US007929897B2

(12) United States Patent
Sugimoto et al.

(10) Patent No.: US 7,929,897 B2
(45) Date of Patent: Apr. 19, 2011

(54) CLEANING UNIT, PROCESS CARTRIDGE, AND IMAGE FORMING APPARATUS USING THE SAME

(75) Inventors: Naomi Sugimoto, Kawasaki (JP); Hidetoshi Yano, Yokohama (JP); Kenji Sugiura, Yokohama (JP); Osamu Naruse, Yokohama (JP); Yasuyuki Yamashita, Zema (JP)

(73) Assignee: Ricoh Company, Ltd., Tokyo (JP)

( * ) Notice: Subject to any disclaimer, the term of this patent is extended or adjusted under 35 U.S.C. 154(b) by 506 days.

(21) Appl. No.: 12/031,333

(22) Filed: Feb. 14, 2008

(65) Prior Publication Data

US 2008/0193179 A1 Aug. 14, 2008

(30) Foreign Application Priority Data

Feb. 14, 2007 (JP) ..... 2007-033718

(51) Int. Cl.
*G03G 21/00* (2006.01)

(52) U.S. Cl. ..... 399/353; 399/359; 399/343; 399/71

(58) Field of Classification Search ..... 399/353, 399/343, 71, 34, 359
See application file for complete search history.

(56) References Cited

U.S. PATENT DOCUMENTS

| | | | | |
|---|---|---|---|---|
| 5,481,351 | A * | 1/1996 | Kawai et al. | 399/359 |
| 5,606,408 | A | 2/1997 | Yano et al. | |
| 5,619,316 | A | 4/1997 | Shoji et al. | |
| 5,740,494 | A * | 4/1998 | Shoji et al. | 399/71 |
| 5,765,087 | A | 6/1998 | Yano et al. | |
| 5,809,373 | A * | 9/1998 | Yoda et al. | 399/101 |
| 5,999,773 | A | 12/1999 | Yasutomi et al. | |
| 6,799,012 | B2 | 9/2004 | Shakuto et al. | |
| 6,987,944 | B2 | 1/2006 | Shakuto et al. | |
| 7,062,212 | B2 | 6/2006 | Naruse et al. | |
| 7,103,301 | B2 | 9/2006 | Watanabe et al. | |
| 7,123,872 | B2 | 10/2006 | Shakuto et al. | |
| 7,184,699 | B2 | 2/2007 | Naruse et al. | |
| 7,209,699 | B2 | 4/2007 | Yamaguchi et al. | |
| 2004/0197122 | A1 | 10/2004 | Nakano et al. | |
| 2004/0234294 | A1 * | 11/2004 | Nagame et al. | 399/159 |
| 2005/0058474 | A1 | 3/2005 | Watanabe et al. | |
| 2005/0254868 | A1 | 11/2005 | Naruse et al. | |
| 2006/0099016 | A1 | 5/2006 | Watanabe et al. | |

(Continued)

FOREIGN PATENT DOCUMENTS

| | | |
|---|---|---|
| JP | 63-219624 | 9/1988 |
| JP | 01-183520 | 7/1989 |
| JP | 01-213411 | 8/1989 |
| JP | 01-292116 | 11/1989 |

(Continued)

*Primary Examiner* — David M Gray
*Assistant Examiner* — Roy Yi
(74) *Attorney, Agent, or Firm* — Oblon, Spivak, McClelland, Maier & Neustadt, L.L.P.

(57) ABSTRACT

A cleaning apparatus for removing charged particles includes a cleaning brush and a recovery unit. The cleaning brush removes the charged particles from an object by attracting the charged particles having positive and negative polarity. The recovery unit for recovering the charged particles from the cleaning brush includes a recovery member, a first charge applicator, a second charge applicator, and a voltage control unit. The recovery member is supplied with a voltage to attract the charged particles. The recovery member has a core and a surface layer. The first charge applicator applies a voltage to the surface layer of the recovery member. The second charge applicator applies a voltage to the core of the recovery member. The voltage control unit controls a polarity of the voltage to be applied by the first and second charge applicators depending on a polarity of the charged particles to be recovered.

20 Claims, 26 Drawing Sheets

U.S. PATENT DOCUMENTS

| | | | |
|---|---|---|---|
| 2006/0133872 | A1 | 6/2006 | Sugiura et al. |
| 2006/0285897 | A1 | 12/2006 | Sugiura et al. |
| 2006/0285898 | A1 | 12/2006 | Watanabe et al. |
| 2007/0003337 | A1 | 1/2007 | Shakuto et al. |
| 2007/0166087 | A1 | 7/2007 | Yamaguchi et al. |
| 2009/0035038 | A1 | 2/2009 | Sugimoto et al. |
| 2009/0092428 | A1 | 4/2009 | Yano et al. |

FOREIGN PATENT DOCUMENTS

| | | |
|---|---|---|
| JP | 05-119684 | 5/1993 |
| JP | 10-131035 | 5/1998 |
| JP | 10-310974 | 11/1998 |
| JP | 2004-240316 | 8/2004 |
| JP | 2005-265907 | 9/2005 |
| JP | 2006-189502 | 7/2006 |

* cited by examiner

CLEANING UNIT, PROCESS CARTRIDGE, AND IMAGE FORMING APPARATUS USING THE SAME

CROSS-REFERENCE TO RELATED APPLICATIONS

This application claims priority from Japanese Patent Application No. 2007-033718 filed on Feb. 14, 2007 in the Japan Patent Office, the entire contents of which are hereby incorporated by reference herein.

BACKGROUND OF THE INVENTION

1. Field of the Invention

The present disclosure relates generally to an image forming apparatus and a process cartridge having a cleaning unit.

2. Description of the Background Art

Typically, an image forming apparatus employing electrophotography includes a photoconductor for forming a toner image thereon, and a cleaning unit for removing toner particles remaining on the photoconductor after transferring the toner image to a transfer member such as a sheet. Such cleaning unit may employ a blade cleaning method, which uses a rubber blade to remove toner particles from a photoconductor by contacting the blade to the photoconductor.

However, such blade cleaning method may have some drawbacks. For example, if a blade and a surface of photoconductor do not contact precisely, toner particles may pass through a tiny space between the blade and the photoconductor. Such drawback may be suppressed by contacting the blade to the photoconductor with a higher pressure. However, if the blade is pressed to the photoconductor with a higher pressure, the blade may curl, which may result in insufficient cleaning of the photoconductor, appearing as streaks. Further, if the blade is pressed to the photoconductor with a higher pressure, the blade more likely scrapes the surface of photoconductor and thereby reducing a lifetime of the photoconductor, which is undesirable.

Further, in view of recent market demand for higher quality image, toner particles having a smaller diameter have been introduced to the market. Further, in view of a constant need to reduce toner manufacturing costs and enhance toner transfer performance, more and more image forming apparatuses employ spherical toners having toner particles of more or less uniform spherical shape produced by polymerization instead of pulverized toner having toner particles of non-uniform shape. However, the blade cleaning method described above may be less effective in cleaning spherical toner particles having a smaller diameter compared to pulverized toner particles.

One background art technique discloses an electrostatic brush cleaning method for coping with such drawbacks of the blade cleaning method. The electrostatic brush cleaning method may have a good level of cleaning performance for spherical toner having a smaller diameter, and may reduce mechanical abrasion of a photoconductor (i.e., scraping of surface coat of a photoconductor) caused by friction with a blade.

Such electrostatic brush cleaning method may use a cleaning brush and a recovery roller, in which the cleaning brush having brush fibers contacts a surface of photoconductor to remove toner particles remaining on the photoconductor, and the recovery roller contacts the cleaning brush to remove toner particles adhering to the cleaning brush.

When conducting a cleaning operation by an electrostatic brush cleaning method, a given voltage is applied to either or both the cleaning brush and the recovery roller. For example, the cleaning brush may be supplied with a voltage having one polarity, which is opposite to a polarity of charged toner particles on the photoconductor, by which toner particles on the photoconductor can be removed and transferred to the brush fibers of the cleaning brush by electrostatic force. Such mechanism can enhance cleaning performance for spherical toner particles having a smaller diameter.

Generally, toner image or toner particles developed on a photoconductor has one polarity (referred as a first polarity), and a transfer unit of an image forming apparatus is supplied with a voltage having another polarity (referred as a second polarity) opposite to the first polarity of developed toner image or particles. When the transfer unit applies the second polarity to the developed toner image having the first polarity, a toner image is transferred from the photoconductor to a transfer member (e.g., transfer sheet). In such image transfer process, an electric charge having the second polarity is applied to toner particles developed on the photoconductor and having the first polarity.

Such toner particles developed on the photoconductor may have a different potential value, that is, some toner particles may have a smaller potential value (referred as weakly charged toner particles). If the electric charge having the second polarity is applied to such weakly charged toner particles, such weakly charged toner particles may change their polarity from the first polarity to the second polarity. Consequently, after a toner-image transfer process, toner particles remaining on the photoconductor may be a mixture of two types of toners, that is, toner particles having the first polarity (i.e., polarity of developed toner image) and toner particles having the second polarity.

As noted above, a cleaning brush for cleaning toner particles remaining on a photoconductor is supplied with a voltage having a given polarity. Accordingly, some toner particles remaining on the photoconductor have a polarity opposite to a voltage polarity applied to the cleaning brush, and some toner particles on the photoconductor have a polarity which is the same as voltage polarity applied to the cleaning brush. Therefore, toner particles having a polarity the same as a voltage polarity applied to the cleaning brush may not be attracted to the cleaning brush, and thereby the cleaning brush cannot remove such toner particles, resulting in poor cleaning performance.

A cleaning brush has been devised to cope with such drawbacks. For example, a cleaning brush is supplied with a voltage having one given polarity from a power source, and the same cleaning brush has brush edges frictionally electrified to another polarity opposite to the applied given polarity, by using a friction of brush fibers of the cleaning brush and a photoconductor. Such configured cleaning brush may attract toner particles having a polarity opposite to the voltage polarity applied to the cleaning brush, and also attract toner particles having a polarity the same as the voltage polarity applied to the cleaning brush. Such mechanism may suppress phenomenon that toner particles on the photoconductor are not be captured by the cleaning brush After recovering and attracting toner particles to the cleaning brush as above described, toner particles adhering to such cleaning brush may be removed and transferred to a recovery roller, which is supplied with a given voltage from a power source. Specifically, the recovery roller is supplied with a first recovery voltage set higher than a voltage applied to the cleaning brush with a same polarity, by which toner particles having a polarity opposite to a voltage polarity applied to the cleaning brush and adhered on the cleaning brush may be electrostatically attracted to the recovery roller from the cleaning brush.

Then, assuming that toner particles adhered on the cleaning brush still have a given level of electric charges, the recovery roller is supplied with a second recovery voltage having a polarity opposite to the first recovery voltage by using a switching device, which is used to switch voltage polarity applied to the recovery roller. Accordingly, toner particles adhering to the cleaning brush and having a polarity the same as voltage polarity applied to the cleaning brush can be electrostatically attracted to the recovery roller from the cleaning brush. With such process, the recovery roller may recover toner particles having positive and negative polarity adhering to the cleaning brush.

However, if the recovery roller is made of a conductive metal material such as stainless steel (SUS) or the like, some toner particles may not be effectively recovered by the recovery roller from the cleaning brush, and such residual toner particles remaining on the cleaning brush may re-adhere to the photoconductor, degrading cleaning performance.

Further, the cleaning brush, contacting the recovery roller made of SUS, may have a potential substantially similar to a potential of the recovery roller. In such a case, the recovery roller and the cleaning brush may have a smaller potential difference, by which toner particles may not be effectively attracted to and recovered by the recovery roller.

Further, when the cleaning brush is observed after recovering toner particles having a polarity the same as voltage polarity applied to the cleaning brush by the recovery roller, some toner particles still adhere to the cleaning brush. Such toner particles may continue to adhere to the cleaning brush until a subsequent printing job. If such next printing job is not conducted for a long period of time, an electric charge amount of such adhered toner particles may become substantially zero. If the electric charge amount of such adhered toner particles becomes zero, such toner particles having zero potential may not be electrostatically attracted to the recovery roller but may remain on the cleaning brush even if a next printing job is conducted.

Based on further observation of such cleaning brush and recovery roller, it is found that some toner particles on the cleaning brush are strongly charged when toner particles are recovered from the cleaning brush to the recovery roller, in which the recovery roller may introduce electric charges to toner particles on the cleaning brush and then toner particles adhering to the cleaning brush are strongly charged with a polarity the same as the voltage polarity applied to the cleaning brush. Accordingly, such strongly charged toner particles having a polarity the same as the voltage polarity applied to the cleaning brush may re-adhere to the photoconductor.

Further, it is also observed that some toner particles invert their polarity with an introduction of electric charges by the recovery roller when toner particles are recovered to the recovery roller from the cleaning brush. Accordingly, such polarity-inverted toner particles may not be recovered by the recovery roller, and may continue to adhere to the cleaning brush after one printing job has been completed.

In view of such phenomenon, a recovery roller having a metal core made of a conductive material such as SUS and a surface layer made of insulating material was prepared as a high-resistance recovery roller, and such high-resistance recovery roller shows some effects as follows.

For example, such high-resistance roller may have an effect of suppressing electric charge introduction to toner particles when the toner particles are recovered by a high-resistance recovery roller from a cleaning brush, and also have an effect of suppressing polarity inversion of toner particles adhered on the cleaning brush. With such configuration, toner particles may not remain on the cleaning brush or may not re-adhere to the photoconductor.

At the same time, however, such high-resistance recovery roller may not effectively recover toner particles under a lower temperature/lower humidity environment, especially when toner particles are input (or used) in greater amount.

In view of such phenomenon, a surface potential of such high-resistance recovery roller under lower temperature/lower humidity environment after recovering toner particles from the cleaning brush was measured, and such measured surface potential of the high-resistance recovery roller was found to be lower than an initial surface potential of the high-resistance recovery roller by about several hundred volts, wherein the initial surface potential was measured before conducting a toner recovery operation.

If the surface potential of the high-resistance recovery roller declines, a potential difference between a cleaning brush edge of a cleaning brush and a surface of the high-resistance recovery roller decreases. As a result, the high-resistance recovery roller may not effectively attract toner particles adhering to the cleaning brush, and therefore toner particles may not be effectively recovered by the high-resistance recovery roller.

Although the cause of such surface potential decline of a high-resistance recovery roller is not yet known, such surface potential decline of high-resistance recovery roller was not observed when a cleaning brush was operated without inputting or adhering toner particles to a cleaning brush. Accordingly, it may be said that such surface potential decline may be related to toner recovery.

For example, such surface potential decline may occur as follows: When toner particles adhere to the high-resistance recovery roller, toner particles may give electric charges having a polarity opposite to a voltage polarity applied to the high-resistance recovery roller to a surface of the high-resistance recovery roller, by which a surface potential of the high-resistance recovery roller may decrease. Further, toner particles adhering to the high-resistance recovery roller and having a polarity opposite to voltage polarity applied to the high-resistance recovery roller may be scraped by a recovery blade, which contacts the surface of the high-resistance recovery roller. During such scraping process by the recovery blade, electric discharge may occur on the high-resistance recovery roller, decreasing a surface potential of the high-resistance recovery roller.

Consequently, toner particles may not be effectively recovered when a high-resistance recovery roller is used in certain lower temperature/lower humidity environments, which is undesirable.

SUMMARY

The present invention provides a cleaning apparatus for removing charged particles from a surface of an object. The cleaning apparatus includes a cleaning brush and a recovery unit. The cleaning brush removes the charged particles from the surface of the object, moving in a given direction, by attracting the charged particles to the cleaning brush. The cleaning brush attracts the charged particles having positive and negative polarity from the object. The recovery unit for recovering the charged particles adhering to the cleaning brush includes a recovery member, a first charge applicator, a second charge applicator, and a voltage control unit. The recovery member is supplied with a given voltage and contacted the cleaning brush to electrostatically attract the charged particles from the cleaning brush. The recovery member has a core made of a conductive material and a surface layer formed on the core. The surface layer is made of an insulating material. The first charge applicator applies a given voltage polarity to the surface layer of the recovery member. The second charge applicator applies a given voltage polarity to the core of the recovery member. The voltage control unit controls a polarity of the given voltage to be applied by the first charge applicator and the second charge applicator depending on a polarity of the charged particles to be recovered by the recovery unit.

The present invention also provides an image forming apparatus including an image carrier, a charge unit for charging the image carrier, a writing unit for writing a latent image on the image carrier charged by the charge unit, a developing unit for developing the latent image on the image carrier as toner image using toner particles, a transfer unit for transferring the toner image from the image carrier to a transfer member or a recording member, and a first cleaning apparatus for removing toner particles remaining on a surface of the image carrier after transferring the toner image. The first cleaning apparatus includes a cleaning brush and a recovery unit. The first cleaning brush removes the charged toner particles from the surface of the object, moving in a given direction, by attracting the charged toner particles to the cleaning brush. The cleaning brush attracts the charged toner particles having positive and negative polarity from the object. The recovery unit for recovering the charged toner particles adhering to the cleaning brush includes a recovery member, a first charge applicator, a second charge applicator, and a voltage control unit. The recovery member is supplied with a given voltage and contacted the cleaning brush to electrostatically attract the charged toner particles from the cleaning brush. The recovery member has a core made of a conductive material and a surface layer formed on the core. The surface layer is made of an insulating material. The first charge applicator applies a given voltage polarity to the surface layer of the recovery member. The second charge applicator applies a given voltage polarity to the core of the recovery member. The voltage control unit controls a polarity of the given voltage to be applied by the first charge applicator and the second charge applicator depending on a polarity of the charged toner particles to be recovered by the recovery unit.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
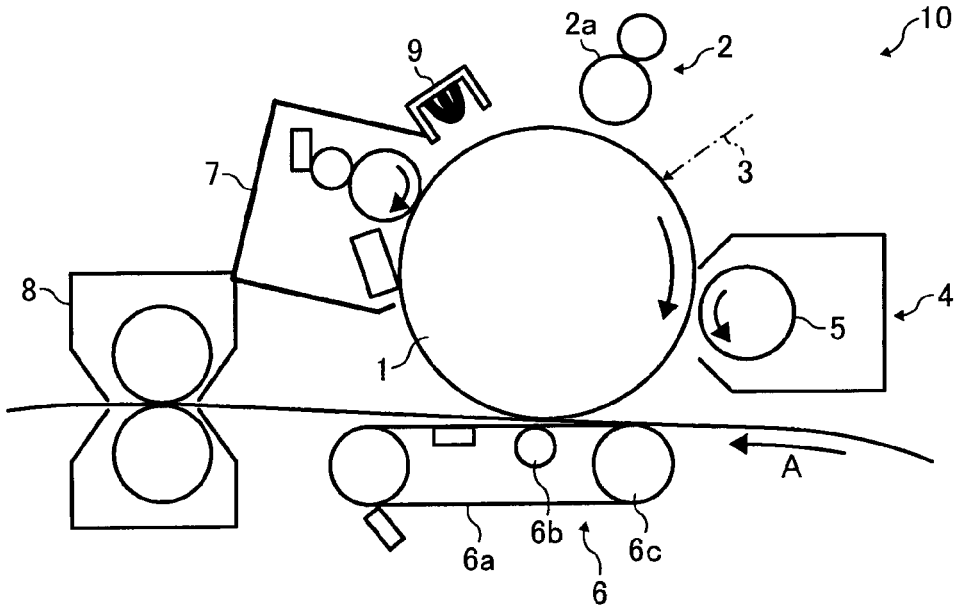
FIG. 1 illustrates an schematic configuration of an image forming apparatus having a cleaning unit according to an exemplary embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded view s shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus according to an exemplary embodiment is described with reference to accompanying drawings. The image forming apparatus may employ electrophotography, for example.

FIG. 1 illustrates a schematic configuration of an image forming apparatus 10 according to an exemplary embodiment. The image forming apparatus 10 includes a photoconductor 1, a charge unit 2, a developing unit 4, a transfer unit 6, a cleaning unit 7, a fixing unit 8, and a decharging unit 9, for example.

The photoconductor 1 having a drum shape may rotate at a given speed (e.g., 250 mm/sec) in a direction shown by an arrow. After a surface of the photoconductor 1 is uniformly charged to a given potential by the charge unit 2, a writing unit (not shown) irradiates a light beam 3 onto the photoconductor 1, wherein the light beam 3 is generated based on image data of documents scanned by a scanner (not shown). With such light irradiation, an electrostatic latent image is formed on the photoconductor 1, and then developed as toner image by the developing unit 4.

As illustrated in FIG. 1, the developing unit 4 includes a developing roller 5, which carries and transports a developing agent composed of toner particles and carrier particles. Such toner particles may be charged to a given polarity by friction in the developing unit 4. In an exemplary embodiment, toner particles may be charged to negative polarity in the developing unit 4, for example. Toner particles carried and transported by the developing roller 5 are electrostatically transferred to the photoconductor 1 to develop the electrostatic latent image as visible image (e.g., toner image). The toner image formed on the photoconductor 1 is then transferred to a transfer sheet, fed by a feed unit (not shown) in a direction of an arrow A, with an effect of the transfer unit 6.

The transfer sheet having the toner image thereon is further guided to the fixing unit 8, in which heat and pressure is applied to fix the toner image on the transfer sheet, and such transfer sheet is ejected from the image forming apparatus 10 by an ejection unit (not shown). After the toner image is transferred to the transfer sheet from the photoconductor 1, the cleaning unit 7 removes toner particles remaining on the photoconductor 1. After the cleaning unit 7 removes toner particles from the photoconductor 1, the decharging unit 9 decharges the surface of the photoconductor 1, by which the photoconductor 1 is set ready for a next image forming operation.

As illustrated in FIG. 1, the charge unit 2 includes a charge roller 2*a*, which has a core made of a conductive material and a resistive layer formed on the core. The charge roller 2*a* is pressed to the surface of the photoconductor 1 with a given pressure (e.g., 500 gf) by a pressure applicator (not shown). Such charge roller 2*a* may rotate when the photoconductor 1 rotates. If the surface of the charge roller 2*a* has too small coefficient of static friction, the charge roller 2*a* may be rotated by a driver (not shown) because such charge roller 2*a* having too small coefficient of static friction may not rotate when the photoconductor 1 rotates. The charge unit 2 having the charge roller 2*a* may have a longitudinal length in an axial direction of the charge roller 2*a*, which is set longer than a maximum image forming range on the photoconductor 1 (e.g., about 300 mm if a maximum image forming size is set to A4 for an image forming apparatus).

The core of the charge roller 2*a* is connected to a power source (not shown), which is used to apply a charging voltage to the charge roller 2*a*. With an application of power to the charge roller 2*a*, a given potential difference is formed between the photoconductor 1 and the charge roller 2*a*. For example, a charging voltage, which can charge a surface potential of the photoconductor 1 to a given potential (e.g., −700V), is applied to the charge roller 2*a*, by which an electric discharge may occur between the charge roller 2*a* and the photoconductor 1, and the photoconductor 1 is uniformly charged.

Such charging voltage may be a superimposed voltage having DC (direct current) voltage superimposed with AC (alternating current) voltage. For example, a charging voltage having frequency of 1.8 kHz, a peak voltage of 2 kV, and an offset voltage of −740 V is applied, for example. If a generation of toxic gas such as ozone, NOx (nitrogen oxides) or the like may need to be suppressed, DC voltage alone is applied because DC voltage may cause to emit less toxic gas compared to a superimposed voltage. If the photoconductor 1 may need to be uniformly charged, a superimposed voltage is preferable. Other than the charge roller 2*a*, the charging unit 2 may employ a charge blade, a charge brush, or the like.

Although the charge roller 2*a* may be contactingly pressed to the photoconductor 1 in an exemplary embodiment, a charging unit may be disposed to a position proximity to the photoconductor 1, in which a charging device may not contact a surface of the photoconductor 1 while maintaining a given gap with the photoconductor 1, wherein such non-contact type charging unit may similarly charge the photoconductor 1. As such, a charging unit, which may contact or not contact the surface of the photoconductor 1, can be used similarly in an exemplary embodiment.

As illustrated in FIG. 1, the transfer unit 6 includes a transfer belt 6*a*, a transfer roller 6*b*, and a drive roller 6*c*, for example. The transfer belt 6*a* is contactable to the surface of the photoconductor 1.

After developing an electrostatic latent image formed on the photoconductor 1 as toner image with the developing unit 4, the toner image is transferred to a transfer sheet with an effect of the transfer roller 6*b* of the transfer unit 6, in which the transfer roller 6*b* is applied with a given transfer voltage, under a constant current control, having a polarity opposite to a polarity of charged toners particles forming the toner image. For example, if a polarity of charged toners particles is negative polarity, a current (e.g., 30 μA) having positive polarity is applied to the transfer roller 6*b* as transfer voltage.

Therefore, toner particles remaining on the surface of the photoconductor 1 after transferring the toner image at a transfer position (or nip) may have two polarities, which may mean some remaining toner particles may have negative polarity (i.e., same as developed toner image) and some other remaining toner particles may have positive polarity, which is opposite to negative polarity, with an effect of the transfer voltage applied by the transfer roller 6*b*. Although the transfer unit 6 shown in FIG. 1 may include a transfer belt contactable to the surface of the photoconductor 1, and a transfer roller and a drive roller, a transfer unit having other configuration can be used.

Figure 2:
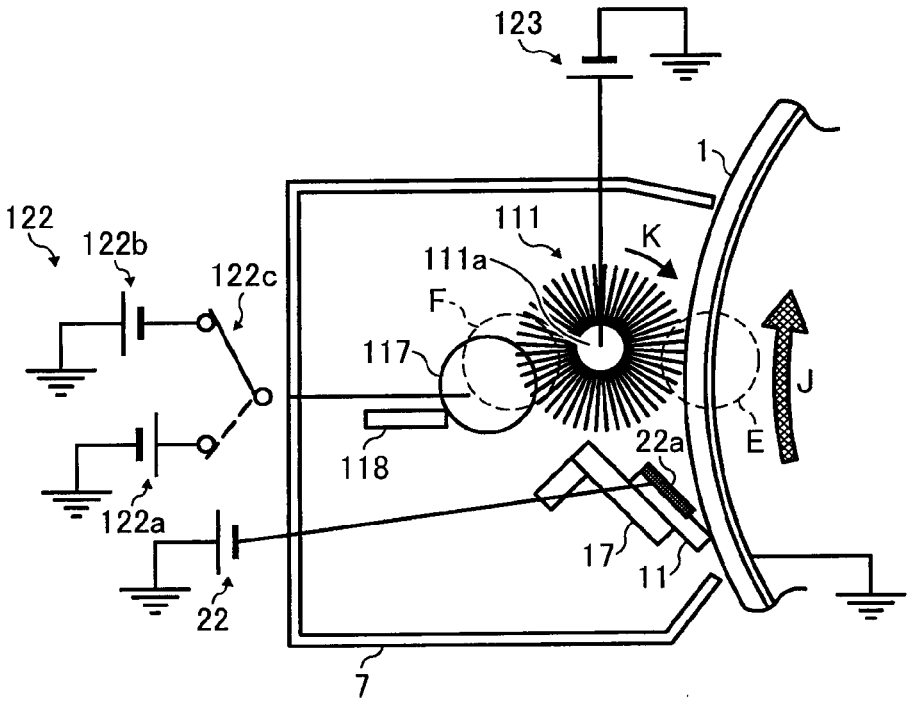
FIG. 2 illustrates an expanded view of a cleaning unit according to an exemplary embodiment.

A description is now given to the cleaning unit 7 with reference to FIG. 2. As illustrated in FIG. 2, the cleaning unit 7 includes a conductive blade 11 and a cleaning brush 111, for example. The conductive blade 11 is used to control polarity of toner particles.

As illustrated in FIG. 2, the photoconductor 1 may move in a direction shown by an arrow J. Accordingly, the surface of the photoconductor 1 also moves in a direction shown by the arrow J. Hereinafter, the direction shown by the arrow J may be referred as "surface movement direction" of the photoconductor 1 and such movement may be referred as "surface movement" of the photoconductor 1 for the simplicity of expression. Although the surface movement direction shown in FIG. 2 is a clockwise direction, the surface movement direction can be changed to a counter-clockwise direction depending on a configuration of the cleaning unit 7. As illustrated in FIG. 2, the conductive blade 11 is positioned at an upstream side of the cleaning brush 111 with respect to the surface movement direction of the photoconductor 1.

For example, the conductive blade 11 is made of an elastic member such as rubber having a given electric resistance such as $10^5$ Ω·cm to $10^9$ Ω·cm, and contacts the photoconductor 1 with a given pressure such as 20 g/cm to 40 g/cm. Further, the conductive blade 11 may be fixed to a blade holder 17 provided in the cleaning unit 7. Further, the conductive blade 11 is attached with an electrode 22*a* in its longitudinal direction, wherein the electrode 22*a* is connected to a first power source circuit 22, which applies a given voltage to the electrode 22*a*. The conductive blade 11 applied with a given voltage introduces electric charges to remaining toner particles when remaining toner particles pass through the conductive blade 11 so that remaining toner particles passed through the conductive blade 11 may be set to a uniform polarity. In this disclosure, such "pass through" of toner particles may mean that most of toner particles are captured by the conductive blade 11, and toner particles not captured by the conductive blade 11 may remain on the photoconductor 1 while receiving an electric effect of the conductive blade 11.

On one hand, the cleaning brush 111, driven by a driver (not shown), rotates in a direction same as a rotation direction of the photoconductor 1. Accordingly, the cleaning brush 111 and the photoconductor 1 move in an opposite direction at a point where cleaning brush 111 and the photoconductor 1 meet each other.

The cleaning brush 111 includes a metal core and a brush fiber fixed around the metal core. For example, the metal core may be made of stainless steel (SUS), and the brush fiber may be made of conductive brush fibers prepared by implanting conductive materials (e.g., carbon, ionic conductive agent) in an insulating material fiber made of nylon, polyester, acrylic, or the like. Further, the cleaning brush 111 is connected to a third power source circuit 123, wherein the third power source circuit 123 applies a given voltage having a given polarity, opposite to a voltage polarity applied to the conductive blade 11, to the cleaning brush 111.

Hereinafter, the conductive blade 11 may be applied with a voltage having a first polarity and the cleaning brush 111 may be applied with a voltage having a second polarity, in which the first and second polarities are opposite polarity each other. The first and second polarities may be set to as positive and negative polarity, respectively, or negative and positive polarity respectively depending on a design concept of an image forming apparatus.

As illustrated in FIG. 2, the cleaning unit 7 further includes a recovery roller 117, which contacts the cleaning brush 111, and a second power source circuit 122, which applies a given voltage to the recovery roller 117. The second power source circuit 122 includes a primary power source 122*a*, a secondary power source 122*b*, and a switch 122*c*, for example.

The primary power source 122*a* applies a given voltage having a polarity the same as a voltage polarity applied to the cleaning brush 111, to the recovery roller 117, wherein such given voltage has a value set higher than a voltage value applied to the cleaning brush 111. Because the cleaning brush 111 is supplied with a voltage having the second polarity, the primary power source 122*a* applies a voltage having the second polarity to the recovery roller 117.

The secondary power source 122*b* applies a given voltage having a polarity opposite to a voltage polarity applied to the cleaning brush 111, to the recovery roller 117. Because the cleaning brush 111 is supplied with a voltage having the second polarity, the secondary power source 122*b* applies a voltage having the first polarity to the recovery roller 117.

The switch 122*c* is used to switch over a voltage to be applied to the recovery roller 117. Specifically, by switching the switch 122*c*, the recovery roller 117 is supplied with a voltage from one of the primary and secondary power sources 122*a* and 122*b*. Accordingly, a voltage polarity applied to the recovery roller 117 can be switched by switching the switch 122*c*.

Further, the cleaning unit 7 includes a scraper 118, which contacts the recovery roller 117 and a transport coil (not shown).

In such configured cleaning unit 7, toner particles passed through the conductive blade 11 and having the first polarity are electrostatically attracted to the cleaning brush 111 having the second polarity, wherein toner particles is set to have the first polarity when the toner particles pass through the conductive blade 11 applied with a voltage having the first polarity.

As the cleaning brush 111 rotates in the direction shown by an arrow K (see FIG. 2), the remaining toner particles adhered on the cleaning brush 111 is then transported to a position facing the recovery roller 117, at which the recovery roller 117 electrostatically attracts the remaining toner particles adhered on the cleaning brush 111. The remaining toner particles attracted and adhered on the recovery roller 117 are then scraped by the scraper 118, and transported to a waste toner container (not shown) by a transport coil (not shown).

Figure 3:
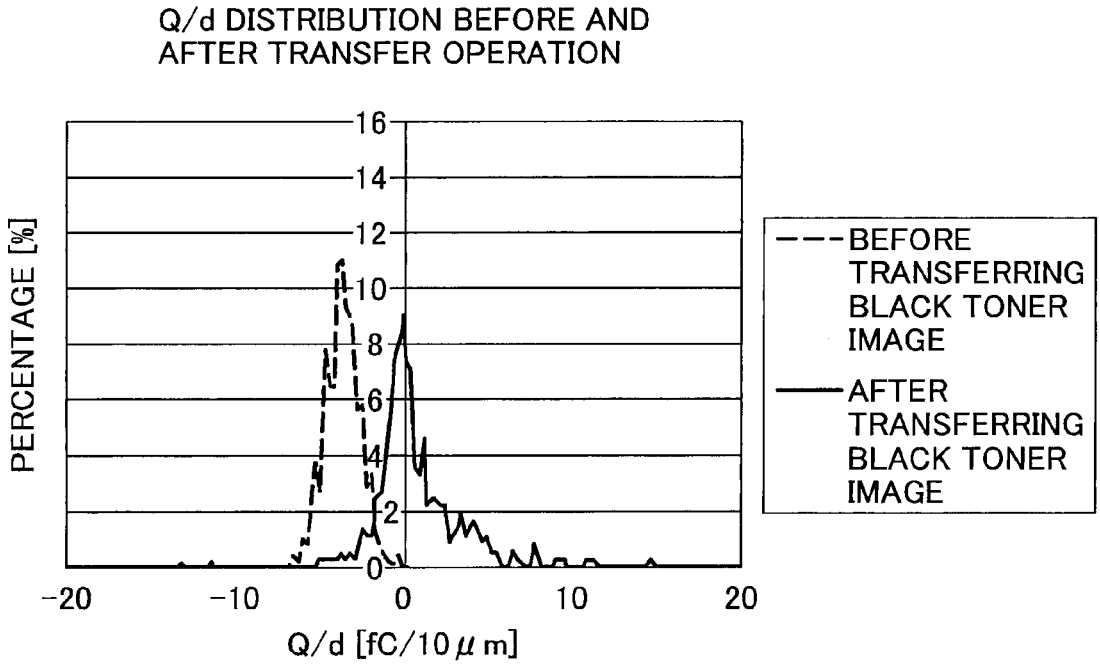
FIG. 3 shows graphs of charge potential distribution of toner particles, in which one graph corresponds to toner particles carried on a photoconductor and just before a toner image transfer operation and another graph corresponds to toner particles remaining on the photoconductor after the toner image transfer operation.

A description is now given to a charge amount of toner particles remaining on a surface of the photoconductor 1 after transferring tone image to a transfer member and transported to an area facing the cleaning unit 7 with reference to FIG. 3. FIG. 3 shows a charge potential distribution of toner particles in two states. A dotted line shows a charge potential distribution of black toner particles developed on the photoconductor 1 and just before an image transfer operation, and a solid line shows a charge potential distribution of black toner particles remaining on the photoconductor 1 after the image transfer operation.

As illustrated in FIG. 3, before the image transfer operation, toner particles developed on the surface of the photoconductor 1 are substantially charged to negative polarity. During the image transfer operation, some toner particles may change their polarity from negative polarity to positive polarity or non-charged condition with an effect of electric charges having positive polarity applied by the transfer roller 6*b* of the transfer unit 6. Accordingly, toner particles remaining on the surface of the photoconductor 1 after the image transfer operation is a mixture of toner particles having positive and negative polarity as illustrated in FIG. 3.

In this disclosure, toner particles developed on the surface of the photoconductor 1 are substantially charged to negative polarity as illustrated in FIG. 3. However, a polarity of toner developed on the surface of the photoconductor 1 may be changed depending on a design concept of an image forming apparatus. For the simplicity of description, toner particles developed on the surface of the photoconductor 1 are substantially charged to negative polarity in this disclosure.

After the image transfer operation is conducted by the transfer roller 6*b*, toner particles remaining on the surface of the photoconductor 1 are then transported to an area facing the conductive blade 11 as the photoconductor 1 rotates in the direction shown by the arrow J (see FIG. 2), at which most of the remaining toner particles are mechanically scraped by the conductive blade 11.

Figure 4:
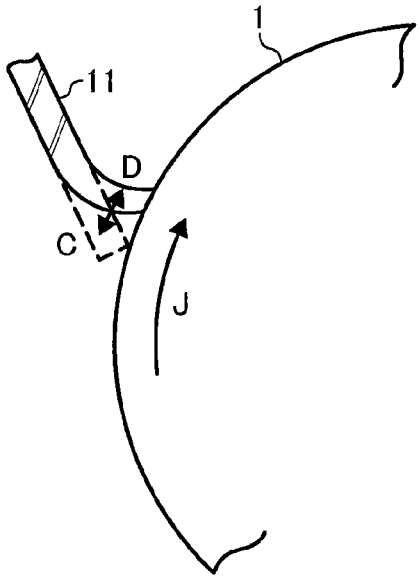
FIG. 4 illustrates a schematic view of a cleaning blade contacting on a surface of the photoconductor.

However, the conductive blade 11 may change its contact condition with the photoconductor 1 as illustrated in FIG. 4 when the photoconductor 1 rotates. As illustrated in FIG. 4, the conductive blade 11 has a straight shape (condition C) when the conductive blade 11 starts to contact the photoconductor 1. Then, with a surface movement of the photoconductor 1, the conductive blade 11 may be warped (condition D) while maintaining a contacting condition with a surface of the photoconductor 1 with an elasticity of the conductive blade 11 made of elastic material such as rubber. Specifically, a contact edge of the conductive blade 11 may be maintained at a contact condition with the photoconductor 1 while warping some portion of the conductive blade 11. However, if the conductive blade 11 cannot maintain such warped condition (condition D) due to some reasons such as limit of elasticity, the conductive blade 11 may change its shape from the warped shape (condition D) to the straight shape (condition C) while slipping on the photoconductor 1, which may be known as stick slip. When such contact condition change occurs, the conductive blade 11 may not effectively scrape toner particles, by which toner particles may not be captured by the conductive blade 11.

Figure 5:
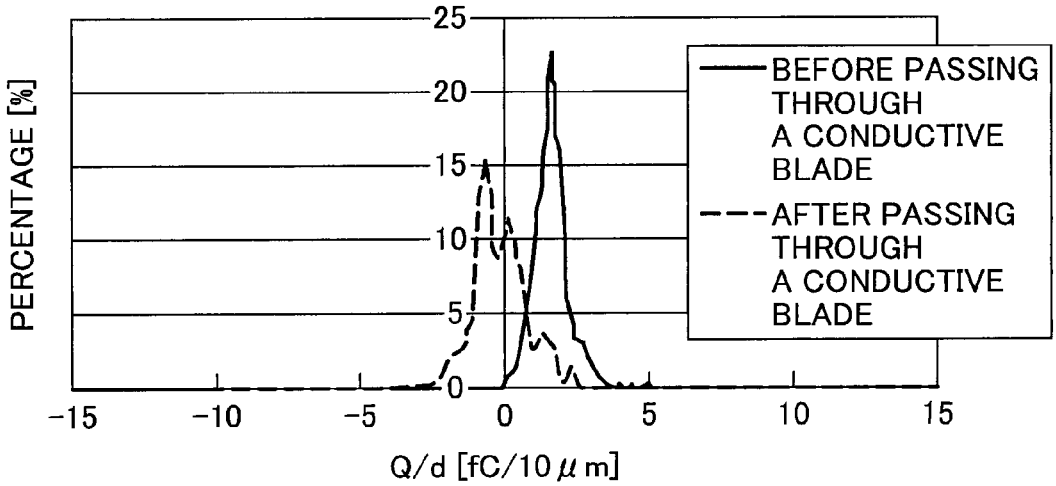
FIG. 5 shows graphs of charge potential distribution of toner particles, in which one graph corresponds to remaining toner particles carried on a photoconductor after a toner image transfer operation and another graph corresponds to toner particles remaining on the photoconductor, which have passed through a position facing a conductive blade.

FIG. 5 shows graphs indicating a change of charge amount of toner particles that pass through the conductive blade 11.

The graphs of FIG. 5 is prepared based on an experiment, in which toner particles developed on a photoconductor were charged to positive polarity by introducing corona ion to toner particles, and such charged toner particles were passed through the conductive blade 11, in which the conductive blade 11 is not connected to a power source.

As illustrated in FIG. 5, some toner particles may change their polarity from positive polarity to negative polarity when toner particles pass through an area facing the conductive blade 11. Accordingly, some toner particles change their polarity to a normal polarity, wherein the normal polarity means that toner particles passed through an area facing the conductive blade 11 are controlled to a polarity, which is set based on a designed concept of cleaning operation. In this disclosure, the normal polarity means negative polarity, for example.

Such polarity change or shift may occur when toner particles pass through the conductive blade 11 because the conductive blade 11 may apply a contact pressure to toner particles, and frictions with toner particles.

However, as shown in FIG. 5, toner particles passed through the conductive blade 11 are still a mixture of toner particles having positive and negative polarity. Accordingly, toner particles passed through the conductive blade 11 may not be charged to a uniform polarity such as negative polarity, which may be set as a normal polarity in this disclosure.

As shown in FIG. 3, toner particles remaining on the photoconductor 1 after an image transfer operation have a charge amount distribution having positive and negative polarity. Therefore, the cleaning brush 111 may not recover any one of toner particles charged to normal polarity and toner particles not charged to normal polarity, by which the cleaning brush 111 may not effectively remove toner particles from the photoconductor 1.

In view of such phenomenon, as above described, a voltage is applied to the conductive blade 11 to introduce electric charges to toner particles, which have passed through the conductive blade 11, so that remaining toner particles passed through the conductive blade 11 can be controlled to a uniform polarity.

If a voltage value applied to the conductive blade 11 is sufficiently smaller than a charging voltage value used for charging the photoconductor 1, toner particles remaining on the photoconductor 1 may be charged to a polarity the same as voltage polarity applied to the conductive blade 11 as follows: When toner particles remaining on the photoconductor 1 may pass through a tiny space between the conductive blade 11 and the photoconductor 1, toner particles may be sandwiched by the conductive blade 11 and the photoconductor 1. Such sandwiched toner particles may be charged to a polarity applied to the conductive blade 11 as similar to a capacitor charging process. Such toner charging process by the conductive blade 11 may be termed as "electric charge introduction to toner particles." With such electric charge introduction, toner particles passed through the conductive blade 11 may be charged to a polarity the same as voltage polarity applied to the conductive blade 11.

On one hand, if a voltage value applied to the conductive blade 11 is substantially similar to or greater than a charging voltage value used for charging the photoconductor 1, toner particles remaining on the photoconductor 1 may be charged to a polarity the same as voltage polarity applied to the conductive blade 11 as follows: The photoconductor 1 and the conductive blade 11 may form a tiny gap having a wedge-like entry and exit portion therebetween. When electric discharging occurs at such tiny gap, toner particles remaining on the photoconductor 1 may be charged to a polarity the same as voltage polarity applied to the conductive blade 11.

However, when experiments were conducted for controlling charge amount of toner particles passed through the conductive blade 11 while applying a given voltage to the conductive blade 11, some experiments show results that a percentage of toner particles charged and controlled to normal polarity did not become 100%. This may be caused by following factors, for example. One of the factors may be type of toner particles because some toner particles may be hard to control its charge amount. Another factors may be a variation of charge amount distribution of toner particles to be contacted with the conductive blade 11, which may be caused by variations of conditions such as usage environment, developed toner adhering amount per unit area, transfer current, image area ratio, types of toner particles, or the like.

Therefore, not all toner particles, passed through the conductive blade 11, may be charged to a polarity the same as voltage polarity applied to the conductive blade 11. If such phenomenon may occur, some toner particles may not be electrostatically attracted to the cleaning brush 111 effectively, by which the cleaning brush 111 may not effectively remove toner particles from the photoconductor 1.

Figure 6:
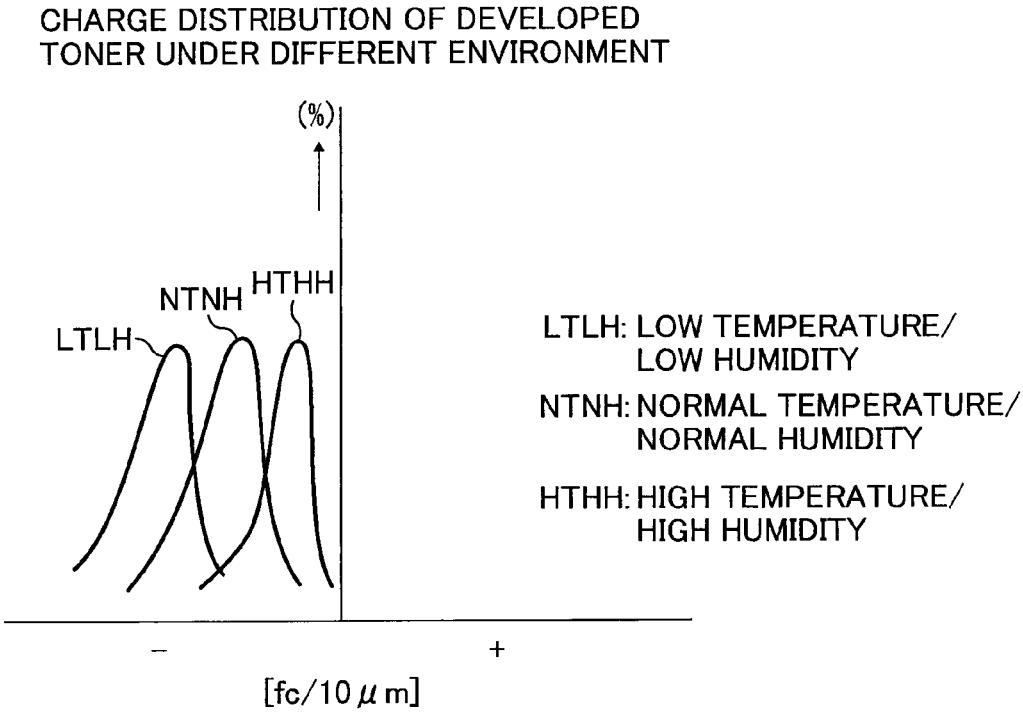
FIG. 6 shows graphs of charge potential distribution of toner particles on a photoconductor before a toner image transfer operation under different environments.
Figure 7:
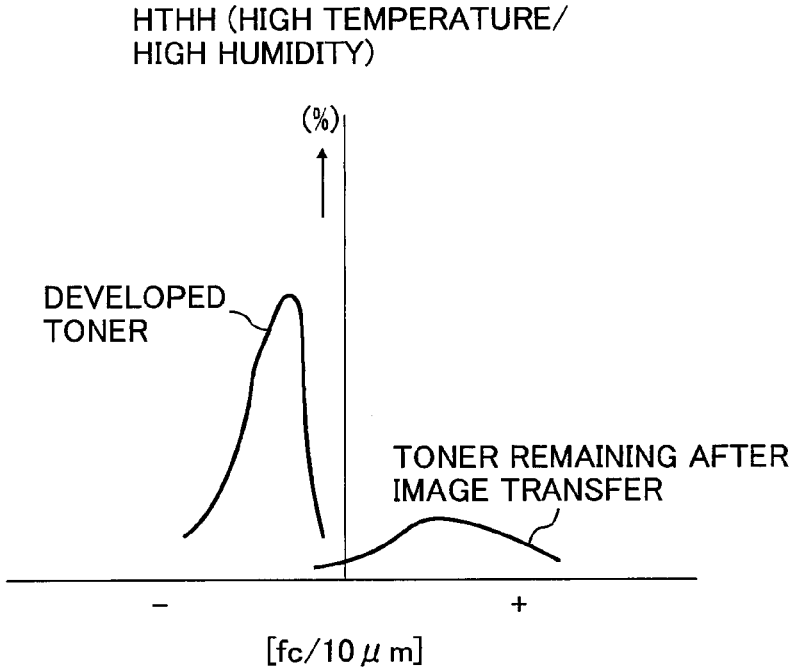
FIG. 7 shows graphs of charge potential distribution of toner particles on a photoconductor under a higher temperature/higher humidity environment, in which one graph corresponds to toner particles before a toner image transfer operation and another graph corresponds to toner particles after the toner image transfer operation.
Figure 8:
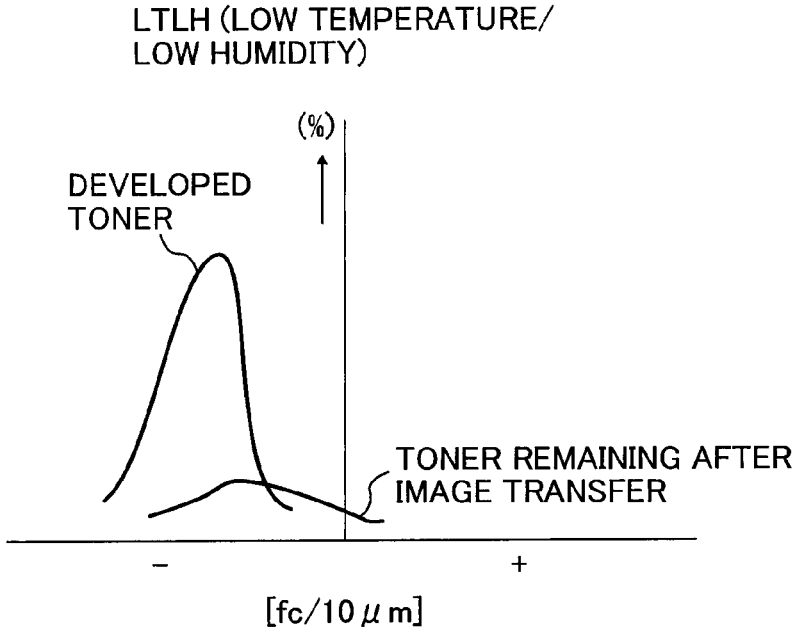
FIG. 8 shows graphs of charge potential distribution of toner particles on a photoconductor under a lower temperature/lower humidity environment, in which one graph corresponds to toner particles before a toner image transfer operation and another graph corresponds to toner particles after the toner image transfer operation.

A description is given to variations of conditions with reference to FIGS. 6 to 8. FIGS. 6 to 8 show a change of charge amount distribution of toner particles used in different environments. The charge amount distribution shown in FIGS. 6 to 8 was measured with E-SPART Analyzer, which is a product of Hosokawa Micron Corporation. The horizontal axis in FIGS. 6 to 8 indicates Q/d value, obtained by dividing a charge amount "Q" of one toner particle with a diameter "d" of the toner particle, wherein the Q/d value is expressed with a unit of "fc/10 μm." The vertical axis in FIGS. 6 to 8 indicates a "percentage (%)" of toner particles having a given Q/d value with respect to sampled toner particles. Accordingly, FIGS. 6 to 8 show histograms of toner particles having a given range of Q/d values. In such experiment, the number of sampled toner particles was five hundred particles because toner particles remaining on the photoconductor is generally so small.

FIG. 6 shows three graphs of charge amount distribution for developed toner particles used in three different environments. Each graph shows charge amount distribution of toner particles under higher temperature/higher humidity (e.g., 32 degrees Centigrade/80% humidity), normal temperature/normal humidity (e.g., 20 degrees Centigrade/50% humidity), and lower temperature/lower humidity (e.g., 10 degrees Centigrade/15% humidity). Because toner particles are charged by friction with carrier particles, toner particles may be less likely to be charged under higher humidity, by which charge amount of the toner particles under higher humidity may become generally smaller. Accordingly, a charge amount distribution under higher temperature/higher humidity may be closer to "zero" of the Q/d value compared to a charge amount distribution under normal temperature/normal humidity, and a charge amount distribution under lower temperature/lower humidity is farther away from "zero" of the Q/d value compared to a charge amount distribution under normal temperature/normal humidity as shown in FIG. 6.

FIG. 7 shows charge amount distribution profile of toner particles under higher temperature/higher humidity (HTHH), in which one profile corresponds to toner particles developed on a photoconductor, and other profile corresponds to toner particles remaining on a photoconductor after an image transfer operation. FIG. 8 shows charge amount distribution profile of toner particles under lower temperature/lower humidity (LTLH), in which one profile corresponds to toner particles developed on a photoconductor, and other profile corresponds to toner particles remaining on a photoconductor after an image transfer operation.

As shown in FIG. 7, under a higher temperature/higher humidity condition, remaining toner particles have a greater number of toner particles charged to positive polarity side after an image transfer operation. As shown in FIG. 8, under a lower temperature/lower humidity condition, remaining toner particles have a greater number of toner particles charged to negative polarity side after an image transfer operation. Such charge amount distribution profile may vary by other conditions such as sheet thickness.

Although charge amount of toner particles may vary depending on environment condition, sheet thickness, transfer condition, image area ratio, or the like, 90% of remaining toner particles passed through the conductive blade 11 may be set to a polarity the same as voltage polarity applied to the conductive blade 11 if the conductive blade 11 is applied with an appropriate voltage.

However, depending on types of toner particles, polarity of toner particles may not be effectively controlled to a desired polarity. For example, in case of some toner particles, only 80% of remaining toner particles passed through the conductive blade 11 may be set to a polarity the same as voltage polarity applied to the conductive blade 11 even if the conductive blade 11 is applied with a given voltage such as 1 kV, for example, and 20% of remaining toner particles may become a polarity opposite to a polarity applied to the conductive blade 11. It is not known yet why such ineffective polarity control may occur to some toner particles.

However, such toner particles having a polarity, opposite to a polarity applied to the conductive blade 11, can be attracted by the cleaning brush 111 as described below, by which toner particles may be effectively removed from the photoconductor 1. A description is now given to the cleaning brush 111 in more detail.

In an exemplary embodiment, the cleaning brush 111 in the cleaning unit 7 has brush fibers having following structure. The brush fibers of the cleaning brush 111 is made of a material, which can be set to a polarity the same as voltage polarity applied to the conductive blade 11, when the brush fibers are frictioned with the photoconductor 1. In other words, a material used for the brush fibers of the cleaning brush 111 can be charged to a polarity the same as voltage polarity applied to the conductive blade 11 when brush fibers friction with a material used for the surface of the photoconductor 1.

As above noted, 90% or more of toner particles passed through the conductive blade 11 may be charged to a polarity the same as voltage polarity applied to the conductive blade 11. Because the cleaning brush 111 is supplied with a voltage having a polarity opposite to a voltage polarity applied to the conductive blade 11, such 90% or more of toner particles may be electrostatically attracted to the cleaning brush 111.

For the simplicity of expression in this disclosure, as previously noted, the conductive blade 11 is supplied with a voltage having a first polarity from a power source, and the cleaning brush 111 is supplied with a voltage having a second polarity from a power source, in which the first and second polarities are opposite polarity each other.

Further, 10% or less of toner particles having a polarity (i.e., second polarity) opposite to a voltage polarity (i.e., first polarity) applied to the conductive blade 11 may be captured by the brush fibers of the cleaning brush 111 as below: Brush fibers of the cleaning brush 111 are frictioned with the photoconductor 1 and charged to the first polarity (i.e., negative polarity), which is a polarity applied to the conductive blade 11. Accordingly, an electrostatic attraction can be generated between a surface of an insulating layer of the brush fiber of the cleaning brush 111 and such 10% or less of toner particles having the second polarity (i.e., positive polarity), by which such 10% or less of toner particles may be attracted to the cleaning brush 111.

Such 10% or less of toner particles captured by such frictional electrification of the brush fibers are toner particles, not controlled to the first polarity (i.e., negative polarity) by the conductive blade 11, that is, such 10% or less of toner particles have the second polarity (i.e., positive polarity).

Such 10% or less of toner particles having the second polarity (i.e., positive polarity) may have a greater charge amount before passing through the conductive blade 11, by which a polarity of such toner particles may not be inverted although the conductive blade 11 introduces electric charges of the first polarity (i.e., negative polarity) to toner particles.

However, after passing through the conductive blade 11, a charge amount of toner particles having the second polarity (i.e., positive polarity) may be decreased with an effect of electric charge introduction by the conductive blade 11, by which toner particles having the second polarity (i.e., positive polarity) may become weaker-charged toner particles. Such weaker-charged toner particles may be more likely to be captured by the frictionally electrified brush fibers because the weaker-charged toner particles may adhere the photoconductor 1 with a smaller electrostatic force.

Further, because such weaker-charged toner particles still have weaker charge after adhering the brush fiber, such weaker-charged toner particles may receive less effect of electric field formed between the photoconductor 1 and the cleaning brush 111, but may be more likely to receive van der Waals' force with brush fibers or may be more likely to be captured between spaces of brush fibers. Accordingly, toner particles captured by frictionally electrified brush fibers may hardly re-adhere to the surface of the photoconductor 1, but may continue to adhere on the brush fibers.

A description is now given to another experiment for confirming a charge amount distribution of toner particles remaining on the photoconductor 1 before a cleaning operation by the cleaning brush 111, and a charge amount distribution of toner particles adhered on the cleaning brush 111 after the cleaning operation by the cleaning brush 111. In this experiment, spherical toner having circularity of 0.98 was used and a toner image developed on the photoconductor 1 had a toner amount per unit area (M/A) of M/A 0.4 mg/cm$^2$, wherein M is a developed toner weight and A is a developed area.

Under a condition that the cleaning brush 111 is not connected to a power source, the recovery roller 117 was applied with a voltage of +300V. The cleaning brush 111 has brush fibers made of polyester fiber, which can be negatively charged when the brush fibers friction with a surface material of the photoconductor 1. A curled fiber was used as brush fibers of the cleaning brush 111.

In this experiment, the conductive blade 11 is removed from the cleaning unit 7. Three currents (It) of +20 μA, +38 μA, and +42 μA were set as transfer current for transferring a solid image from the photoconductor 1 to a transfer sheet, by which toner particles remaining on the photoconductor 1 can be set to have toner particles having positive and negative polarity, and such toner particles are transported to a position facing the cleaning brush 111. With such setting, toner particles that cannot be electrostatically attracted to the cleaning brush 111 can be prepared. For example, if the cleaning brush 111 may be applied with a voltage having positive polarity, toner particles, set to positive polarity, may not be electrostatically cleaned by (or attracted to) the cleaning brush 111.

Figure 9A:
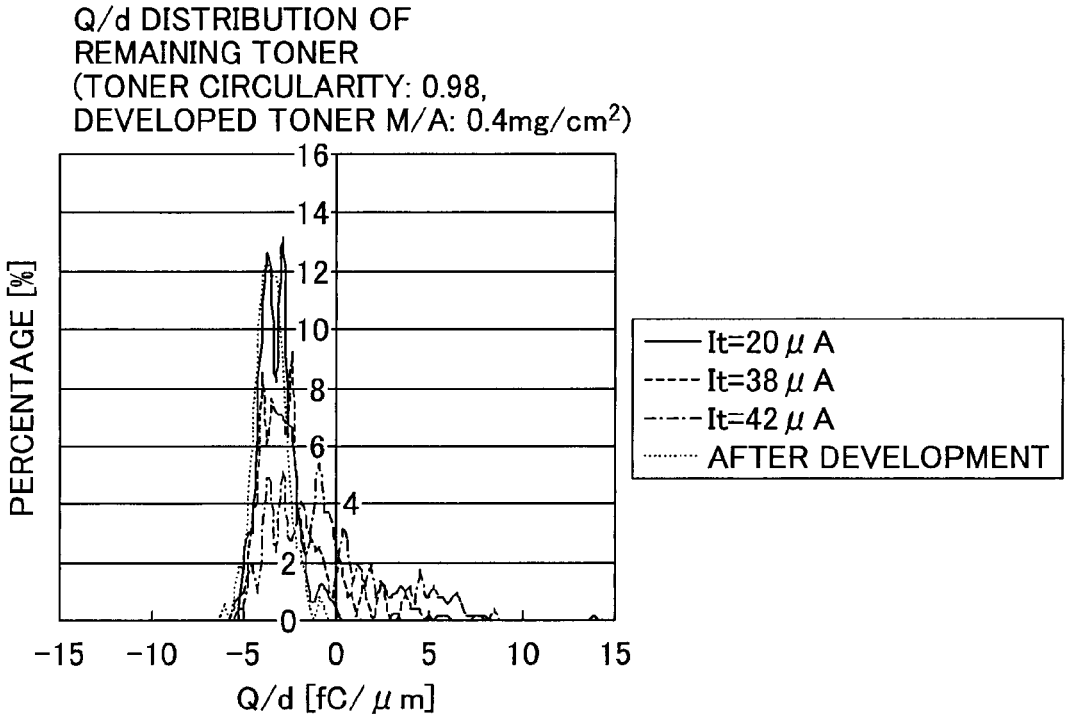
FIG. 9A shows graphs of charge potential distribution of toner particles remaining on a photoconductor after transferring toner image using different transfer current.
Figure 9B:
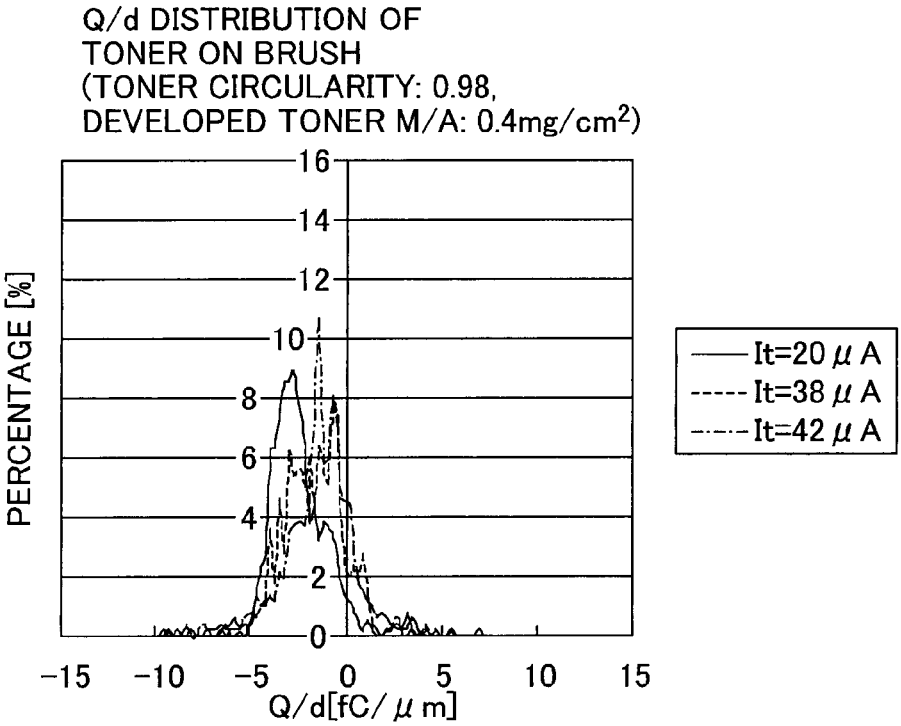
FIG. 9B shows graphs of charge potential distribution of toner particles adhered on a cleaning brush.

FIG. 9A shows a charge amount distribution of toner particles remaining on the photoconductor 1 before a cleaning operation by the cleaning brush 111, and FIG. 9B shows a charge amount distribution of toner particles adhered on the cleaning brush 111 after the cleaning operation by the cleaning brush 111.

Further, during a cleaning operation, a metal plate, which is not connected to a power source, is contacted to a brush edge of brush fibers of the cleaning brush 111, and a surface potential of the metal plate was measured with a surface potential meter to measure a brush edge potential of brush fibers. Based on such measurement, the brush edge potential of brush fiber of the cleaning brush 111 was +220V, which was lower than +300V applied to the recovery roller 117.

Although the brush edge potential of brush fibers of the cleaning brush 111 was +220V, it is observed that positively charged toner particles adhered on brush fibers as shown in a charge amount distribution of FIG. 9B. Based on such result, it could be said that brush fibers of the cleaning brush 111 may be charged to the first polarity (i.e., negative polarity) by frictioning with the photoconductor 1, by which toner particles having the second polarity (i.e., positive polarity) may be attracted to the brush fibers of the cleaning brush 111.

A description is now given to experiments for confirming that frictionally charged brush fibers, having a first polarity (i.e., negative polarity), of the cleaning brush 111 attract toner particles having a second polarity (i.e., positive polarity).

The cleaning brush 111 is prepared by fixing brush fibers made of conductive polyester fiber around a metal core, and the cleaning brush 111 is not connected to a power source. A photoconductor A and a photoconductor B, which will be described later, were placed in a dark space, and a conductive base material of the photoconductors A and B is earthed while maintaining surface potential of the photoconductors A and B at 0V.

A potential of the brush fiber of the cleaning brush 111 was measured with a surface potential meter while rotating the cleaning brush 111 and the photoconductor 1. With such friction, the brush fiber of the cleaning brush 111 was electrified to −30V.

Similarly, a potential of the brush fibers of the cleaning brush 111 made of conductive nylon fiber, including the above-noted conductive materials (e.g., carbon, ionic conductive agent), was measured with a surface potential meter while rotating the cleaning brush 111 and the photoconductor 1. With such friction, the brush fiber of the cleaning brush 111 was electrified to +70V.

A cleaning experiment was conducted using the cleaning brush 111 having the conductive polyester fiber and applying +200V to the metal core of the cleaning brush 111, and +300V to the recovery roller 117, and the conductive blade 11 is applied with negative polarity. The recovery roller 117 rotationally contacts the polyester brush fibers of the cleaning brush 111 to recover toner particles from the cleaning brush 111.

In this experiment, toner particles passed through the conductive blade 11 were set to have negative polarity for 90% of toner particles, and positive polarity for 10% of toner particles. Such toner particles were effectively cleaned by the cleaning brush 111. The recovery roller 117 used in this experiment was a high-resistance recovery roller having a roller made of SUS, a PVDF (polyvinylidene fluoride) tube having a thickness of 100 μm and overlaid on the surface of the roller, and an insulating layer having a thickness of 3 μm coated on the PVDF tube. Although the detail is described later, the high-resistance recovery roller may effectively stabilize a potential difference between the cleaning brush 111 and the recovery roller 117, by which toner particles can be reliably recovered from the cleaning brush 111 to the recovery roller 117.

Similarly, another cleaning experiment was conducted using the cleaning brush 111 having the conductive nylon fiber and applying +200V to the metal core of the cleaning brush 111 and +300V to the recovery roller 117, and the conductive blade 11 is applied with negative polarity.

In this experiment, toner particles passed through the conductive blade 11 were set to have negative polarity for 90% of toner particles, and positive polarity for 10% of toner particles. Different from the above-described experiment using polyester fibers, such toner particles were not effectively cleaned by the cleaning brush 111 having the conductive nylon brush fibers.

Further, another experiment was conducted using nylon brush fiber for the cleaning brush 111, in which a metal core of the cleaning brush 111 was applied with −200V, the recovery roller 117 was applied with −300V, and the conductive blade 11 is applied with positive polarity.

In this experiment, toner particles passed through the conductive blade 11 were set to have positive polarity for 90% of toner particles, and negative polarity for 10% of toner particles. Such toner particles were effectively cleaned by the cleaning brush 111 having the conductive nylon brush fibers.

Similarly, another cleaning experiment was conducted using polyester fiber for the cleaning brush, in which a metal core of the cleaning brush 111 was applied with −200V, the recovery roller 117 was applied with −300V, and the conductive blade 11 is applied with positive polarity.

In this experiment, toner particles passed through the conductive blade 11 were set to have positive polarity for 90% of toner particles, and negative polarity for 10% of toner particles. Different from the above-described case using nylon fibers, such toner particles were not effectively cleaned by the cleaning brush 111 having the conductive polyester brush fibers.

Based on such experiments, it is confirmed that a good level of cleaning performance may be obtained by using brush fibers, which can be frictionally electrified to a polarity the same as voltage polarity applied to the conductive blade 11 when brush fibers of the cleaning brush 111 friction with the photoconductor 1.

Figure 10A:
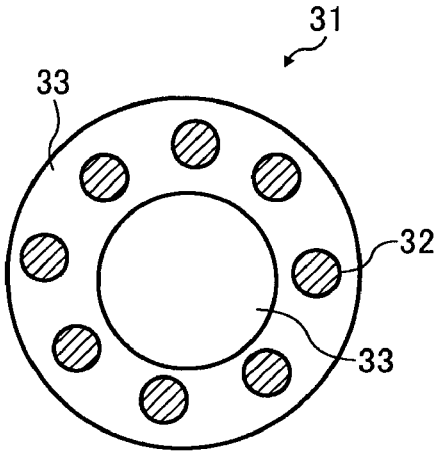
FIGS. 10A and 10B illustrate schematic cross-sectional views of brush fibers for a known cleaning brush.
Figure 10B:
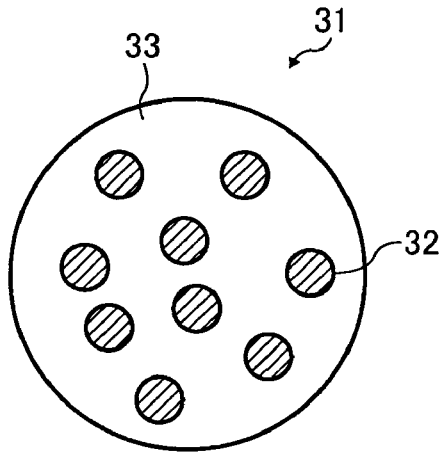

If the cleaning brush 111 has a brush fiber 31 having dispersed a conductive material 32 in a surface or sub-surface of the brush fiber 31 as illustrated in FIGS. 10A and 10B, the conductive material 32 and toner particles may contact each other with a higher probability, by which a current may flow to toner particles from the brush fiber 31 with a higher probability. Therefore, toner particles may be strongly charged to a polarity, which is applied to the cleaning brush 111, with a higher probability, in which "strongly charged" means that a charge amount distribution of toner particles is shifted in a position far from a zero value of charge amount.

Further, a charge amount distribution of remaining toner particles may affect on polarity control of toner particles by the conductive blade 11.

If remaining toner particles may be strongly charged to positive polarity (i.e., a charge amount distribution of remaining toner particles is sided greatly to positive polarity), toner particles passed through the conductive blade 11 may not be effectively charged to negative polarity, but remaining toner particles may include toner particles having negative polarity at a lower charge amount and toner particles having positive polarity although the conductive blade 11 applies negative polarity to the remaining toner particles by introducing electric charges to the remaining toner particles. When such remaining toner particles, not effectively controlled to negative polarity, are introduced with electric charge from the cleaning brush 111 at a first cleaning area E (see FIG. 2), such remaining toner particles may be strongly charged to a voltage polarity applied to the cleaning brush 111 with a higher probability.

Further, such electric charge introduction to toner particles may also occur at a second cleaning area F (see FIG. 2), at which the cleaning brush 111 and the recovery roller 117 contact each other. Specifically, toner particles having negative or positive polarity at a lower charge amount may be strongly charged to a polarity applied to the cleaning brush 111 (e.g., positive polarity) with electric charge introduction from the recovery roller 117 at the second cleaning area F. Such strongly charged toner particles having positive polarity may not be attracted to the recovery roller 117. Accordingly, such strongly charged toner particles may remain on the cleaning brush 111, and may re-adhere to the photoconductor 1 with a rotation of the cleaning brush 111, and resultantly remain on the photoconductor 1, which is not preferable.

Figure 11:
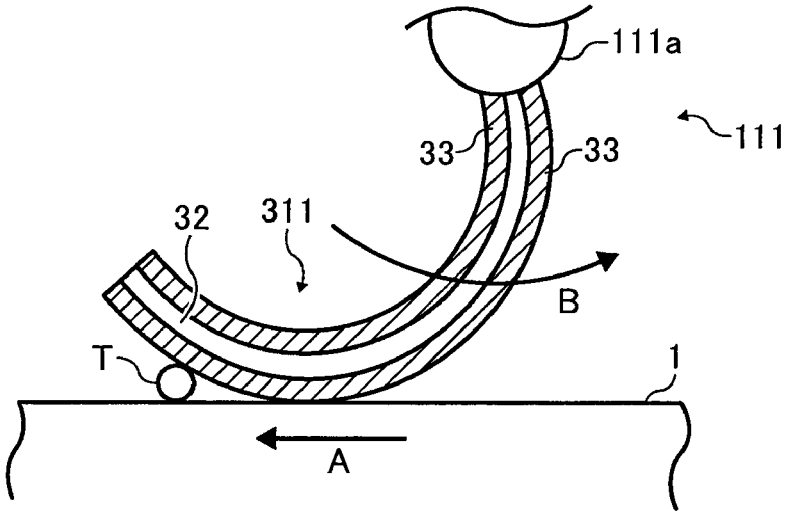
FIG. 11 illustrates a schematic cutaway view of a brush fiber of a cleaning brush according to an exemplary embodiment.
Figure 12A:
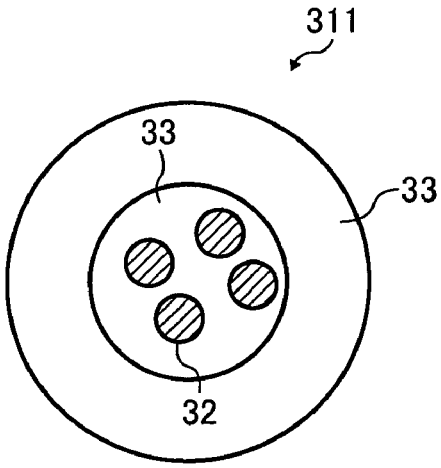
FIGS. 12A and 12B illustrate schematic cross-sectional views of brush fibers for a cleaning brush according to exemplary embodiments.
Figure 12B:
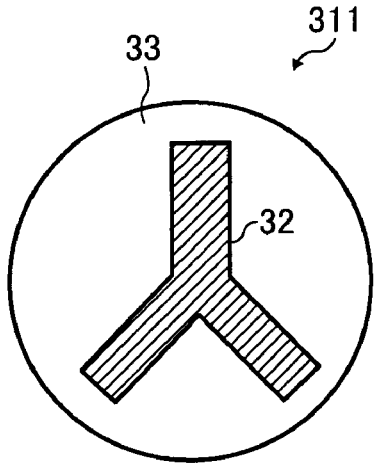

FIG. 11 illustrates a cross-sectional view of the brush fiber 311 of the cleaning brush 111 according to an exemplary embodiment, wherein the brush fiber 311 contacts the photoconductor 1. Further, FIGS. 12A and 12B illustrate cross-sectional views of the brush fiber 311 having internal configurations according to an exemplary embodiment.

As illustrated in FIGS. 11 and 12, the brush fiber 311 has a double layered structure or a core-in-sheath structure, in which an internal core includes the conductive material 32 and a surface layer is made of an insulating material 33. Because the surface layer of the brush fiber 311 is made of the insulating material 33, the conductive material 32 contacts toner particles only at a cutting edge of the brush fiber 311. With such configuration, an electric charge introduction to toner particles from the cleaning brush 111 can be suppressed.

The insulating material 33 of the brush fiber 311 may be nylon, polyester, acrylic, or the like, which may effectively suppress electric charge introduction to toner particles from the cleaning brush 111. Brush fibers having core-in-sheath structure can be prepared by known methods.

The surface of brush fiber is preferably coated with an insulating material while a conductive agent can be included in brush fiber with known methods such as dispersing or inserting a conductive agent in fiber.

If the surface of the brush fiber of the cleaning brush 111 has a given level of conductivity, the brush fiber may not be effectively electrified by friction with the photoconductor 1, by which the brush fiber of the cleaning brush 111 may not effectively attract toner particles, not effectively controlled to the aforementioned normal polarity by the conductive blade 11, from the photoconductor 1. The reason for such ineffective frictional electrification of brush fiber is not known yet. It may be that a conductive material may be hard to be frictionally electrified or electric charges may dissipate even if a conductive material is frictionally electrified.

Further, although two resistance value of log $\Omega$=6.5 or 8 were used for brush fiber, no difference was observed in experiment. Other conditions for experiment were as follows: brush fiber material having a resistance of $10^8$ $\Omega$·cm; brush fiber having a density of 100,000 fibers/inch$^2$; scraper contact angle of 20 degrees; scraper impression to the recovery roller is 1 mm; scraper material is polyurethane rubber; the recovery roller is made of metal recovery roller; voltage is applied to a roller shaft of the recovery roller in some experiments, and voltage is not applied to a metal core of a cleaning brush in some experiments.

As illustrated in FIG. 11, the brush fiber 311 of the cleaning brush 111 is a curled fiber, in which the brush fiber 311 is bended in a rearward direction, shown by an arrow B, with respect to a direction of rotation of the cleaning brush 111 shown by an arrow A.

Figure 13:
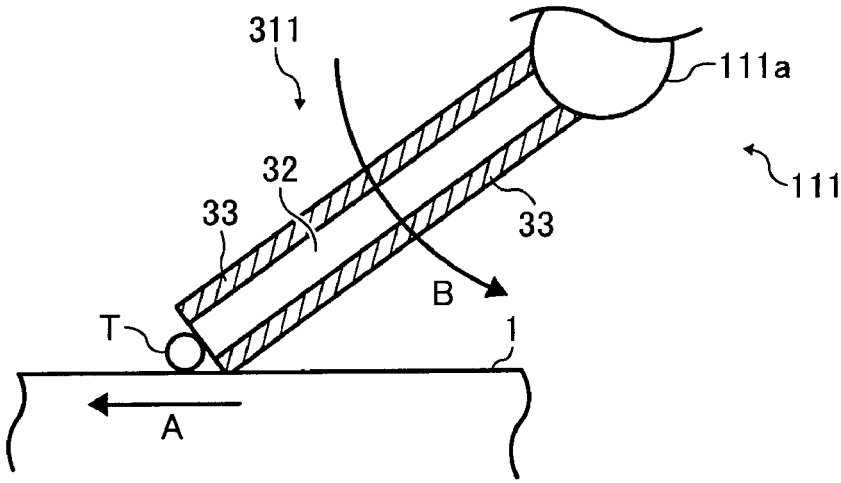
FIG. 13 illustrates a schematic cutaway view of a brush fiber using a straight fiber.

As illustrated in FIG. 13, the brush fiber 311 having a core-in-sheath structure includes the conductive material 32 as inner core and the insulating material 33 as surface layer, and such brush fiber 311 may be a straight fiber, in which the brush fibers 311 are fixed to a core 111*a* of the cleaning brush 111 in a radial pattern. Such brush fiber 311 moves in a direction shown by an arrow B in FIG. 13 when the cleaning brush 111 rotates in a direction shown by an arrow B. If the brush fiber 311 is a straight fiber, the conductive material 32 and a toner particle T may contact each other at a cutting edge of the brush fiber 311 as illustrated in FIG. 13, and thereby the cleaning brush 111 may introduce electric charges to the toner particle T.

On one hand, if the brush fiber 311 is a curled fiber as shown in FIG. 11, the conductive material 32 and a toner particle T may not contact each other at a cutting edge of the brush fiber 311, and thereby the cleaning brush 111 may not introduce electric charges to the toner particle T at the first cleaning area E and the second cleaning area F (see FIG. 2).

A description is now given to an area where an electric charge introduction may occur when the cleaning brush 111 has brush fibers of straight fiber with reference to FIG. 2. The above-mentioned electric charge introduction to toner particles may occur at the first cleaning area E and the second cleaning area F shown in FIG. 2.

In such configuration, the recovery roller 117 is applied with a given voltage, and then such voltage is supplied to the cleaning brush 111 from the recovery roller 117, and then toner particles are attracted to the cleaning brush 111 from the photoconductor 1.

An electric charge introduction at the first cleaning area E may instantaneously occur when remaining toner particles contact conductive materials in brush fibers of the cleaning brush 111, by which weaker-charged toner particles of remaining toner particles may be strongly charged to a polarity applied to the recovery roller 117 (e.g., positive polarity). Such strongly charged toner particles may electrostatically adhere on the surface of the photoconductor 1 with a stronger force, by which such strongly charged toner particles may not be captured by brush fibers of the cleaning brush 111, having electrified by friction, and may pass through the cleaning brush 111, and may become toner particles remaining on the photoconductor 1.

Although an electric charge introduction may occur to toner particles strongly charged (or having greater charge amount) to a polarity opposite to a voltage polarity applied to the cleaning brush 111, a polarity of such oppositely charged toner particles may not be inverted because of greater charge amount of such toner particles, by which such toner particles may be captured by the cleaning brush 111.

At the second cleaning area F, toner particles captured by the cleaning brush 111 from the photoconductor 1 may be attracted to the recovery roller 117, wherein such toner particles have a polarity opposite to a voltage polarity applied to the recovery roller 117. At this time, as similar to between the photoconductor 1 and the cleaning brush 111, toner particles on the cleaning brush 111 may be strongly charged to a polarity the same as voltage polarity applied to the recovery roller 117, by which such strongly charged toner particles may not be attracted to the recovery roller 117 but may remain on the cleaning brush 111. When such strongly charged toner particles come to a position facing the photoconductor 1 again with a rotation of the cleaning brush 111, such strongly charged toner particles may re-adhere to the photoconductor 1 with an effect of electric field formed between the surface of the photoconductor 1 and the cleaning brush 111, by which such toner particles may remain on the photoconductor 1.

On one hand, in an exemplary embodiment, the brush fiber 311 of the cleaning brush 111 having core-in-sheath structure is a curled fiber as illustrated in FIG. 11, by which the conductive material 32 in the brush fiber 31 may not contact toner particles.

Accordingly, an electric charge introduction to toner particles at an area between the photoconductor 1 and the cleaning brush 111 and an area between the cleaning brush 111 and the recovery roller 117 can be reduced. Therefore, toner particles weakly charged to negative or positive polarity and adhering the cleaning brush 111 may not be strongly charged to a voltage polarity applied to the cleaning brush 111.

Figure 14:
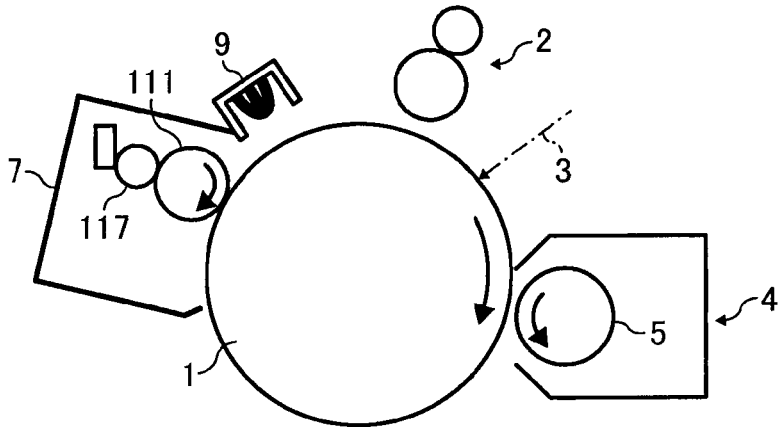
FIG. 14 illustrates a schematic configuration of an image forming apparatus omitting a transfer section and a cleaning blade from a configuration shown in FIG. 1.

Such electric charge introduction at the first cleaning area E and the second cleaning area F (see FIG. 2) was confirmed as below, which is described with reference to FIG. 14. In FIG. 14, the transfer unit 6 and the conductive blade 11 are removed from a configuration shown in FIG. 1, and toner particles to be removed by the cleaning brush 111 include toner particles having about 100% negative polarity after developing toner image.

When a front edge of a toner image moves from a contact area of the cleaning brush 111 and the photoconductor 1 for two times of the circumference length of the cleaning brush 111 (or two rotation of the cleaning brush 111), the photoconductor 1 is stopped. Then, Q/d distribution of toner particles on the photoconductor 1, corresponding to a second time rotation of the cleaning brush 111, was measured. Because the cleaning brush 111 rotates to clean the toner image on the photoconductor 1, a same portion of the cleaning brush 111 comes again to a same position facing the photoconductor 1 when the cleaning brush 111 rotates for one rotation. During such one rotation, the cleaning brush 111 also contacts the recovery roller 117 for one time, by which an electric charge introduction may occur between the cleaning brush 111 and the recovery roller 117. Accordingly, by measuring Q/d distribution of toner particles on the photoconductor 1 when the cleaning brush 111 rotates for two times, it can be determined whether an electric charge introduction has occurred.

When the cleaning brush 111 uses a straight fiber as brush fiber, it is referred as a first structure A, and when the cleaning brush 111 uses a curled fiber as brush fiber, it is referred as a second structure B. Further a third structure C, which applies a given voltage to a shaft 111*a* (see FIG. 2) of the cleaning brush 111, was also prepared.

Because an electric charge introduction may mainly occur between the cleaning brush 111 and the recovery roller 117, the recovery roller 117 is removed from the second structure B and the third structure C to estimate an effect of the recovery roller 117. Accordingly, the second structure B removes the recovery roller 117 and the scraper 118, and the third structure C also removes the recovery roller 117 and the scraper 118. In such first, second, and third structures A, B, and C, the photoconductor 1 is stopped when the cleaning brush 111 rotates for two times.

Figure 15:
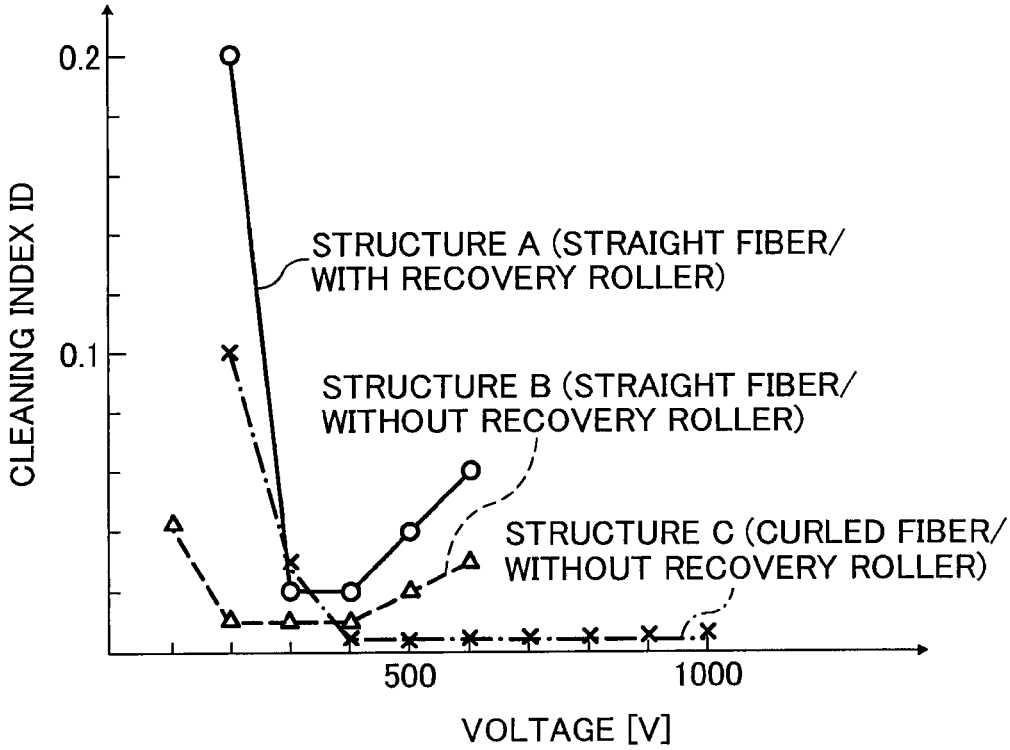
FIG. 15 shows graphs of cleaning performance level of a cleaning unit having different structures.

FIG. 15 shows graphs of cleaning performance level for the first, second, and third structures A, B, and C, in which the horizontal axis indicates a voltage applied to the recovery roller 117 or the cleaning brush 111, and the vertical axis indicates a cleaning index ID, which is determined as below.

First, toner particles remaining on the photoconductor 1 after a cleaning operation by the cleaning brush 111 is transferred to a transparent tape. Then, the transparent tape having toner particles is attached to a white sheet to measure a reflection density or image density (RD 1) with a spectroscopic chronometer X-Rite produced by X-Rite, Incorporated. Another transparent tape having no toner particles is also attached to a white sheet to measure a reflection density or image density (RD2). The cleaning index ID can be obtained by subtracting RD2 from RD1. Because the cleaning index ID and a number of toner particles has a correlation, the greater the number of toner particles, the greater the cleaning index ID. Accordingly, a cleaning performance level can be determined using the cleaning index ID. Therefore, the smaller the cleaning index ID, the better the cleaning performance level.

As shown in FIG. 15, the cleaning index ID of the second structure B is smaller than the cleaning index ID of the first structure A, and the cleaning index ID of the third structure C is generally smaller than the cleaning index ID of the second structure B.

When a higher voltage is applied to the recovery roller 117 or the cleaning brush 111, most of toner particles remaining on the photoconductor 1 after a cleaning operation may become strongly charged toner particles having a polarity the same as voltage polarity applied to the recovery roller 117 or the cleaning brush 111 because toner particles may be introduced with electric charges from the recovery roller 117 or the cleaning brush 111 due to a stronger cleaning electric field.

On one hand, when a lower voltage is applied to the recovery roller 117 or the cleaning brush 111, toner particles remaining on the photoconductor 1 may not be effectively removed because of a weaker cleaning electric field, by which the cleaning index ID becomes greater.

Accordingly, the cleaning index ID corresponding to a voltage of 500V or more applied to the recovery roller 117 or the cleaning brush 111 may be attributed to toner particles strongly charged to positive polarity, and the cleaning index ID corresponding to a voltage of 200V or less (100V or less for the first structure A) applied to the recovery roller 117 or the cleaning brush 111 may be attributed to toner particles having negative polarity.

Based on results shown in FIG. 15, it is assumed that an electric charge introduction has occurred at an area between the photoconductor 1 and the cleaning brush 111 or at an area between the cleaning brush 111 and the recovery roller 117. Further, based on results of the third structure C, it is assumed that an electric charge introduction may be suppressed if the cleaning brush 111 employs a curled fiber as brush fiber.

In an exemplary embodiment, the cleaning brush 111 and the recovery roller 117 may have following conditions, for example. The recovery roller 117 is made of a material of SUS, and has a diameter of 10 mm, for example. The cleaning brush 111, having brush fibers made of conductive polyester and having a width of 5 mm and a length of 5 mm, is impressed to the photoconductor 1 for 1 mm, and the brush fiber material has a resistance of $10^8$ Ω·cm and fiber density of 100,000 fibers/inch$^2$, for example.

Further, in an exemplary embodiment, the scraper 118 may have following conditions: scraper contact angle of 20 degrees; impression to the recovery roller 117 is 1 mm; and scraper is made of polyurethane rubber, for example.

A curling condition of the brush fiber 311 is determined based on a diameter of the photoconductor 1 and the recovery roller 117, in which such curling condition is determined so that the conductive material 32 in the brush fiber 311 does not contact the photoconductor 1 or the recovery roller 117.

The brush fiber 311 may be curled as below. First, the cleaning brush 111 is prepared by having straight fibers in a radial pattern about the axis of the cleaning brush 111. Then, a jig having an inner diameter same as the diameter of the cleaning brush 111 is heated and rotated along the cleaning brush 111 to curl the brush fiber 311 permanently. Accordingly, when a same diamatered cleaning brush 111 is prepared with curled fibers and straight fibers, a fiber length of the curled fiber extending from the shaft 111*a* to the brush edge may become longer than the straight fiber.

Further, the brush fiber 311 may not necessary curled, but slanted brush fiber (not shown) can be used. If such slanted brush fiber has a total length effectively longer than a distance between the surface of the shaft 111*a* and the surface of the photoconductor 1, a side face of the brush fiber 311 may contact the photoconductor 1, and thereby the brush edge of the brush fiber 311 may not contact the photoconductor 1. If such slanted brush fiber is attached to the cleaning brush 111, which may rotate in a counter direction at an area facing the photoconductor 1, a contact probability between the brush edge of the brush fiber 311 and toner particles may be suppressed, by which an electric charge introduction from the cleaning brush 111 to toner particles may be suppressed. Further, if such brush fibers are made of conductive polyester fiber, toner particles passed through the conductive blade 11 and having both positive and negative polarities may be preferably attracted to the brush fibers, for example.

A description is now given to the conductive blade 11 fixed on the blade holder 17 (see FIG. 2). The conductive blade 11 contacts the photoconductor 1 with a given contact angle such as 20 degrees and a given pressure such as 20 g/cm, has a given thickness such as 2 mm, a given length such as 7 mm, a given hardness such as JIS-A hardness of 60 to 80, and a given coefficient of elasticity of 30%, for example, but not limited such thereto. Generally, the conductive blade 11 may not remove toner particles 100% from the photoconductor 1, but the conductive blade 11 can effectively remove most of toner particles from the photoconductor 1. The conductive blade 11 may be used for removing pulverized toner particles and spherical toner particles. Further, a voltage polarity to be applied to the conductive blade 11, the cleaning brush 111, and the recovery roller 117 can be changed from the above-described voltage polarity pattern. For example, a voltage polarity to be applied to the conductive blade 11, the cleaning brush 111, and the recovery roller 117 can be reversed from the above-described voltage polarity pattern.

Generally, a removal rate of spherical toner particles from the photoconductor 1 by the conductive blade 11 is smaller than a removal rate of pulverization toner particles by the conductive blade 11, which may mean an amount of spherical toner particles not captured by the conductive blade 11 may become relatively greater. However, spherical toner particles can also be preferably removed from the photoconductor 1 as similar to pulverization toner particles as below.

Specifically, the conductive blade 11 can set a polarity of toner particles on the photoconductor 1 to one preferable polarity (i.e., negative or positive) when toner particles pass through the conductive blade 11, by which an electric charge introduction to toner particles from the cleaning brush 111 may be suppressed, and thereby toner particles can be preferably removed from the photoconductor 1.

A description is given to toner particles, electrostatically adhered on the conductive blade 11. At the conductive blade 11, toner particles may gradually obtain a polarity applied to the conductive blade 11 with an effect of electric charge introduction or electric discharge, and then depart from the conductive blade 11 to the photoconductor 1. Although some toner particles may depart from the conductive blade 11 as such, most of toner particles may be captured and remained on the conductive blade 11, by which a contact portion of the conductive blade 11 contacting the photoconductor 1 becomes dirty over time.

If such contact portion of the conductive blade 11 becomes dirty, an electric charge introduction or electric discharge at the conductive blade 11 may be degraded, by which more and more toner particles passed through the conductive blade 11 may not be controlled to a polarity applied to the conductive blade 11. In such a condition, more and more toner particles having a polarity opposite to voltage polarity applied to the conductive blade 11 may come to a position of the cleaning brush 111, by which the cleaning brush 111 cannot effectively remove such toner particles having such opposite polarity although the brush fiber of the cleaning brush 111 may be frictionally electrified. Accordingly, the contact portion of the conductive blade 11 of the photoconductor 1 may need to be cleaned on a routine basis.

The contact portion of the conductive blade 11 may be cleaned when an image forming operation is not performed in an image forming apparatus, in which a voltage opposite when conducting image forming operation is applied to the conductive blade 11, and the photoconductor 1 is rotated in a direction, opposite when performing an image forming operation.

When the photoconductor 1 is rotated in the opposite direction, a face of the conductive blade 11 at an upstream side of a normal rotation direction of the photoconductor 1 may contact the photoconductor 1, by which adhered toner particles may be transferred to the photoconductor 1 easily, wherein such face of the conductive blade 11 is used for electric discharging to invert a polarity of toner particles.

Further, because most of toner particles electrostatically adhered on the conductive blade 11 have a polarity opposite to the voltage polarity applied to the conductive blade 11 when a normal toner recovery operation for toner particles are conducted, such adhered toner particles may be easily transferred to the photoconductor 1 from the conductive blade 11 when an opposite voltage is applied to the conductive blade 11 for cleaning the conductive blade 11.

With such configuration, toner particles electrostatically adhered on the conductive blade 11 and charged to a polarity opposite to a voltage polarity applied to the conductive blade 11 when conducting an image forming operation can be transferred to the photoconductor 1 from the conductive blade 11, and can be transported to an upstream side of a normal rotation direction of the photoconductor 1 with respect to the conductive blade 11.

Then, such toner particles transferred to the photoconductor 1 may be mechanically removed or introduced with electric charge by the conductive blade 11 when a next image forming operation is performed by rotating photoconductor 1 in a normal rotation direction.

The contact portion of the conductive blade 11 may be cleaned at any timing when an image forming operation is not performed. For example, the conductive blade 11 may be cleaned when a given number of image forming operations is performed, when one image forming operation is completed, or when a power source is applied to an image forming apparatus, or the like.

Further, the photoconductor 1 may be rotated in the opposite direction at least for a distance between the conductive blade 11 and the cleaning brush 111, which contact the photoconductor 1. If the photoconductor 1 is stopped for a longer period time, toner particles on the photoconductor 1 existing between the conductive blade 11 and the cleaning brush 111 may lose electric charges gradually, and may become non-charged condition in an extreme case. Such non-charged toner particles may not be removed by the cleaning brush 111.

In such a case, non-charged toner particles may be transported to a upstream side with respect to the contact portion between the conductive blade 11 and the photoconductor 1 by further rotating the photoconductor 1 in the direction opposite to a normal rotation direction, and then the photoconductor 1 is rotated in the normal rotation direction so that the conductive blade 11 can charge the non-charged toner particles again, and then charged toner particles may be removed from the photoconductor 1 by the cleaning brush 111.

A description is now given to a toner recovery operation by the recovery roller 117 and the scraper 118. If the scraper 118, made of an insulating material, is used for removing toner particles on the recovery roller 117 mechanically, spherical toner particles may be hardly removed by the scraper 118. In such a case, a following configuration can be devised, for example.

Generally, the recovery roller 117 can be made of any conductive materials if the recovery roller 117 can form a given potential difference with the cleaning brush 111 sufficient for attracting toner particles from the cleaning brush 111 to the recovery roller 117 with an effect such potential difference. Therefore, compared to the photoconductor 1, the recovery roller 117 can be made of variety of conductive materials.

For example, the recovery roller 117 may have a surface layer having lower friction coefficient, or the recovery roller 117 may have a metal core coated with a conductive tube having lower friction coefficient to enhance its anti-abrasiveness, and thereby the scraper 118 can be contacted to the recovery roller 117 with setting a greater pressure. With such configuration, the scraper 118 can easily remove spherical toner particles from the recovery roller 117. The recovery roller 117 can enhance its anti-abrasiveness by employing fluorine coating, PVDF tube, PFA (perfluoroalkoxy) tube, or the like.

Figure 16:
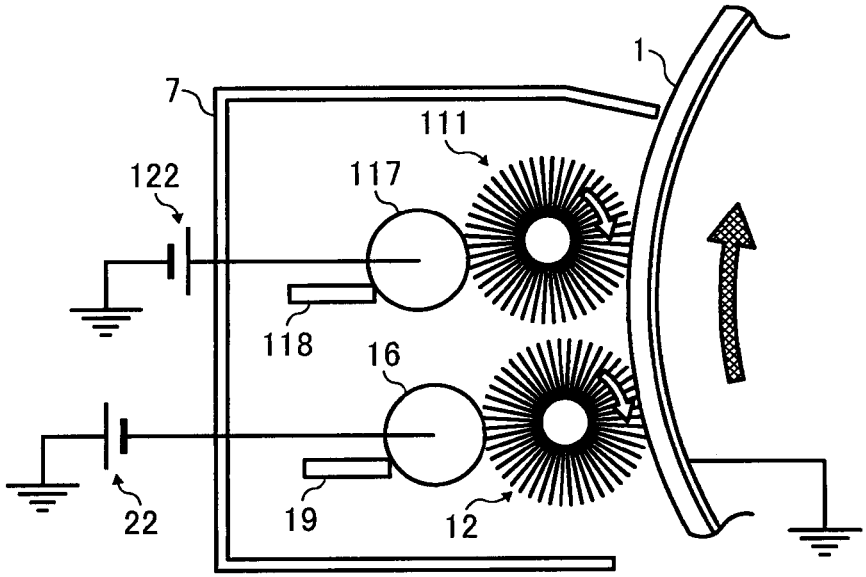
FIG. 16 illustrates an expanded view of another cleaning unit according to an exemplary embodiment, in which a conductive brush roller is used instead of a cleaning blade shown in FIG. 2.

Further, as illustrated in FIG. 16, instead of the conductive blade 11, a conductive brush 12 can be used to control polarity of toner particles remaining on the photoconductor 1, in which the conductive brush 12 may introduce electric charges to the remaining toner particles. The conductive brush 12 may have a given electric resistance such as $10^5$ Ω·cm to $10^9$ Ω·cm, a given fiber density such as 100,000 fibers/inch$^2$, a given brush length such as 5 mm, and be impressed to the photoconductor 1 for a given length such as 1 mm, for example.

In FIG. 16, the conductive brush 12 is contacted with a recovery roller 16 made of a conductive material, in which the conductive brush 12 is supplied with a voltage from the recovery roller 16, and the conductive brush 12 controls polarity of toner particles on the photoconductor 1.

Further, by using potential difference between a core of the conductive brush 12 and the recovery roller 16, toner particles adhered on the brush fibers of the conductive brush 12 can be recovered by the recovery roller 16, by which brush fibers of the conductive brush 12 can be cleaned, by which the conductive brush 12 can reliably control polarity of toner particles over time.

Figure 17:
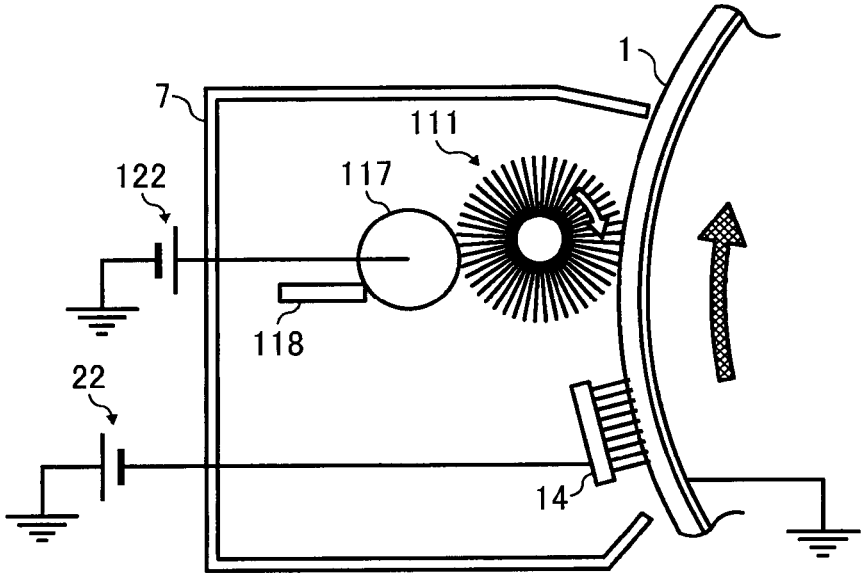
FIG. 17 illustrates an expanded view of another cleaning unit according to an exemplary embodiment, in which a conductive brush is used instead of a cleaning blade shown in FIG. 2.

Further, instead of the conductive blade 11 and the conductive brush 12, a swath brush 14 shown in FIG. 17 can be used if toner particles can be recovered by free fall from brush fibers or by a vibration of flicker bar or the like, in which toner particles can be recovered from the swath brush 14 without using electrostatic method. Such method can simplify a configuration of the cleaning unit 7.

Figure 18:
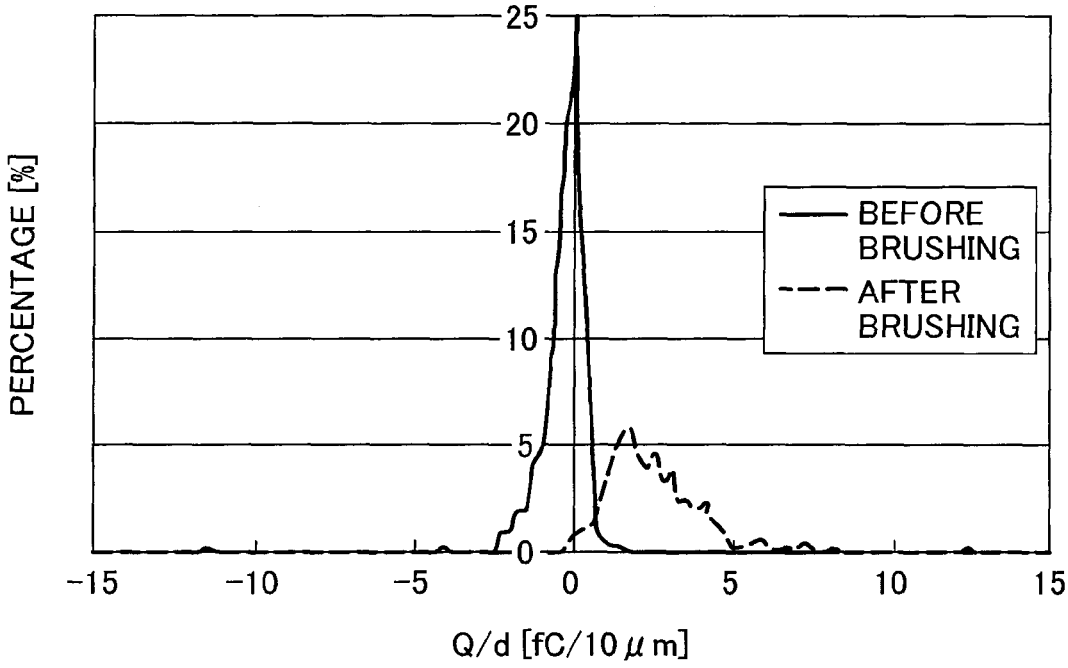
FIG. 18 shows graphs of charge potential distribution of toner particles using a configuration of FIG. 17, in which one graph corresponds to toner particles before recovered by the conductive brush of FIG. 17 and another graph corresponds to toner particles after recovered by the conductive brush of FIG. 17, wherein toner particles having positive and negative polarity are set by irradiating corona charging to toner particles by applying a given voltage and the conductive brush is applied with a given positive voltage.

In a configuration shown in FIG. 17, a higher voltage was experimentally applied to a wire to irradiate a corona charging to toner particles on the photoconductor 1 to prepare toner particles having positive and negative polarity, and the swath brush 14 was experimentally applied with a voltage of +300 V. FIG. 18 shows graphs of charge amount distribution of toner particles on the photoconductor 1 when a polarity control was conducted for toner particles under such condition.

In FIG. 18, a graph of "before brushing" is a graph for "toner particles having positive and negative polarity are mixed by about 50%:50%", and a graph of "after brushing" is a graph for "polarity controlled toner particles with the swath brush 14." The charge amount distribution shown in FIG. 18 was measured with E-SPART Analyzer, which is a product of Hosokawa Micron Corporation. The swath brush 14 may have a brush fiber made of any conductive material such as nylon, polyester, acrylic, carbon, ionic conductive agent, or the like.

A description is now given to a process when toner particles change its polarity when toner particles pass through the conductive brush 12 with reference to FIG. 16. When the toner particles pass through the conductive brush 12, toner particles may change its polarity to a polarity applied to the conductive brush 12 because before passing through the conductive brush 12, toner particles may be in one polarity, opposite to a voltage polarity applied to the conductive brush 12.

If a voltage value applied to the conductive brush 12 is sufficiently smaller than a charging voltage value used for charging the surface of the photoconductor 1, toner particles remaining on the photoconductor 1 may be charged to a polarity the same as voltage polarity applied to the conductive brush 12 as follows: When toner particles remaining on the photoconductor 1 may pass through a tiny space between the conductive brush 12 and the photoconductor 1, toner particles may be sandwiched by the conductive brush 12 and the photoconductor 1. Such sandwiched toner particles may be charged to a polarity applied to the conductive brush 12 as similar to a capacitor charging process. Such toner charging process by the conductive brush 12 may be termed as "electric charge introduction to toner particles." With such electric charge introduction, toner particles passed through the conductive brush 12 may be charged to a polarity the same as voltage polarity applied to the conductive brush 12.

On one hand, if a voltage value applied to the conductive brush 12 is substantially similar to or greater than a charging voltage value used for charging the photoconductor 1, toner particles remaining on the photoconductor 1 may be charged to a polarity the same as voltage polarity applied to the conductive brush 12 as follows: The photoconductor 1 and the conductive brush 12 may form a tiny gap having a wedge-like entry and exit portion therebetween. When electric discharging occurs at such tiny gap, toner particles remaining on the photoconductor 1 may be charged to a polarity the same as voltage polarity applied to the conductive brush 12.

A brush fiber of the conductive brush 12 may preferably have a configuration shown in FIGS. 10A and 10B, in which conductive materials are dispersed in a surface or sub-surface layer of brush fiber. Because the conductive materials may be dispersed in the surface or sub-surface layer in such configuration, the conductive materials in the brush fiber may contact toner particles with a higher probability, by which a current flow to toner particles may more likely to occur. As a result, toner particles may be charged to a voltage polarity applied to the cleaning brush 12 with a higher probability, by which polarity of toner particles on the photoconductor 1 may be easily set to one polarity.

Figure 19:
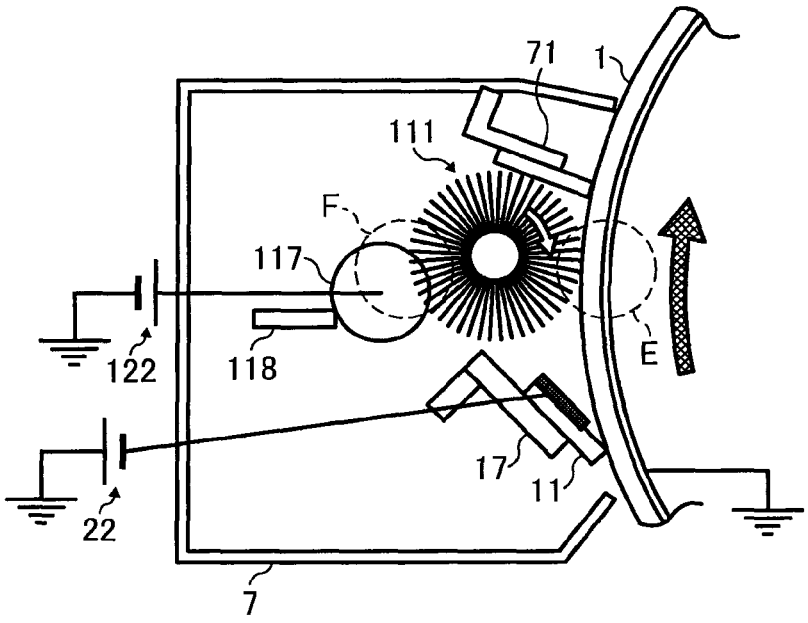
FIG. 19 illustrates an expanded view of another cleaning unit according to an exemplary embodiment, in which a polishing blade polishes a photoconductor after a cleaning operation.

Further, as illustrated in FIG. 19, the cleaning unit 7 may further include a polishing blade 71 at a downstream side position of the cleaning brush 111 with respect to a surface movement or rotation direction of the photoconductor 1, in which the polishing blade 71, contactable to the photoconductor 1, polishes the surface of the photoconductor 1. FIG. 19 shows a state that the polishing blade 71 is contacted to the surface of the photoconductor 1.

Generally, it is hard to remove filming materials adhered on the photoconductor 1 by using the conductive blade 11 or the cleaning brush 111. The filming materials may adhere on the photoconductor 1 as follows: In one case, a base material of toner particles may adhere on the photoconductor 1 as filming materials when toner particles contact parts disposed in the developing unit 4, the transfer unit 6, and the cleaning unit 7, which are provided around the photoconductor 1. In another case, additive agent provided in toner particles for adding fluidity or charging functionality may be separated from the toner particles and adhered on the photoconductor 1 as filming materials. In another case, products formed by an electric discharging of the charge unit 2 may adhere on the photoconductor 1 as filming materials. In another case, paper talc may adhere on the photoconductor 1 as filming materials.

If an amount of such filming materials adhering on the photoconductor 1 may be small, image quality to be produced may not degrade. However, if such filming materials may adhere on the photoconductor 1 for a long period of time, such filming materials may cause some drawbacks such as non-uniform charging on the photoconductor 1, image formation failed area on the photoconductor 1, or the like. Therefore, such filming material may need to be removed.

The polishing blade 71 shown in FIG. 19 may have an abrasive particles layer, which includes abrasive particles in an elastic material. The polishing blade 71 may be positioned in an image forming apparatus so that the abrasive particles layer can contact the surface of the photoconductor 1, in which a contact face of the polishing blade 71 may need to include sufficient amount of abrasive particles. Specifically, the polishing blade 71 may preferably have abrasive particles with a volume ratio of 50% to 90% at the contact face. If the volume ratio of abrasive particles at the contact face may become too small (e.g., less than 50%), amount of abrasive particles contacting the surface of the photoconductor 1 may become small, by which filming material on the photoconductor 1 may not be effectively removed. If the volume ratio of abrasive particles at the contact face may become too great (e.g., more than 90%), abrasive particles on the contact face may more likely drop, which is not preferable.

The polishing blade 71 may have a single layer structure including abrasive particles, or a double layer structure including an abrasive particles layer and a base layer. The polishing blade 71 shown in FIG. 19 has a single layer structure, for example. In case of a single layer structure, an elastic material mixed with abrasive particles are formed into a sheet member by a centrifugal molding, and such sheet member is cut in pieces to fabricate the polishing blade 71, wherein such fabrication process is a simpler process, which may be preferable from a viewpoint of fabrication cost.

Figure 20:
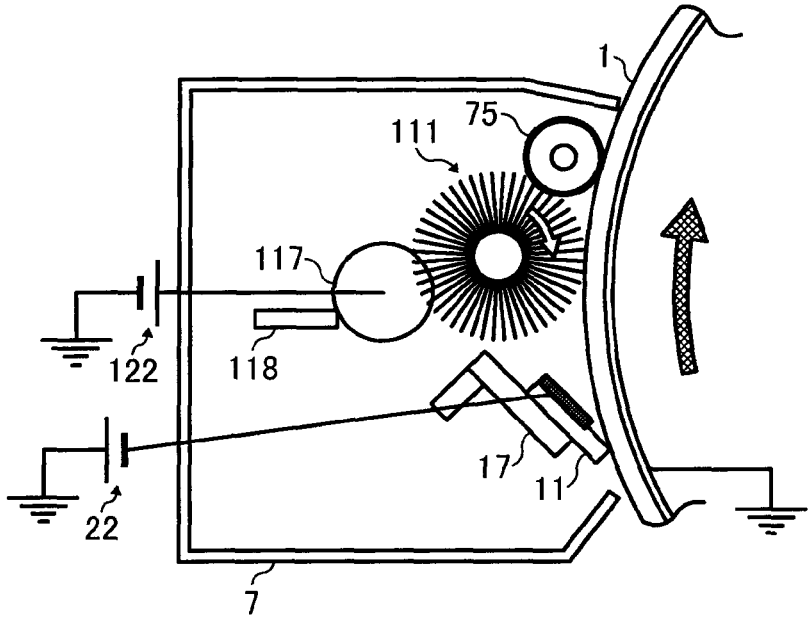
FIG. 20 illustrates an expanded view of another cleaning unit according to an exemplary embodiment, in which a polishing roller polishes photoconductor after a cleaning operation.

In case of a double layer structure, the polishing blade 71 may include a thin sheet member and a base layer. The thin sheet member is formed by reducing an amount of an elastic material and abrasive particles compared to the single layer structure, and is cut in a thin blade having abrasive particles, and such thin blade is adhered on the base layer made of material such as rubber, resin, and metal to fabricate the polishing blade 71. Alternatively, the polishing blade 71 having double layer structure may also be formed by integrating a base layer (e.g., resin, metal) and a thin blade by a centrifugal molding, and cutting the integrated member into the polishing blade 71. Further, as illustrated in FIG. 20, such polishing device may be a polishing roller 75. The polishing roller 75 may be composed of a core and a surface layer having abrasive particles, for example.

Figure 21:
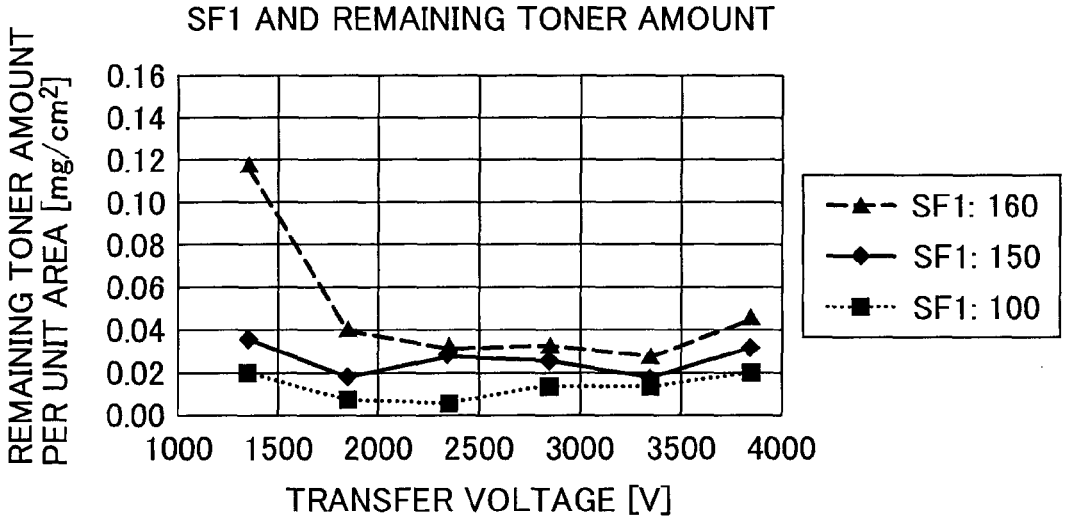
FIG. 21 shows graphs indicating a relationship of SF1 factor of toner particles and an amount of remaining toner on a photoconductor after a cleaning operation.

A description is now given to toner particles preferably used in an exemplary embodiment with reference to FIG. 21.

Experiments were conducted to compare toner amount remaining on the surface of the photoconductor 1 by producing test images using toner particles having different shape factors. Specifically, toner particles of each color having three types of shape factors SF1 of 100, 150, and 160 were prepared to produce test images. In such experiments, a developing bias voltage is adjusted so that toner amount per unit area in a test image formed on the surface of the photoconductor 1 for each type of toner particles becomes substantially similar.

Right after developing test images, toner particles adhering on the surface of the photoconductor 1 were sampled by using a suction jig, and a weight of sampled toner particles was measured to obtain a first toner amount Ml developed on the photoconductor 1.

Further, toner particles of a test image, primary transferred and adhering on an intermediate transfer belt, were sampled by using a suction jig, and a weight of sampled toner particles was measured to obtain a second toner amount M2, transferred to the intermediate transfer belt. By reducing the second toner amount M2 from the first toner amount M1, toner amount remaining on the photoconductor 1 was obtained. FIG. 21 shows graphs of toner amount remaining on the photoconductor 1.

As indicated in graphs of FIG. 21, toner amount remaining on the photoconductor 1 becomes smaller as the shape factor SF1 becomes smaller, in which an amount of toner particles adhering per unit area on the photoconductor 1 was measured as remaining toner amount. As shown in FIG. 21, when toner particles having the shape factor SF1 of 100 is used, remaining toner amount becomes lower, and remaining toner amount increases as the shape factor SF1 increases. Therefore, the smaller the shape factor SF1 of toner particles, the smaller the remaining toner amount.

Generally, the smaller the remaining toner amount, the lesser the burden on the cleaning unit 7, and the longer the lifetime of the cleaning unit 7. Accordingly, the lifetime of the cleaning unit 7 can be set longer when toner particles having smaller shape factor SF1 are used. Therefore, toner particles having the shape factor SF1 of 100 to 150 may be used in example embodiments.

Such toner particles were prepared as follows. A binding resin having modified polyester resin, which can have urea bonding, is solved in an organic solvent, and agents such as colorant were solved or dispersed in the organic solvent. Then a poly-addition reaction and particle-making reaction were conducted in a water-based medium, and after removing solvent of such dispersed solution, residual products were cleaned and dried as toner particles and used in experiments. Instead of such method, other polymerization methods such as emulsion polymerization method, suspension polymerization method, or dispersion polymerization method can be used to manufacture spherical toners having a greater average circularity. Further such spherical toners having a greater average circularity may be manufactured by conducting a heat treatment to toner particles prepared by a pulverization method.

The shape factor SF1, which indicates sphericity value of spherical material, are defined by the following equations: $SF1=\{(MXLNG)^2/AREA\}\times(100\ \pi/4)$, wherein AREA is a projected area of spherical material such as toner particle and MXLNG is a maximum length of an oval figure, which is the projection of a spherical material in a two-dimensional plane. By randomly sampling hundred or more toner particles from toner particles, an average value of SF1 of sampled hundred or more toner particles was set as shape factor SF1 of toner particles to be used.

Further, remaining toner amount can be measured by another measurement method. First, a patch pattern of toner particles having an area A $cm^2$ is formed, developed on the photoconductor 1, and transferred to a transfer member, at which a main switch of an image forming apparatus is turned to OFF. Next, toner particles remaining on the photoconductor 1 after transferring toner image is suctioned by using a suction jig having a filter and air pump for trapping toner particles and measuring weight M mg of suctioned toner particles. Remaining toner amount ($mg/cm^2$) is obtained by dividing the weight M mg of suctioned toner particles with the area A $cm^2$ of patch pattern.

A description is now given to the photoconductor 1 used in the image forming apparatus 10 according to an exemplary embodiment.

In an exemplary embodiment, the photoconductor 1 may include a conductive base material and a photosensitive layer directly formed on the conductive base material or via an intermediate layer. The photosensitive layer may at least include an electric charge generating material, an electric charge transport material, and a particulate substance used as filler.

An amount of the particulate substance in the photosensitive layer may be set greater at an external surface side of the photosensitive layer, which is far from the conductive base material side of the photosensitive layer, so that an electric characteristic of the photoconductor 1 can be stabilized, and an abrasion resistance of the photoconductor 1 can be enhanced, by which the photoconductor 1 having higher sensitivity and higher durability can be obtained.

Further, the photoconductor 1 may have a configuration having a conductive support member, a photosensitive layer, and a surface layer including particulate substance. Further, although the photosensitive layer may need a charge-able electric insulating material, a dielectric layer having non-photoconductivity or a photosensitive layer having a given photoconductivity can be used as photosensitive layer.

The particulate substance mixed, dispersed and pulverized with binder resin, electric charge transport material having lower molecular weight, and electric charge transport material having polymer molecule, may be coated on a surface layer. The surface layer may include particulate substance with 5 to 50 weight %, and more preferably 10 to 40 weight %. If particulate substance weight ratio becomes too small (e.g., 10 weight % or less), the abrasion resistance of the photosensitive layer may not be enough level. If particulate substance weight ratio becomes too great (e.g., 50 weight % or more), transparency of the photosensitive layer may be degraded. The particulate substance may have an average particle diameter of 0.05 μm to 1.0 μm, and more preferably 0.05 μm to 0.08 μm, which is prepared by pulverization and dispersion.

The particulate substance may be made of material, which may be harder than a resin configuring a surface layer, wherein such material may be inorganic material or organic material.

For example, metal oxides such as titanium oxide, silicon dioxide, tin oxide, alumina, zirconia, indium oxide, silicon nitride, calcium oxide, zinc oxide, and barium sulfate may be used as particulate substance. Preferably, titanium oxide, silicon dioxide, zirconia, or the like may be used as particulate substance. Such particulate substance may receive a surface treatment using inorganic material or organic material to enhance disperse-ability. Generally, silane coupling agent treatment, fluorine silane coupling agent treatment, higher fatty acid treatment may be used as water-repellent treatment. In case of inorganic material treatment, a filler surface may be treated with alumina, zirconia, tin oxide, silicon dioxide, or the like.

As for high-polymer materials configuring a surface layer, reactionable monomers having a plurality of cross-linkable functional groups in one molecule may be used, for example. By using light energy or thermal energy, cross-linking reactions are started to form a three-dimensional net-like structure. Such net-like structure may preferably enhance an abrasion resistance. From viewpoints of enhancing electrical stability, durability, and lifetime of the photoconductor 1, the reactionable monomer may partially or all include monomer having electric charge transport function. If such monomer may be used, a net-like structure may have an enhanced abrasion resistance while also having an electric charge transport function.

Reactionable monomers having electric charge transport function may be following compounds, but not limited thereto: a compound including at least one electric charge transport material and one silicon atom having hydrolyzable substitutional group in one same molecule; a compound including an electric charge transport material and a hydroxyl group in one same molecule; a compound including an electric charge transport material and a carboxyl group in one same molecule; a compound including an electric charge transport material and an epoxy group in one same molecule; and a compound including an electric charge transport material and an isocyanate group in one same molecule. Electric charge transport materials having such reactionable groups may be used alone, or two or more such electric charge transport materials may be mixed and used.

Further, reactionable monomers having electric charge transport function may preferably have a triarylamine structure to enhance electric/chemical stability, and transport speed of carrier. In view of viscosity adjustment at the time of coating, stress relief of cross-linked charge transport layer, lowering of surface energy, and reducing friction coefficient, polymerization monomer or oligomer having one or two functional groups may also be used with reactionable monomers. Such polymerization monomer or oligomer may be known monomer or oligomer.

As for cross-linked high-polymer materials, polymerization or cross-linking of positive hole transport compounds is conducted by using heat energy or light energy.

When a polymerization reaction is conducted with heat energy, a polymerization reaction may be progressed only by thermal energy or a polymerization reaction may be progressed with thermal energy and a polymerization initiator. Such polymerization initiator may be preferably added to efficiently progress a polymerization reaction at a lower temperature.

When a polymerization reaction is conducted with light energy, ultraviolet ray may be preferably used. However, a polymerization reaction may barely be progressed only by light energy. Accordingly, a photo-polymerization initiator may also be used with light energy for a polymerization reaction. Such photo-polymerization initiator may mainly absorb ultraviolet ray having a wavelength of 400 nm or less to generate active species such as radicals or ions to start a polymerization reaction. Further, such photo-polymerization initiator may also be used with heat energy.

Although a surface layer having such net-like structure and a charge transport layer may have an enhanced abrasion resistance, such surface layer may shrink its volume during a cross-linking reaction. Accordingly, if a surface layer becomes too thick, cracks may occur on the surface layer. In view of such phenomenon, a surface layer may be composed of a bottom layer and an upper layer, in which the bottom layer, which is near side of the photosensitive layer, may be formed of dispersed polymer of lower molecular weight, and the upper layer, which is an external surface side of the surface layer, may be formed of polymers having cross-linked structure, for example.

A description is given to photoconductors A and B, which were manufactured as follows.

The photoconductor A was manufactured as follows: First, methyltrimethoxysilane of 182 part, dihydroxymethyltriphenylamine of 40 part, 2-propanol of 225 part, 2% acetic acid of 106 part, and aluminum trisacetylacetonato 1 part were mixed to prepare a coating solution for coating a surface layer. Such coating solution was coated and dried on a charge transport layer, and hardened by applying 110 degrees Centigrade for one hour, by which a surface layer having a film thickness of 3 μm was formed.

The photoconductor B was manufactured as follows: First, positive hole transport compound (see chemical formula 1) of 30 part, acrylic monomer (see chemical formula 2) and photo polymerization initiator (1-hydroxy-cyclohexyl-phenyl-ketone) of 0.6 part were solved in a mixed solvent having monochlorobenzene/dichloromethane as 50/50 part to prepare a coating solution for coating a surface layer. Such coating solution was coated on a charge transport layer by using a spray coating method, and hardened by irradiating light having a light intensity of 500 mW/cm$^2$ for 30 seconds using a metal halide lamp, by which a surface layer having a film thickness of 5 μm was formed.

(chemical formula 1)

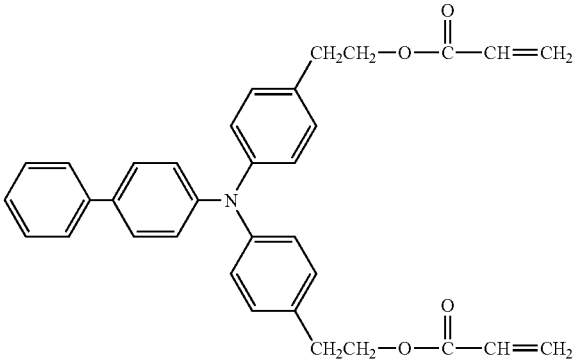

(chemical formula 2)

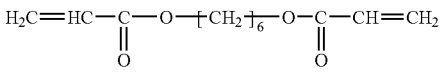

In an exemplary embodiment, a small amount of toner particles, which cannot be set to a voltage polarity applied to the conductive blade 11 can be removed from the photoconductor 1 by the cleaning brush 111.

However, toner particles having a polarity, opposite to a voltage polarity applied to the conductive blade 11 may not be recovered by the recovery roller 117, and toner particles may stick in brush fibers of the cleaning brush 111, by which frictional electrification between the brush fibers and toner particles or the photoconductor 1 may not occur effectively.

In view of such phenomenon, a recovery unit, which can recovery toner particles, charged to a polarity opposite to a voltage polarity applied to the conductive blade 11 and adhering brush fibers of the cleaning brush 111, may be in need.

Figure 22:
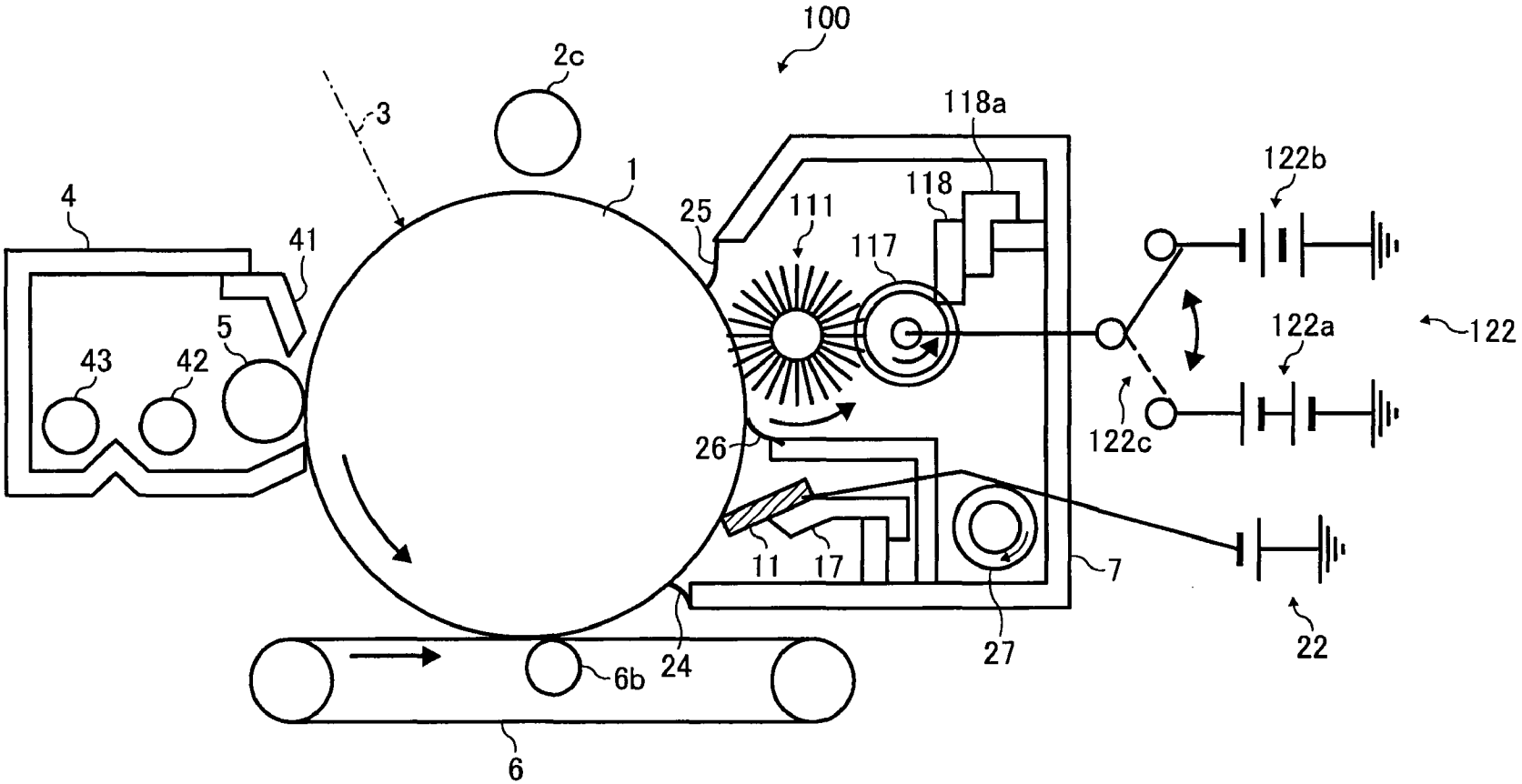
FIG. 22 illustrates a schematic configuration of an image forming apparatus having a cleaning unit according to another exemplary embodiment.

A description is now given to such recovery unit with reference to FIG. 22. FIG. 22 illustrates a schematic configuration of an image forming apparatus 100 using electrophotography having a recovery unit according to another exemplary embodiment. The image forming apparatus 100 may employ a non-contact charge roller so that toner particles may be attracted to an area having lower potential in an image forming process, which may be known as negative/positive method.

When a start button of an operation unit (not shown) is pressed, given voltages or currents are sequentially applied to each of a non-contact charge roller 2*c*, the developing roller 5, the transfer unit 6, the conductive blade 11, the cleaning brush 111, the recovery roller 117, and a decharging unit (not shown) at given timings. The non-contact charge roller 2*c* does not contact the photoconductor 1.

When such power application is conducted, the photoconductor 1, the non-contact charge roller 2*c*, the transfer unit 6, the developing roller 5, a left screw 43, a right screw 42, the cleaning brush 111, the recovery roller 117, a toner ejection screw 27 start to rotate in given directions. For example, the photoconductor 1 rotates with a speed of 200 mm/sec, the cleaning brush 111 and the recovery roller 117 rotate with a speed of 200 mm/sec.

The photoconductor 1 is uniformly charged to a negative polarity (e.g., −700V) by the non-contact charge roller 2*c*, and then a laser beam 3 is irradiated on the photoconductor 1 to form a latent image. For example, a latent image of solid black image may have a given potential such as −120V. Such latent image is developed as toner image by magnetic brushes formed on the developing roller 5, in which the developing process is conducted with a given developing bias voltage such as −450V.

Such toner image is then transferred to a transfer sheet, fed to a space between the photoconductor 1 and the transfer unit 6 from a sheet feeder (not shown), in which a registration roller (not shown) adjusts a sheet feed timing to the space so that the toner image and the transfer sheet are synchronized for image forming. When the toner image is transferred, the transfer roller 6*b* is applied with a current having a given value such as +10 μA to electrostatically transfer the toner image from the photoconductor 1 to the transfer sheet. Then, the transfer sheet is separated from the photoconductor 1 by a separation unit (not shown), and transported to a fixing unit (not shown), and then ejected from the image forming apparatus 100 as copied image.

After transferring the toner image by using the transfer unit 6, some toner particles may remain on the photoconductor 1. Such toner particles may be referred as "remaining toner." Such remaining toner, which may be a mixture of toner particles having "positive polarity" and "negative polarity," is transported to a position of the conductive blade 11 with a rotation of the photoconductor 1.

The conductive blade 11 may contact the photoconductor 1 with a counter direction of the direction of rotation of the photoconductor 1. The conductive blade 11 may be made of a conductive elastic material such as polyurethane rubber, for example. The conductive blade 11 may have a given thickness range such as from 50 μm to 2000 μm, and more preferably 100 μm to 500 μm, for example. If the thickness of the conductive blade 11 is too thin, the conductive blade 11 may not be effectively pressed to the photoconductor 1 due to a waviness of the surface of the photoconductor 1 and the conductive blade 11.

If the thickness of the conductive blade 11 is too thick, the conductive blade 11 may absorb vibration energy receiving from a vibration member (not shown), attached to the conductive blade 11, by which vibration energy may not be effectively transmitted to an edge portion of the conductive blade 11. As a result, toner particles adhered on the conductive blade 11 may not be dropped from the conductive blade 11, and thereby the conductive blade 11 may become in a condition that the conductive blade 11 cannot effectively control polarity of toner particles on the photoconductor 1. Such vibration energy may be efficiently transmitted to the conductive blade 11 when the conductive blade 11 is made of a material having a relatively higher hardness such as JIS-A hardness of 85 to 100.

In another exemplary embodiment, the conductive blade 11 may be contacted to the photoconductor 1 with a given contact angle such as 20 degrees and a given contact pressure such as 20 g/cm, and impressed to the photoconductor 1 with a given impression amount such as 0.6 mm, for example. Further, the conductive blade 11 may have a given electric resistance such as $1\times10^6$ Ω·cm, or in a given range such as from $2\times10^5$ Ω·cm to $5\times10^7$ Ω·cm, for example.

The conductive blade 11, having a sheet-like shape and fixed on the blade holder 17 made of sheet metal, may have a given thickness such as 2 mm, a given free length such as 7 mm, a given hardness such as JIS-A hardness of 60 to 80, and a given coefficient of elasticity such as 30%, for example, but not limited thereto. For example, the conductive blade 11 may be made of a material having a hardness of JIS-A hardness of 40 to 85. Although the conductive blade 11 may not remove all toner particles from the photoconductor 1, the conductive blade 11 may be effectively used if only a small amount of toner particles may not be captured by the conductive blade 11.

Although the conductive blade 11 may mechanically scrape most of toner particles from the photoconductor 1, some toner particles may not be scraped by the conductive blade 11 due to a stick slip of the conductive blade 11, by which such unscraped toner particles may pass through the conductive blade 11.

As illustrated in FIG. 22, the conductive blade 11 is connected to the first power source circuit 22. The first power source circuit 22 applies a voltage having a polarity the same as normal polarity of toner particles (e.g., negative polarity) to the conductive blade 11. Accordingly, when toner particles pass through the conductive blade 11, toner particles are charged to the normal polarity (e.g., negative polarity). The conductive blade 11 may be applied with a voltage of −450V, for example.

Figure 23:
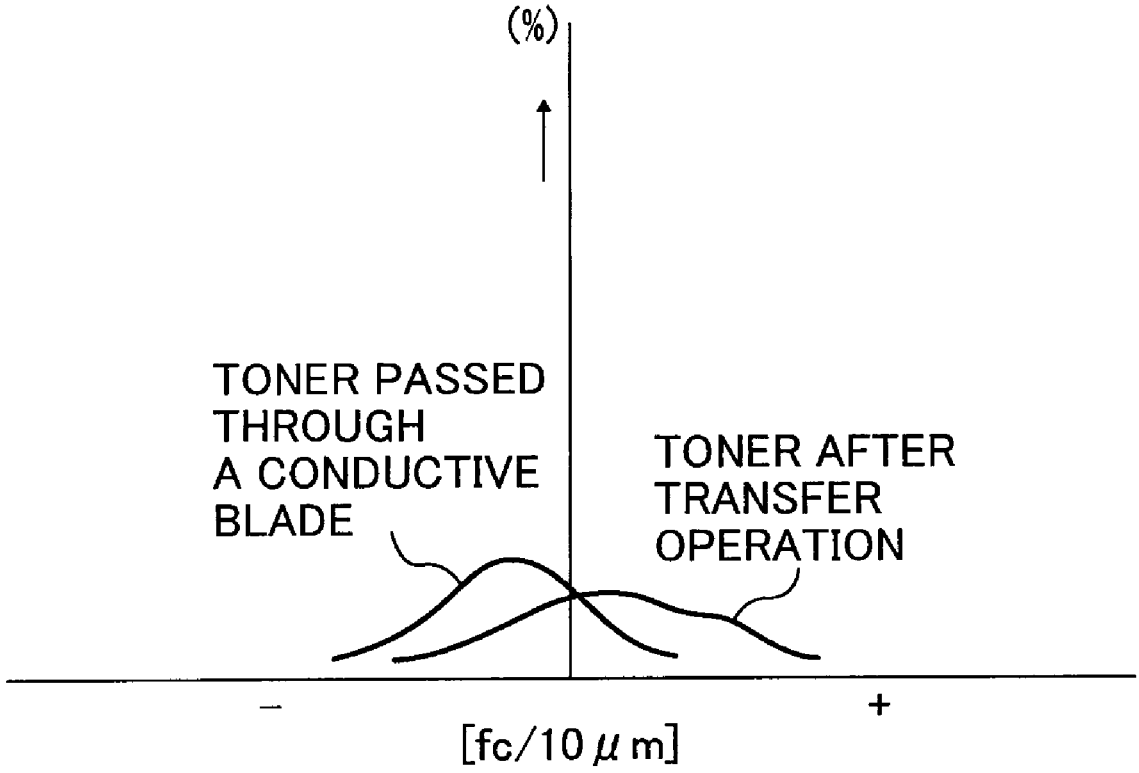
FIG. 23 shows graphs of charge potential distribution of toner particles in another exemplary embodiment of FIG. 22, in which one graph corresponds to remaining toner particles carried on a photoconductor after a toner image transfer operation and another graph corresponds to toner particles remaining on the photoconductor, which have passed through a position facing a conductive blade.

Toner particles passed through the conductive blade 11 may be frictionally electrified by receiving pressure from the photoconductor 1 and the conductive blade 11, and then toner particles may be charged to a normal polarity (i.e., negative polarity) as illustrated in FIG. 23. To charge toner particles to a normal polarity (i.e., negative polarity) more reliably, a given voltage is applied to the conductive blade 11 to control polarity of toner particles.

When toner particles are sandwiched between the conductive blade 11 and the photoconductor 1, a current, having a given voltage applied to the conductive blade 11, may flow into toner particles, by which toner particles are charged to a polarity applied to the conductive blade 11 when passing through the conductive blade 11. Further, toner particles, passed through the conductive blade 11, are charged to a polarity applied to the conductive blade 11 with a microscopic-scale electric discharge at a tiny gap having wedge-like entry and exit portion formed between the photoconductor 1 and the conductive blade 11.

However, based on measurement results of charge amount distribution of toner particles measured by E-SPART Analyzer, 90% or more of toner particles passed through the conductive blade 11 are charged to a normal polarity (i.e., negative polarity) but 10% or less toner particles passed through the conductive blade 11 are not charged to a normal polarity and remain as weaker-charged toner particles.

Toner particles passed through the conductive blade 11 further pass through a gate seal 26 (see FIG. 22) and come to a position facing the cleaning brush 111 with a rotation of the photoconductor 1, wherein the cleaning brush 111 are rotating. The cleaning brush 111 has brush fibers made of conductive polyester, for example, and is contacted to the recovery roller 117. The cleaning brush 111, the recovery roller 117, and the toner ejection screw 27 may rotate using a drive force transmitted from a driver (not shown) of the photoconductor 1 via a drive force transmission unit (not shown), for example.

The recovery roller 117, made of stainless steel (SUS), is applied with a direct current voltage such as +300V from the second power source circuit 122 at the same timing when a voltage is applied to the non-contact charge roller 2*c*, for example. A current applied to the recovery roller 117 may be a current superimposing an alternate current to a direct current in view of enhancing toner removal rate from the photoconductor 1, for example. The cleaning brush 111, not connected to a power source but contacted with a contact portion of the recovery roller 117, may be set to a given potential slightly lower than a voltage applied to the recovery roller 117.

Because most of the remaining toner on the photoconductor 1, transported to a position facing the cleaning brush 111, may have negative polarity, brush fibers of the cleaning brush 111 having positive polarity may electrostatically attract toner particles while rotating. Then, toner particles captured by the cleaning brush 111 are electrostatically attracted to the recovery roller 117 with an effect of a voltage applied to the recovery roller 117. Toner particles recovered on the recovery roller 117 are then scraped by the scraper 118 contacting the recovery roller 117 with a rotation of the recovery roller 117.

Hereinafter, such cleaning operation for removing toner particles having negative polarity, controlled to negative polarity by the conductive blade 11 applied with a negative voltage, is referred as "normal toner recovery operation" in this disclosure. On one hand, a cleaning operation for removing toner particles having positive polarity is referred as "another toner recovery operation" in this disclosure because such toner particles having positive polarity are toner particles not correctly controlled to designed polarity (i.e., negative polarity) when passed through the conductive blade 11.

In the above descried configuration, toner particles passed through the conductive blade 111 but not charged to normal polarity also pass through the gate seal 26 with a rotation of the photoconductor 1 and come to a cleaning area where the cleaning brush 111 contacts the photoconductor 1 as similar to toner particles charged to the normal polarity.

Brush fibers of the cleaning brush 111 may be configured with a polyester fiber and a conductive carbon dispersed in polyester fiber, for example. Polyester is a material, which is more likely to be charged to a negative polarity when compared other materials in a frictional charge trend of materials. For example, polyester may be charged a negative polarity when polyester material frictions with the photoconductor 1 having an aluminum core and a thin surface layer made of polycarbonate and a photosensitive material.

Accordingly, brush fibers of the cleaning brush 111 are charged to a negative polarity by frictioning with the photoconductor 1, and such brush fibers of the cleaning brush 111 can electrostatically attract toner particles not charged to the normal polarity (i.e., positive polarity) from the photoconductor 1.

As such, a small amount of toner particles not controlled to the normal polarity (i.e., positive polarity) on the photoconductor 1 can be cleaned by the cleaning brush 111.

However, such toner particles having positive polarity, opposite to voltage polarity applied to the conductive blade 11, may not be recovered by the recovery roller 117, and may stick to the brush fibers of the cleaning brush 111, by which frictional electrification between the brush fibers and the photoconductor 1 may not occur effectively.

In view of such phenomenon, a recovery unit, which can recover toner particles, charged to a polarity opposite to a voltage polarity applied to the conductive blade 11 and adhering the brush fibers of the cleaning brush 111, may be in need, wherein such toner recovery operation for toner particles not controlled to a normal polarity is conducted at given timing.

In the above described configuration, toner particles captured by brush fibers having been frictionally electrified are weaker-charged toner particles having positive polarity, which are not controlled to the normal polarity by the conductive blade 11. Therefore, even if such weaker-charged toner particles having positive polarity, not recovered by the recovery roller 117, are transported to a cleaning area between the photoconductor 1 and the cleaning brush 111 again, such weaker-charged toner particles may not receive an electric field effect formed between the photoconductor 1 and the cleaning brush 111, and thereby toner particles may continue to adhere on the brush fibers, and may not be attracted to the photoconductor 1.

As illustrated in FIG. 22, the second power source circuit 122 includes the primary power source 122*a*, the secondary power source 122*b*, and the switch 122*c*.

The primary power source 122*a* applies a voltage having one polarity to the recovery roller 117. For example, the primary power source 122*a* may apply +300V to the recovery roller 117. The secondary power source 122*b* applies a voltage having other polarity to the recovery roller 117. For example, the secondary power source 122*b* may apply −300V to the recovery roller 117. Further, by using the switch 122*c*, a voltage applied to the recovery roller 117 can be switched over from the primary power source 122*a* to the secondary power source 122*b* or from the secondary power source 122*b* to the primary power source 122*a*. Accordingly, the switch 122*c* has a switching function of voltage polarity to be applied to the recovery roller 117.

As noted above, during a normal toner recovery operation, the switch 122*c* may be connected to the primary power source 122*a* so that the primary power source 122*a* can apply a voltage of +300V to the recovery roller 117. With such voltage application, the cleaning brush 111 may be charged to +220V, which is slightly lower than +300 V applied to the recovery roller 117.

Then, charge controlled toner particles having negative polarity and adhering the cleaning brush 111 (i.e., same polarity applied to the conductive blade 11) may be electrostatically attracted to the recovery roller 117, and thereby removed from the cleaning brush 111. Then, toner particles having negative polarity electrostatically attracted to the recovery roller 117 are scraped by the scraper 118 with a rotation of the recovery roller 117, and may drop off to the toner ejection screw 27. The toner ejection screw 27 transports such toner particles to a waste toner tank (not shown) provided outside of the cleaning unit 7.

On one hand, when to conduct another toner recovery operation for toner particles having positive polarity, which are not controlled to a voltage polarity applied to the conductive blade 11, the switch 122*c* is switched and connected to the secondary power source 122*b* so that the secondary power source 122*b* can apply a voltage of −300V to the recovery roller 117. With such voltage application, brush edge of the cleaning brush 111 is charged to about −200V.

Then, toner particles having positive polarity adhering on the cleaning brush 111 may be attracted to the recovery roller 117 having a stronger negative electric field, and may adhere on the recovery roller 117. With such process, toner particles having positive polarity (i.e., polarity is not controlled to negative polarity by the conductive blade 11) can be also removed from the cleaning brush 111. Then, toner particles having positive polarity adhering the recovery roller 117 are scraped by the scraper 118 with a rotation of the recovery roller 117, and may drop off to the toner ejection screw 27. The toner ejection screw 27 transports such toner particles to a waste toner tank (not shown) provided outside of the cleaning unit 7.

Such another toner recovery operation may be conducted when one image forming operation has completed, or when a sheet is not fed to an image forming section, for example.

If a charge amount of toner particles may become "0 fC," such toner particles cannot be electrostatically recovered. Accordingly the above-described another toner recovery operation cannot be conducted when electric charges of toner particles are significantly decreased, which may occur by having been left an image forming apparatus at unused condition for a long period of time. Therefore, such another toner recovery operation may preferably be conducted when one image forming operation has completed, for example. Further, if image forming operations may consecutively continue for a longer period time, such another toner recovery operation for toner particles not controlled to the normal polarity may be conducted at a given timing during image forming operations.

Further, the secondary power source 122*b* may apply a voltage of −300V to the recovery roller 117 for a given time period. Specifically, the recovery roller 117 is applied with −300V for a time period corresponding at least one rotation of the cleaning brush 111, and more preferably five rotation or more of the cleaning brush 111, for example.

Figure 24:
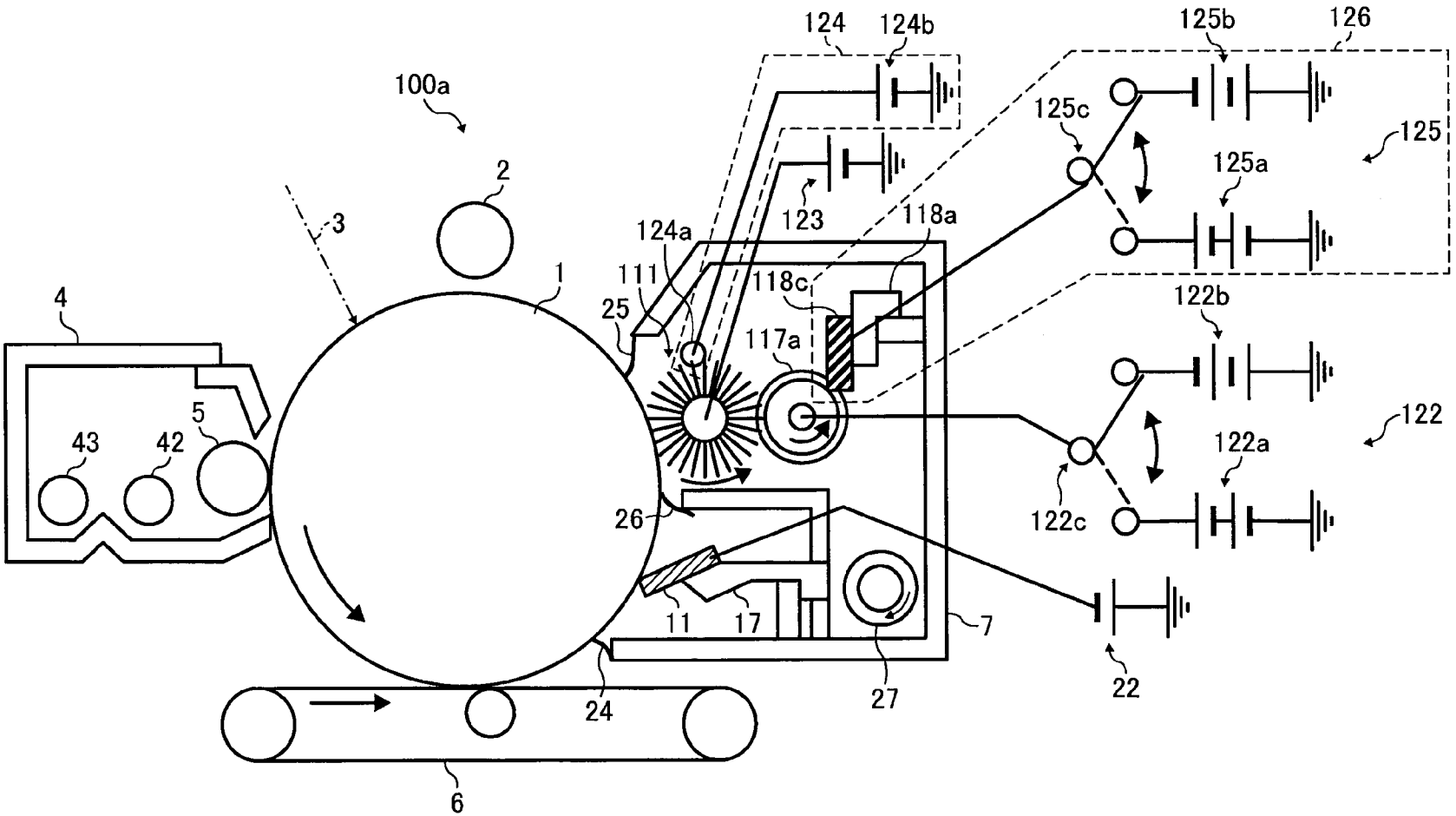
FIG. 24 illustrates a schematic configuration of an image forming apparatus having another cleaning unit according to another exemplary embodiment.

FIG. 24 illustrates a schematic configuration of an image forming apparatus 100*a*, which is modified from the image forming apparatus 100 shown in FIG. 23.

The image forming apparatus 100*a* includes a high-resistance recovery roller 117*a* having a surface layer made of high-resistance material, a brush charge applicator 124 for applying electric charges to a surface of brush fibers of the cleaning brush 111, and a surface charge applicator 126 for applying electric charges to a surface of the high-resistance recovery roller 117*a*, and the second power source circuit 122 used as another charge applicator for applying electric charges to a core of the high-resistance recovery roller 117*a*, wherein the core is made of a conductive material.

For example, the high-resistance recovery roller 117*a* may be configured with a metal core, an intermediate layer, and a surface layer. The metal core is made of SUS and having a given diameter such as 16 mm, and coated with the intermediate layer made of PVDF (polyvinylidene fluoride) layer having a given thickness such as 100 μm, and the surface layer formed on the PVDF layer made of acrylic UV (ultra violet)

cure resin, for example. Such high-resistance recovery roller 117*a* may have a given resistance such as log Ω=12, for example.

The brush charge applicator 124 includes an electric charge application member 124*a* and a fourth power source circuit 124*b*, for example.

The electric charge application member 124*a* may be positioned at an upstream side of a rotating direction of the cleaning brush 111 with respect to a cleaning area where the cleaning brush 111 and the photoconductor 1 contact each other. Accordingly, after the brush fibers of the cleaning brush 111 are applied with electric charges from the electric charge application member 124*a*, the cleaning brush 111 contacts and cleans the surface of the photoconductor 1. The electric charge application member 124*a* may be made of stainless bar, extending in a direction toward a metal core of the cleaning brush 111, and may contact brush edge of brush fibers with a given overlapping length such as 1 mm, for example. Other than stainless steel, the electric charge application member 124*a* may be made of any conductive material and may be shaped in a sheet-like shape instead of a bar shape.

The fourth power source circuit 124*b* connected to the electric charge application member 124*a* applies a voltage (i.e., positive polarity), opposite to voltage polarity applied to the conductive blade 11, to the electric charge application member 124*a*.

The surface charge applicator 126 for the recovery roller 117*a* includes a conductive scraper 118*c*, and a fifth power source circuit 125 connected to the conductive scraper 118*c*. The conductive scraper 118*c* may be made of a polyurethane blade having a given conductivity, and the fifth power source circuit 125 applies a voltage to the conductive scraper 118*c*. The fifth power source circuit 125 includes a primary power source 125*a*, a secondary power source 125*b*, and a switch 125*c*, for example.

The primary power source 125*a* applies a given voltage having positive polarity to the conductive scraper 118*c*, and the secondary power source 125*b* applies a given voltage having negative polarity to the conductive scraper 118*c*. Further, by using the switch 125*c*, a voltage applied to the conductive scraper 118*c* can be switched over from the primary power source 125*a* to the secondary power source 125*b* or from the secondary power source 125*b* to the primary power source 125*a*. Accordingly, the switch 125*c* has a switching function of voltage polarity to be applied to the conductive scraper 118*c*.

Further, in a configuration shown in FIG. 24, the third power source circuit 123 applies a given voltage having a polarity (i.e., positive polarity), opposite to a voltage polarity applied to the conductive blade 11, to the metal core of the cleaning brush 111.

By using the high-resistance recovery roller 117*a*, toner particles adhered on brush fibers of the cleaning brush 111 can be recovered more effectively, and a cleaning performance of the cleaning brush 111 can be enhanced. A description is now given to a high-resistance recovery roller by comparing with a recovery roller having lower resistance, which may be used as ordinal recovery roller with reference to FIGS. 25A and 25B.

Figure 25A:
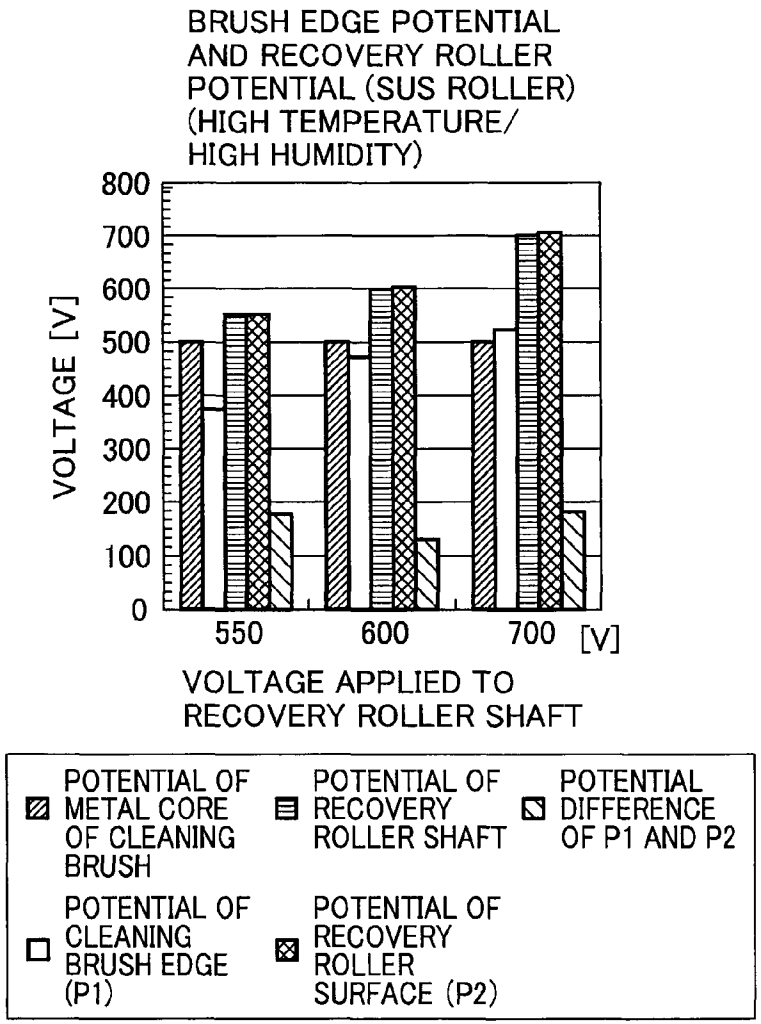
FIG. 25A shows graphs of surface potential of a recovery roller made of metal and an edge potential of a cleaning brush.

FIG. 25A shows potential level of a recovery roller and a cleaning brush under a higher temperature/higher humidity environment, in which the recovery roller employs a metal recovery roller (e.g., SUS roller). Under a higher temperature/higher humidity environment (e.g., 32 degrees Centigrade/80% humidity environment), a voltage of +500V was applied to a metal core of the cleaning brush, and a voltage of +550V to +700V was applied to the recovery roller shaft. FIG. 25A shows a potential of metal core of the cleaning brush, a potential of a cleaning brush edge (P1), a potential of recovery roller shaft, a potential of recovery roller surface (P2), and a potential difference between the recovery roller surface (P2) and the cleaning brush edge (P1).

Figure 25B:
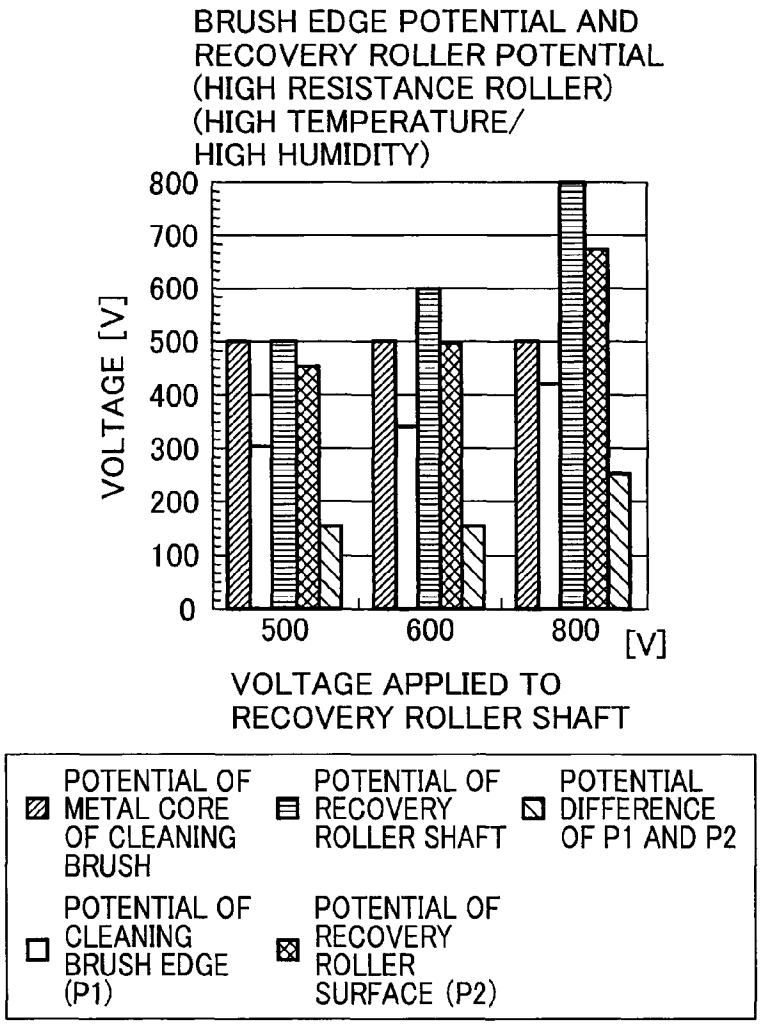
FIG. 25B shows graphs of surface potential of a recovery roller made of high-resistance material and an edge potential of a cleaning brush.

FIG. 25B shows potential level of a recovery roller and a cleaning brush under a higher temperature/higher humidity environment, in which the recovery roller employs a high-resistance recovery roller. Under a higher temperature/higher humidity environment (e.g., 32 degrees Centigrade/80% humidity environment), a voltage of +500 V was applied to a metal core of the cleaning brush, and a voltage of +500 V to +800 V was applied to the recovery roller shaft.

FIG. 25B shows a potential of metal core of the cleaning brush, a potential of a cleaning brush edge (P1), a potential of recovery roller shaft, a potential of recovery roller surface (P2), and a potential difference between the recovery roller surface (P2) and the cleaning brush edge (P1).

As shown in FIGS. 25A and 25B, when a surface potential of the recovery roller is set to about +700V, a cleaning brush edge potential of the cleaning brush used with the high-resistance recovery roller (FIG. 25B) may become smaller than a cleaning brush edge potential of the cleaning brush used with the metal recovery roller (FIG. 25A). Therefore, when a voltage value applied to the recovery roller shaft is increased, a potential difference between the recovery roller surface and the cleaning brush edge becomes greater when a high-resistance recovery roller is used as recovery roller. If such potential difference becomes greater, the recovery roller can electrostatically attract toner particles adhering the cleaning brush with a greater electrostatic force, by which the recovery roller can recover toner particles in an enhanced manner.

Figure 26:
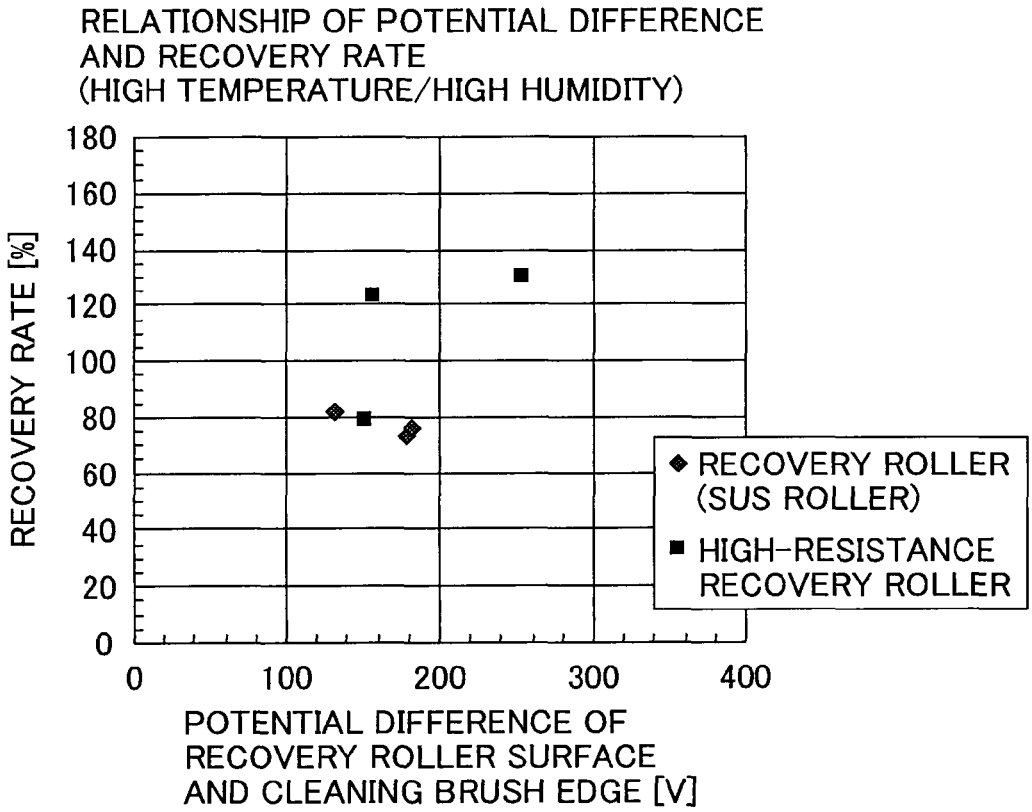
FIG. 26 shows graphs indicating a relationship of toner recovery rate and a potential difference between a surface of a recovery roller and a brush edge of a cleaning brush, in which recovery rollers are made of different materials.

FIG. 26 shows graphs for toner recovery rate under a higher temperature and higher humidity (e.g., 32 degrees Centigrade/80% humidity), in which the horizontal axis indicates the potential difference between the recovery roller surface and the cleaning brush edge, and the vertical axis indicates a toner recovery rate, which is obtained as follows. Toner amount per unit area having a unit of "mg/cm$^2$" is used for the purpose of simplifying calculation of toner recovery rate. First a given amount of toner particles is adhered on a photoconductor, and the photoconductor is cleaned by a cleaning brush, then the cleaning brush is cleaned by a recovery roller. After such cleaning process, toner amount recovered by a recovery roller is measured, in which toner amount per unit area is measured. Then, the toner recovery rate is computed as below, in which "M/A" means toner amount per unit area (mg/cm$^2$).

$$\text{Toner recovery rate (\%)} = (M/A \text{ on recovery roller}) / (M/A \text{ input to cleaning brush}) \times 100$$

As shown in FIG. 26, the toner recovery rate by the metal recovery roller (SUS roller) is about 80% or less, and the toner recovery rate by the high-resistance roller is 100% or more. The toner recovery rate of more than 100% may occur as follows. In this experiment, toner particles are input for 10 seconds. In such condition, during first several seconds period, toner particles may not be recovered effectively by a cleaning brush and a recovery roller, by which toner particles may accumulate in the cleaning brush, and such accumulated toner particles and subsequently input toner particles are combined and recovered by the recovery roller, and thereby a toner recover amount may exceed input (or used) amount of toner.

Based on results shown in FIGS. 25A, 25B, and 26, a high-resistance recovery roller may have a better toner recover rate than a metal recovery roller.

Figure 27:
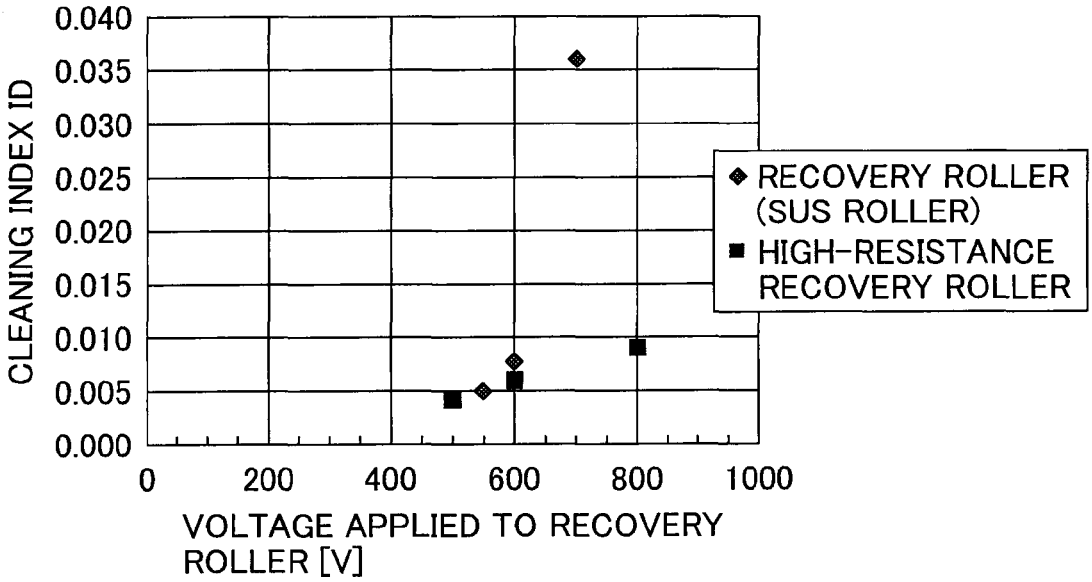
FIG. 27 shows graphs indicating a relationship of cleaning index ID and voltage applied to recovery rollers made of different materials.

FIG. 27 is a graph for indicating a relationship of voltage applied to a recovery roller and a cleaning index ID (vertical axis in graph), which is defined as below.

After cleaning the photoconductor 1 with the cleaning brush 111, toner particles remaining on the photoconductor 1 is transferred to a transparent tape, and the transparent tape is attached on a white sheet. Then, a reflection density (or image density ID) of toner particles is measured with a spectroscopic chronometer (e.g., X-Rite 938 produced by X-Rite, Incorporated) as RD1. Another transparent tape having no toner particles is also attached to a white sheet to measure a reflection density with a spectroscopic chronometer (e.g., X-Rite 938) as RD2. The cleaning index ID can be obtained by subtracting RD2 from RD1. Because the cleaning index ID and a number of toner particles has a correlation, the greater the number of toner particles, the greater the reflection density (or cleaning index ID). Accordingly, a cleaning performance level can be determined using the cleaning index ID. Therefore, the smaller the cleaning index ID, the better the cleaning performance level.

As shown in FIG. 27, a cleaning performance level of a high-resistance recovery roller can be maintained at a given preferable level as indicated by the cleaning index ID even when a voltage value applied to the recovery roller is increased, which is different from a metal recovery roller (e.g., SUS roller). Such phenomenon may be explained as below.

A positive polarity voltage V1 is applied to the metal core of the cleaning brush 111 so that a cleaning brush edge potential can be set higher than a surface potential of the photoconductor 1, which has passed through the conductive blade 11 (used as polarity control member), and a positive polarity voltage V2 is applied to the recovery roller shaft, in which V2 is set higher than V1 (V2>V1). After transferring toner image, toner particles remaining on the photoconductor 1 come to a position facing the conductive blade 11. Then, after passing through the conductive blade 11, toner particles having negative polarity (i.e., normal polarity) are attracted to the cleaning brush 111 charged to positive polarity.

Further, weaker-charged toner particles having positive polarity may be attracted to brush fibers of the cleaning brush 111, which is frictionally electrified, wherein such weaker-charged toner particles are toner particles not controlled to normal polarity by the conductive blade 11.

Then, toner particles having negative polarity adhered to the brush fibers of the cleaning brush 111 are recovered by the recovery roller 117 applied with a positive polarity voltage set higher than the cleaning brush 111.

When the recovery roller 117 contacts brush fibers of the cleaning brush 111 and toner particles adhered on brush fibers of the cleaning brush 111, the recovery roller 117 may continuously supply electric charges to the brush fibers of the cleaning brush 111 and toner particles adhered on brush fibers of the cleaning brush 111 until a potential of such brush fibers and toner particles may become a potential level same as a surface potential of the recovery roller 117.

Compared to a high-resistance recovery roller, a metal recovery roller surface may supply electric charge to brush fibers and toner particles with a shorter time, in which the metal recovery roller supplies electric charge to brush fibers and toner particles, and then the metal recovery roller is applied with power from a power source, by which a potential level of the metal recovery roller becomes same as potential of the power source.

Accordingly, compared to a high-resistance recovery roller, a metal recovery roller (e.g., SUS roller) may supply a greater amount of electric charges to brush fibers and toner particles on the cleaning brush 111 at a recovery area where brush fibers contact the metal recovery roller.

If a voltage applied to the recovery roller becomes greater, an amount of electric charges supplied to brush fibers and toner particles becomes greater, by which weaker-charged toner particles having positive polarity, adhered on brush fibers with an effect of frictional electrification of brush fibers of the cleaning brush 111, may become strongly charged toner particles having positive polarity, and further, if a voltage applied to the recovery roller becomes greater, toner particles having negative polarity adhered on brush fibers of the cleaning brush 111 may also become strongly charged toner particles having positive polarity by inverting polarity. Accordingly, brush fibers of the cleaning brush 111 may have a greater number of strongly charged toner particles having positive polarity.

Because a potential level of the photoconductor 1 is in negative polarity side compared to a cleaning brush edge potential, such strongly charged toner particles having positive polarity may re-adhere to the photoconductor 1 from the brush fibers of the cleaning brush 111, and thereby the cleaning index ID for a metal recovery roller may become greater.

On one hand, if the recovery roller is a high-resistance recovery roller having a given surface resistivity such as $10^{10}$ Ω/sq. to $10^{13}$ Ω/sq., the high-resistance recovery roller may supply a small amount of electric charges to toner particles sandwiched between brush fibers of the cleaning brush 111 and the high-resistance recovery roller. Accordingly, even if a higher voltage is applied to the high-resistance recovery roller, an amount of toner particles strongly charged to positive polarity may become smaller compared to the metal recovery roller, and thereby the cleaning index ID for a high-resistance recovery roller may become smaller.

As such, under a higher temperature/higher humidity environment, if the recovery roller surface is made of higher resistive layer (e.g., $10^{10}$ Ω·cm or more) or an insulating layer, toner particles sandwiched between brush fibers of the cleaning brush 111 and a recovery roller may not be strongly charged to positive polarity, which is preferable.

However, if a high-resistance recovery roller is used under a lower temperature/lower humidity environment, the following phenomena such as "fluctuation of cleaning brush edge potential" and "fluctuation of recovery roller potential" may occur. A description is given to a cleaning operation under a lower temperature/lower humidity environment using a high-resistance recovery roller.

Figure 28:
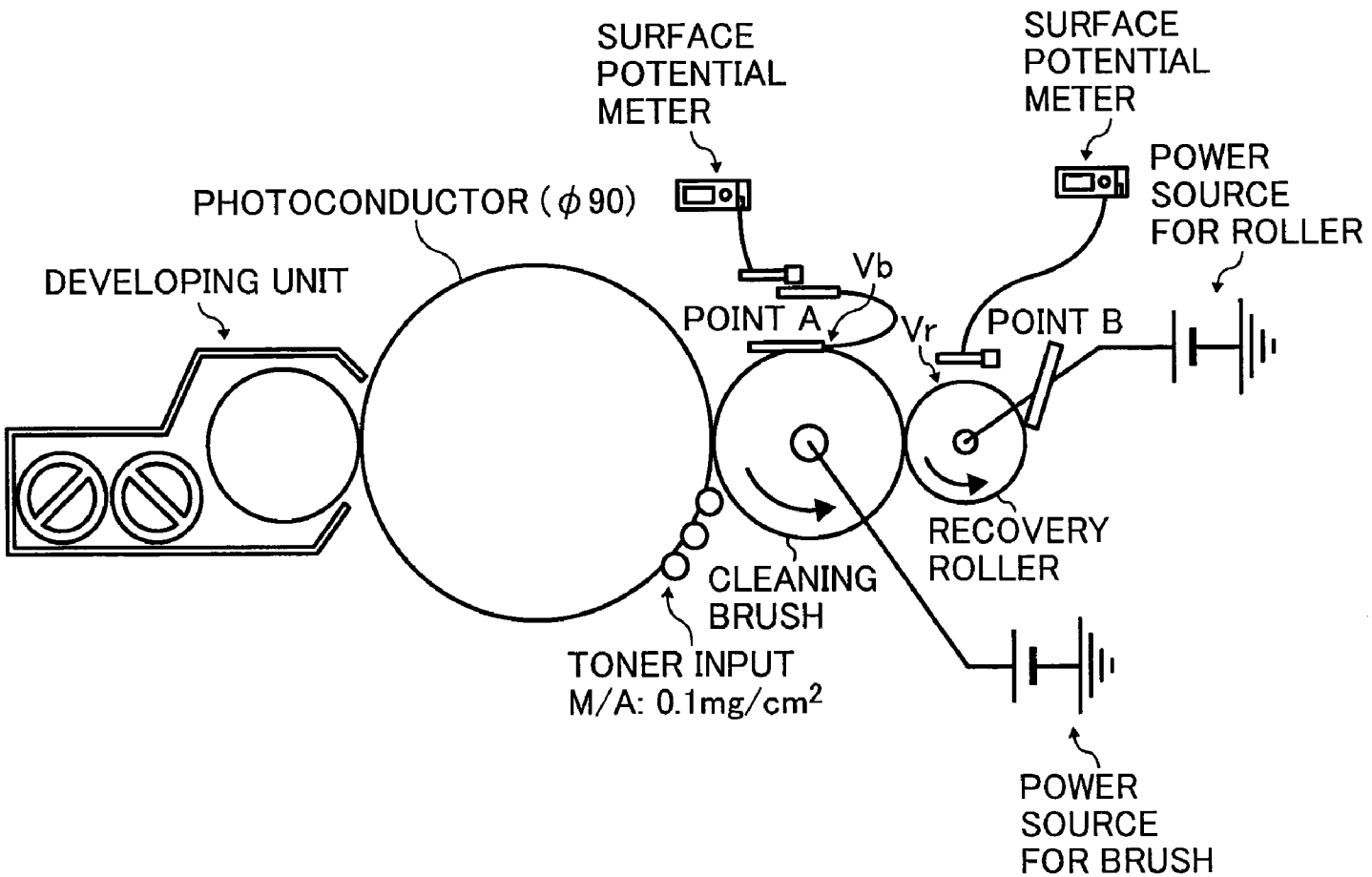
FIG. 28 illustrates a schematic configuration of an apparatus used for experiment to measure an edge potential of a cleaning brush and a surface potential of a recovery roller.

With an experiment apparatus shown in FIG. 28, a surface potential of a high-resistance recovery roller was measured at point B, in which the above-described cleaning operation was conducted under a lower temperature/lower humidity environment (e.g., 10 degrees Centigrade/15% humidity).

Figure 29A:
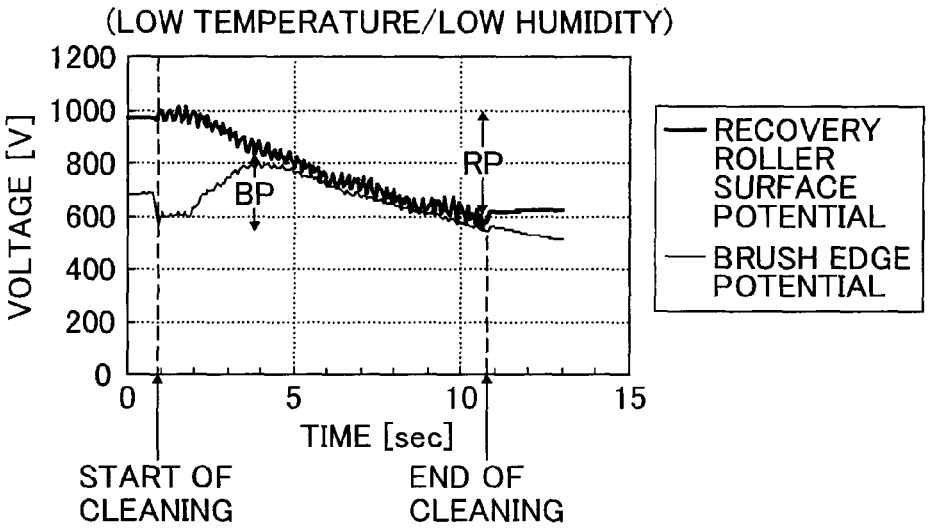
FIG. 29A shows graphs of a measurement result of an edge potential of a cleaning brush and a surface potential of a recovery roller at ten seconds later after starting a cleaning operation of toner particles.
Figure 29B:
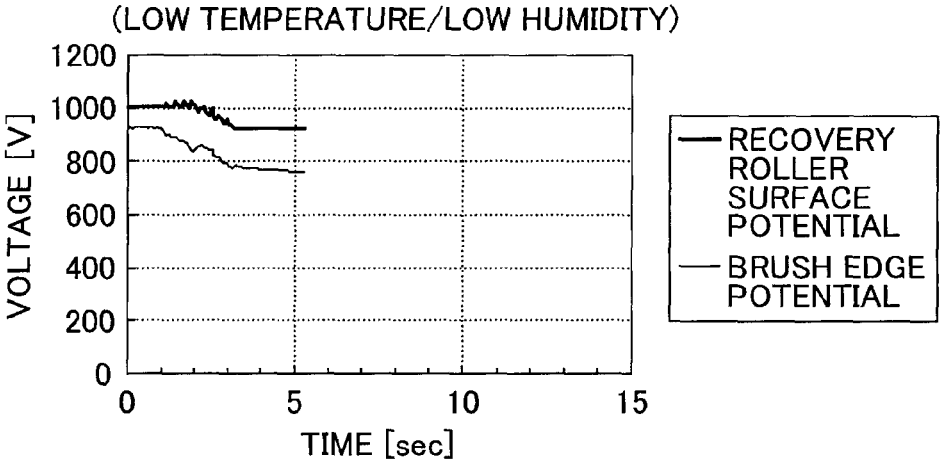
FIG. 29B shows graphs of a measurement result of an edge potential of a cleaning brush and a surface potential of a recovery roller at two seconds later after starting a cleaning operation of toner particles.
Figure 29C:
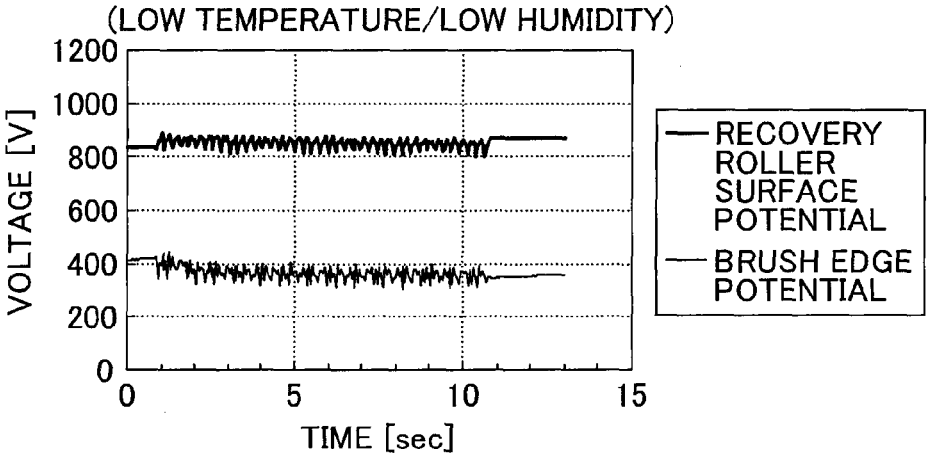
FIG. 29C shows graphs of a measurement result of an edge potential of a cleaning brush and a surface potential of a recovery roller, measured for ten seconds without inputting toner particles.

After cleaning toner particles adhered on a surface of the high-resistance recovery roller with a scraper, a surface potential of a high-resistance recovery roller was measured at point B. Based on such experiment, it was confirmed that a surface potential of a high-resistance recovery roller takes a lower value. Further, a cleaning brush edge potential of a cleaning brush roller, rotationally contacting the high-resistance recovery roller was measured with a surface potential meter at point A, and it was confirmed that the cleaning brush edge potential fluctuates for several hundreds voltage level. FIGS. 29A, 29B, and 29C show measurement results of a surface potential of a high-resistance recovery roller and a cleaning brush edge potential, all of which were conducted under a lower temperature/lower humidity environment (e.g., 10 degrees Centigrade/15% humidity).

FIG. 29A shows graphs of a measurement result of an edge potential of a cleaning brush and a surface potential of a recovery roller for ten seconds or so after starting a cleaning operation of toner particles.

FIG. 29B shows graphs of a measurement result of an edge potential of a cleaning brush and a surface potential of a recovery roller for two seconds or so after starting a cleaning operation of toner particles.

FIG. 29C shows graphs of a measurement result of an edge potential of a cleaning brush and a surface potential of a recovery roller for ten seconds without inputting toner particles.

When measuring potential, the high-resistance recovery roller shaft was applied with a voltage of +1000V, and a metal core of the cleaning brush was applied with a voltage of +700V. Further, toner amount per unit area (M/A), input to a photoconductor, was set to 0.1 mg/cm$^2$, and electric charge per unit weight (Q/M) was set to −5 μC/g to −11 μC/g. Generally, after transferring toner image, toner amount per unit area remaining on a photoconductor may be estimated about 0.02 mg/cm$^2$ to 0.08 mg/cm$^2$ although some variation may occur, and in this experiment, toner amount per unit area was set to a value slightly exceeding such value.

FIG. 29A shows a trend of potential for 10 seconds after starting a cleaning operation, in which a surface potential of a recovery roller decreased for about 400V in 10 seconds later after starting a cleaning operation (see arrow RP in FIG. 29A). Further, a cleaning brush edge potential fluctuated for about 250V in 10 seconds after starting a cleaning operation (see arrow BP in FIG. 29A). Further, a potential difference between the recovery roller and the cleaning brush becomes about 30V in 10 seconds later after starting a cleaning operation (i.e., at the end of cleaning operation) although such potential difference at the start of cleaning operation was about 400V.

FIG. 29B shows a trend of potential for two seconds after starting a cleaning operation, in which a potential difference is relatively greater (e.g., about 150V) although a decrease of surface potential of the recovery roller and fluctuation of cleaning brush edge potential occurred.

FIG. 29C shows a trend of potential for 10 seconds without inputting toner particles, in which a surface potential of the recovery roller did not decrease for several hundred voltages, and a cleaning brush edge potential did not fluctuate for several hundred voltages.

Although mechanism for such potential fluctuation of a cleaning brush edge and a surface potential decrease of a recovery roller may not be known yet, toner particles may have some effect to such potential fluctuation or decrease based on the results shown in FIGS. 29A to 29C.

One theory may explain surface potential decrease of a recovery roller as follows: When toner particles having electric charge and adhering a surface of the recovery roller are scraped by a scraper, separating discharge may occur, and electric charges having negative polarity may be supplied to a high resistive layer or an insulating layer of the recovery roller. Another theory may explain surface potential decrease of a recovery roller as follows: electric charges of negative polarity are supplied to a surface layer of a recovery roller when toner particles adhere the recovery roller, and such electric charges may remain on the recovery roller even if a scraper scrapes toner particles.

If a potential difference between a recovery roller and a cleaning brush may substantially become zero as shown in FIG. 29A, toner particles may not be recovered by the recovery roller, and toner particles remain and accumulate on brush fibers of the cleaning brush, and thereby a cleaning performance level of a photoconductor may degrade.

Figure 30:
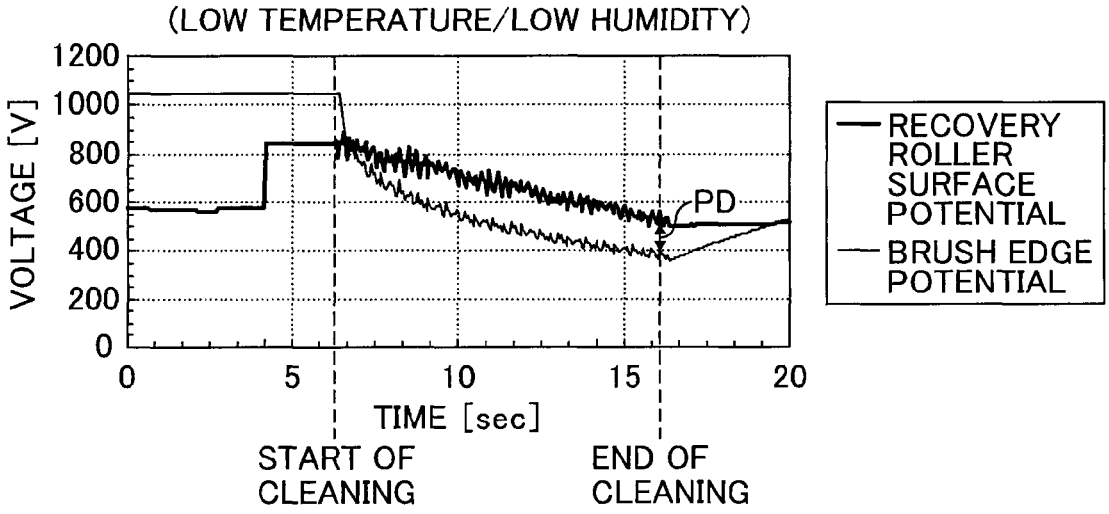
FIG. 30 shows graphs of measurement results of an edge potential of a cleaning brush and a surface potential of a high-resistance recovery roller when toner particles are cleaned under a given condition.

In view of such phenomenon, in a configuration shown in FIG. 24, the surface charge applicator 126 applies electric charges to a surface of the high-resistance recovery roller 117*a* to suppress a decrease of surface potential of the high-resistance recovery roller 117*a* used as recovery roller. FIG. 30 shows a measurement result when the high-resistance recovery roller 117*a* is applied with a given voltage by the surface charge applicator 126.

FIG. 30 shows a trend of potential of a high-resistance recovery roller and a cleaning brush edge under a lower temperature and lower humidity (e.g., 10 degrees Centigrade/15% humidity), in which a metal core of a cleaning brush was applied with +700V, a roller shaft of the high-resistance recovery roller 117*a* was applied with +1000V, and a scraper was applied with +1000V, and a surface potential of a high-resistance recovery roller and a cleaning brush edge potential were measured with a surface potential meter while inputting toner particles as similar to a measurement shown in FIG. 29A.

By comparing the results shown in FIG. 29A and FIG. 30, a decrease of surface potential (arrow PD in FIG. 30) of the high-resistance recovery roller 117*a* (see FIG. 24) was suppressed by applying electric charges to a surface of the recovery roller with the surface charge applicator 126 (see FIG. 24). Therefore, a potential difference between a surface of the high-resistance recovery roller 117*a* and the cleaning brush edge can be maintained at a relatively greater value for about 10 seconds later after starting a cleaning operation. Such potential difference can be maintained more reliably by increasing a surface potential of the high-resistance recovery roller 117*a* by using the conductive scraper 118*c* having a lower resistance or increasing voltage applied to a scraper.

Figure 31:
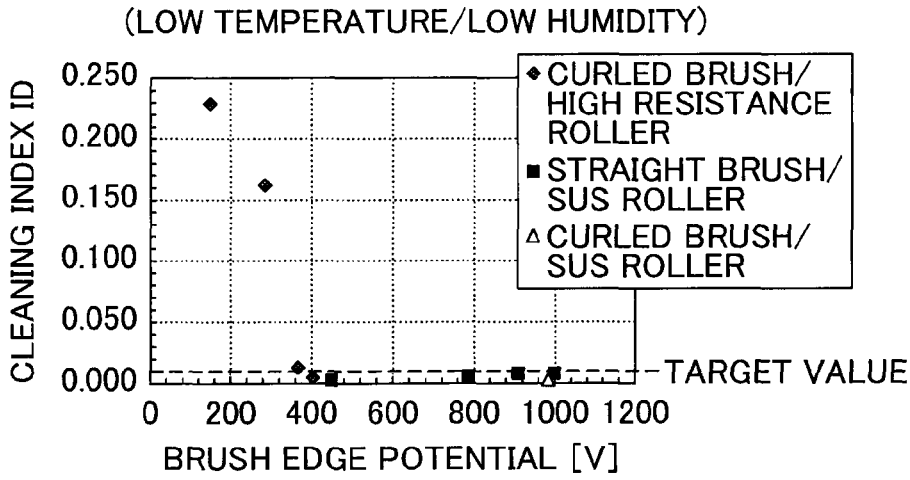
FIG. 31 shows graphs indicating a relationship of cleaning index ID and an edge potential of a cleaning brush under lower temperature/lower humidity environment.
Figure 32:
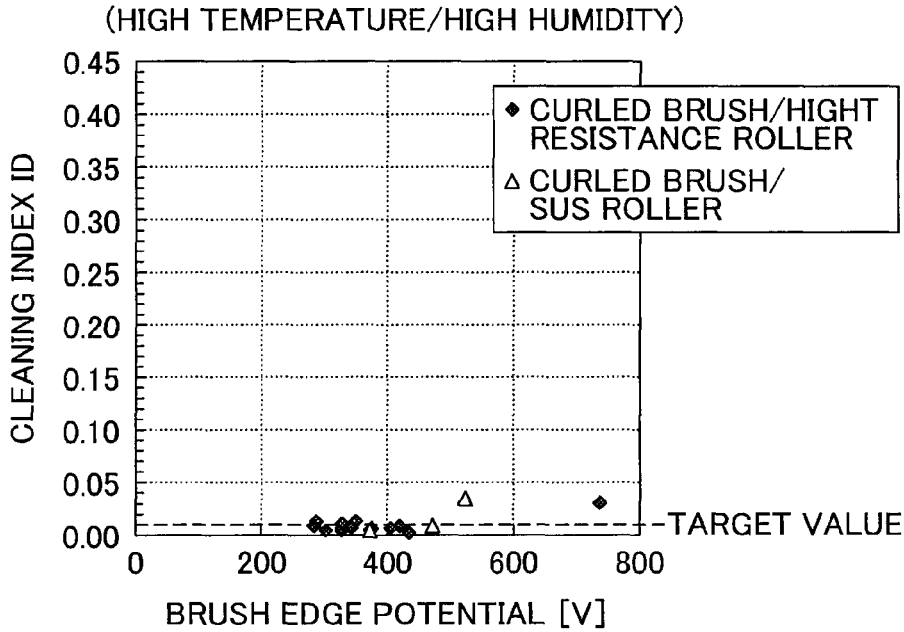
FIG. 32 shows graphs indicating a relationship of cleaning index ID and an edge potential of a cleaning brush under higher temperature/higher humidity environment.

A description is given to a relationship of a cleaning brush edge potential and a cleaning index ID for a photoconductor under a lower temperature/lower humidity environment or under a higher temperature/higher humidity environment with reference to FIGS. 31 and 32.

FIG. 31 shows a relationship of a cleaning brush edge potential and a cleaning index ID for a photoconductor under a lower temperature/lower humidity environment (e.g., 10 degrees Centigrade/15% humidity). FIG. 32 shows a relationship of a cleaning brush edge potential and a cleaning index ID for a photoconductor under a higher temperature/higher humidity environment (e.g., 32 degrees Centigrade/80% humidity).

As shown in FIG. 31, under a lower temperature/lower humidity environment (e.g., 10 degrees Centigrade/15% humidity), when a cleaning brush edge potential is set about +400V to +1000V, the cleaning index ID can be preferably set smaller than a target value of 0.01. Further, as shown in FIG. 32, under a higher temperature/higher humidity environment (e.g., 32 degrees Centigrade/80% humidity), when a cleaning brush edge potential is set about +300V to +500V, the cleaning index ID can be preferably set smaller than a target value of 0.01. Based on such results, a cleaning performance may be maintained at a preferable level under any one of lower temperature/lower humidity environment and higher temperature/higher humidity environment when a cleaning brush edge potential is set to +400V to +500V.

However, as shown in FIGS. 29A and 29B, when a high-resistance recovery roller is used under a lower temperature/lower humidity environment for a cleaning operation, a cleaning brush edge potential fluctuates greatly when a given length of time (e.g., two seconds or more) is required for completing a cleaning operation.

In view of such phenomenon, in a configuration shown in FIG. 24, the brush charge applicator 124 applies electric charges to cleaning brush edge to suppress a fluctuation of cleaning brush edge potential. In such configuration, the electric charge application member 124*a* may be impressed for 1 mm length from a cleaning brush edge, and applied with a given voltage (e.g., +500V) from the fourth power source circuit 124*b*.

Figure 33:
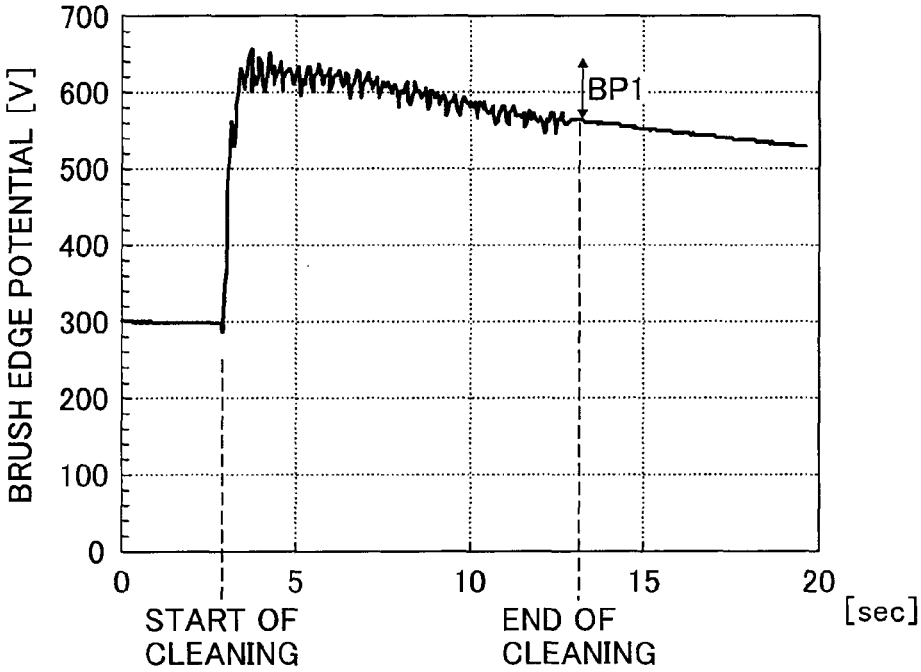
FIG. 33 shows graphs of a measurement result of an edge potential of a cleaning brush when toner particles toner particles are cleaned under a given condition.

FIG. 33 shows a trend of potential of cleaning brush edge under a higher temperature/higher humidity environment (e.g., 32 degrees Centigrade/80% humidity), in which a metal core of a cleaning brush was applied with +700V, the electric charge application member 124*a* was applied with +700V, a roller shaft of the high-resistance recovery roller 117*a* was applied with +1000V, and the conductive scraper 118*c* was applied with +1000V, and a cleaning brush edge potential of a cleaning brush was measured with a surface potential meter while inputting toner particles.

As shown in FIG. 33, a potential fluctuation (an arrow BP1) of a cleaning brush is suppressed compared to a potential fluctuation of FIG. 29A, and a potential decrease of a cleaning brush is also suppressed in FIG. 33 compared to FIG. 29A.

Figure 34:
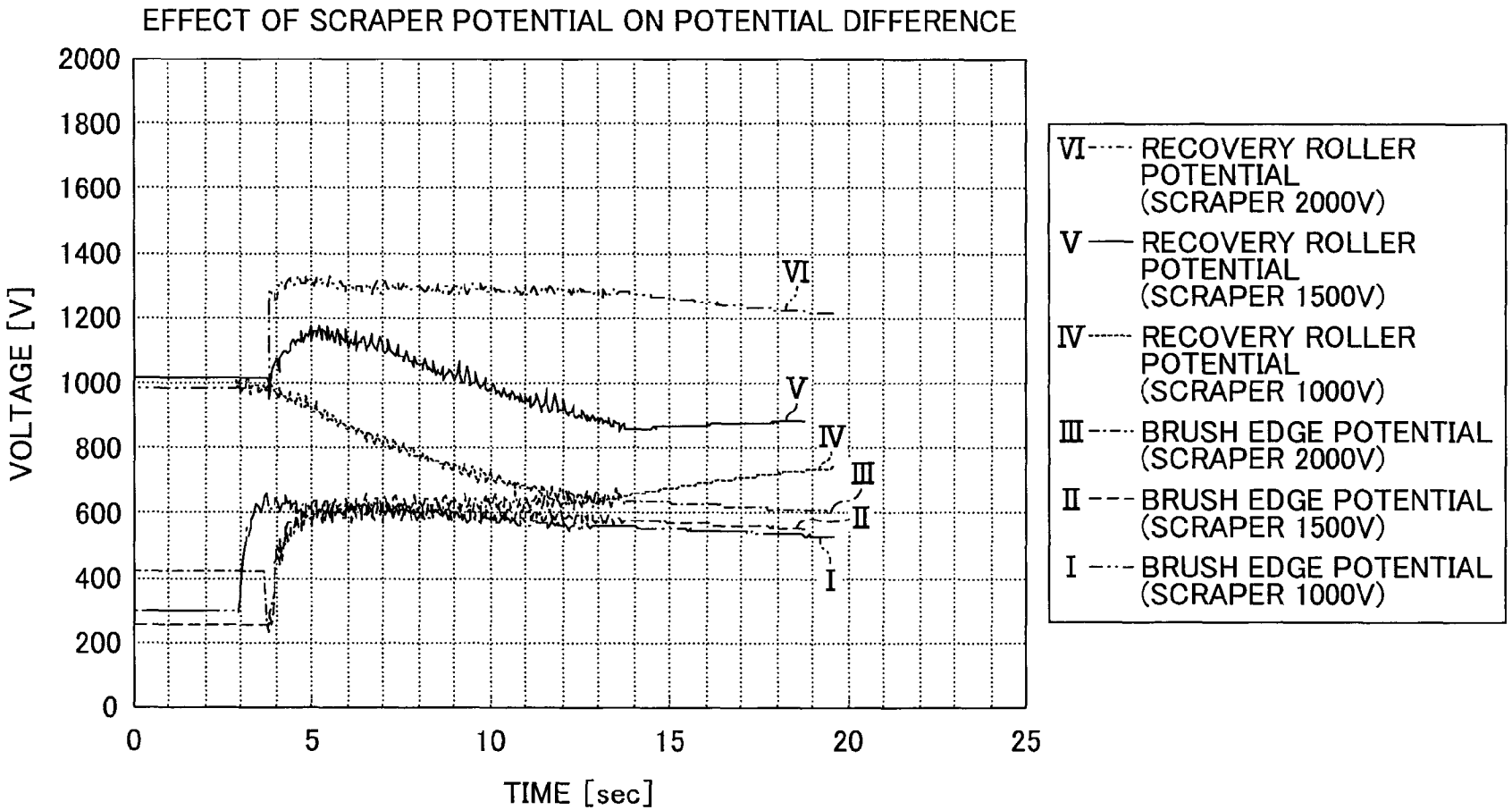
FIG. 34 shows graphs of measurement results of an edge potential of a cleaning brush and a surface potential of a high-resistance recovery roller when toner particles are cleaned while changing voltage applied to a scraper.

A description is given to an effect of the conductive scraper 118*c*, which applies voltages to a surface of a recovery roller with reference to FIG. 34.

FIG. 34 shows a trend of potential of a cleaning brush edge and a high-resistance recovery roller, in which a cleaning brush edge potential of a cleaning brush and a surface potential of a high-resistance recovery roller were measured with a surface potential meter by changing voltages applied to the conductive scraper 118*c* (used as surface charge application member) to +1000V, +1500V, and +2000V while inputting toner particles. Further, the electric charge application member 124*a* made of a copper sheet was applied with +700V, and a metal core of a cleaning brush was applied with +700V, and a roller shaft of the high-resistance recovery roller was applied with +1000V.

Based on results shown in FIG. 34, it is confirmed that a decrease of surface potential of a recovery roller (i.e., high-resistance recovery roller) can be further suppressed by increasing a voltage value applied to the conductive scraper 118*c* used for applying electric charges to a recovery roller.

The conductive scraper 118*c* having a volume resistance of $10^8$ Ω·cm was used in this experiment. The conductive scraper 118*c* may preferably be made of a material having a lower resistance, which may not cause a degradation of a cleaning performance of toner particles by a high-resistance recovery roller, wherein such material may enhance electric charge application effect. The conductive scraper 118*c* may preferably be made of a material having a not-too high resistance value because a higher resistance material may cause a drawback under a lower temperature/lower humidity environment compared to a higher temperature/higher humidity environment.

The above-mentioned voltage values applied to a metal core of a cleaning brush, the electric charge application member 124*a*, a roller shaft of recovery roller, and the conductive scraper 118*c* can be changed any values based on factors such as toner particle characteristics, surface potential of a photoconductor after cleaned by a conductive blade, surface potential of a photoconductor after charging, brush resistance, or the like.

A description is now given to a cleaning operation of the photoconductor 1 with reference to FIG. 24.

As illustrated in FIG. 24, toner particles charged to normal polarity by the conductive blade 11, applied with a negative voltage polarity, pass through the gate seal 26, and come to a position facing the cleaning brush 111 with a rotation of the photoconductor 1.

The cleaning brush 111 has a metal core applied with a voltage (having positive polarity), opposite to a normal polarity for toner particles, by the third power source circuit 123. Such cleaning brush 111 electrostatically attracts toner particles having controlled to normal polarity by the conductive blade 11.

Further, toner particles not charged to normal polarity by the conductive blade 11 also pass through the gate seal 26, and come to a position facing the cleaning brush 111 with a rotation of the photoconductor 1 accompanied with toner particles charged to normal polarity. Such toner particles not charged to normal polarity, which is small in amount, may be electrostatically attracted to brush fibers of the cleaning brush 111, electrified by friction with the photoconductor 1.

During a normal toner recovery operation, a metal core of the cleaning brush 111 is applied with +500V, the electric charge application member 124*a* is applied with +500V, a roller shaft of the high-resistance recovery roller 117*a* is applied with +800V, and the conductive scraper 118*c* is applied with +1000 V, for example. With such configuration, toner particles having negative polarity (i.e., toner particles having correctly controlled polarity) adhering the cleaning brush 111 may be attracted to the high-resistance recovery roller 117*a* with an effect of potential difference between the cleaning brush edge of the cleaning brush 111 and the surface of the high-resistance recovery roller 117*a*. Then, toner particles adhered on the high-resistance recovery roller 117*a* are scraped by the conductive scraper 118*c*, and then ejected to an outside of the image forming apparatus 100*a* by the toner ejection screw 27 or returned to the developing unit 4.

Further, another toner recovery operation may be conducted for toner particles, having positive polarity not controlled to a voltage polarity applied to the conductive blade 11, at a given timing such as when one image forming operation has completed or when a sheet is not fed. When conducting such another toner recovery operation, the switch 122*c*, connected to the primary power source 122*a* (applying a voltage having positive polarity), is switched to the secondary power source 122*b* so that the secondary power source 122*b* can apply a voltage having negative polarity to the high-resistance recovery roller 117. Further, the switch 125*c* of the fifth power source circuit 125 switches over a power source for applying a power to the conductive scraper 118*c* from the primary power source 125*a* (applying a voltage having positive polarity) to the secondary power source 125*b*, which can apply a voltage having negative polarity to the conductive scraper 118*c*. With such configuration, when conducting another toner recovery operation for toner particles not controlled to normal polarity (i.e., toner particles in positive polarity), the metal core of cleaning brush 111 is applied with +500V, the electric charge application member 124*a* is applied with +500V, the shaft of the high-resistance recovery roller 117 is applied with −100V, and the conductive scraper 118*c* is applied with −500V, for example.

Then, toner particles having positive polarity (i.e., not-correctly polarity controlled toner particles) adhering on the cleaning brush 111 may be electrostatically attracted to the high-resistance recovery roller 117*a* with an effect of a potential difference generated between the cleaning brush edge and the high-resistance recovery roller 117*a*. With such process, toner particles having positive polarity (i.e., polarity is not correctly controlled) can be also removed from the cleaning brush 111. Then, toner particles having positive polarity and electrostatically adhering the high-resistance recovery roller 117*a* are scraped by the conductive scraper 118*c* with a rotation of the high-resistance recovery roller 117*a*, and may drop off to the toner ejection screw 27. The toner ejection screw 27 transports such toner particles to a waste toner tank (not shown) provided outside of the cleaning unit 7.

In such configuration shown in FIG. 24, variation of potential difference between the cleaning brush edge of the cleaning brush ill and the high-resistance recovery roller 117*a* may be suppressed by providing the brush charge applicator 124 and the surface charge applicator 126. Therefore, toner particles having negative polarity (i.e., toner particles having correctly controlled polarity) and toner particles having positive polarity (i.e., toner particles having not correctly controlled polarity) adhering on the cleaning brush 111 can be reliably recovered by the cleaning unit 7.

Further, such configuration shown in FIG. 24 is provided with a voltage control unit having a microcomputer (not shown), wherein the microcomputer includes a central processing unit (CPU), a read only memory (ROM), a random access memory (RAM), and an input/output circuit, for example. The CPU determines a timing when to conduct a cleaning operation of toner particles having different polarities (e.g., when to conduct a cleaning operation for toner particles having a polarity not controlled to normal polarity when passed through the conductive blade 11), wherein such timing may be after completing one printing job, or when a sheet is not fed. Further, the CPU instructs processing related to the cleaning operation of toner particles to relevant devices. The ROM stores programs and fixed data for conducting the cleaning operation of toner particles. The RAM includes a working memory for storing input data and processed data for conducting the cleaning operation of toner particles.

Such voltage control unit is used to control a voltage and a polarity to be applied to be the high resistance recovery roller 117*a*. Specifically, the microcomputer instructs a switching timing of the switches 122*c* and 125*c* so that a given voltage having a given polarity can be applied to the high resistance recovery roller 117*a* at a given timing, set for a cleaning operation of toner particles having different polarities.

Figure 35:
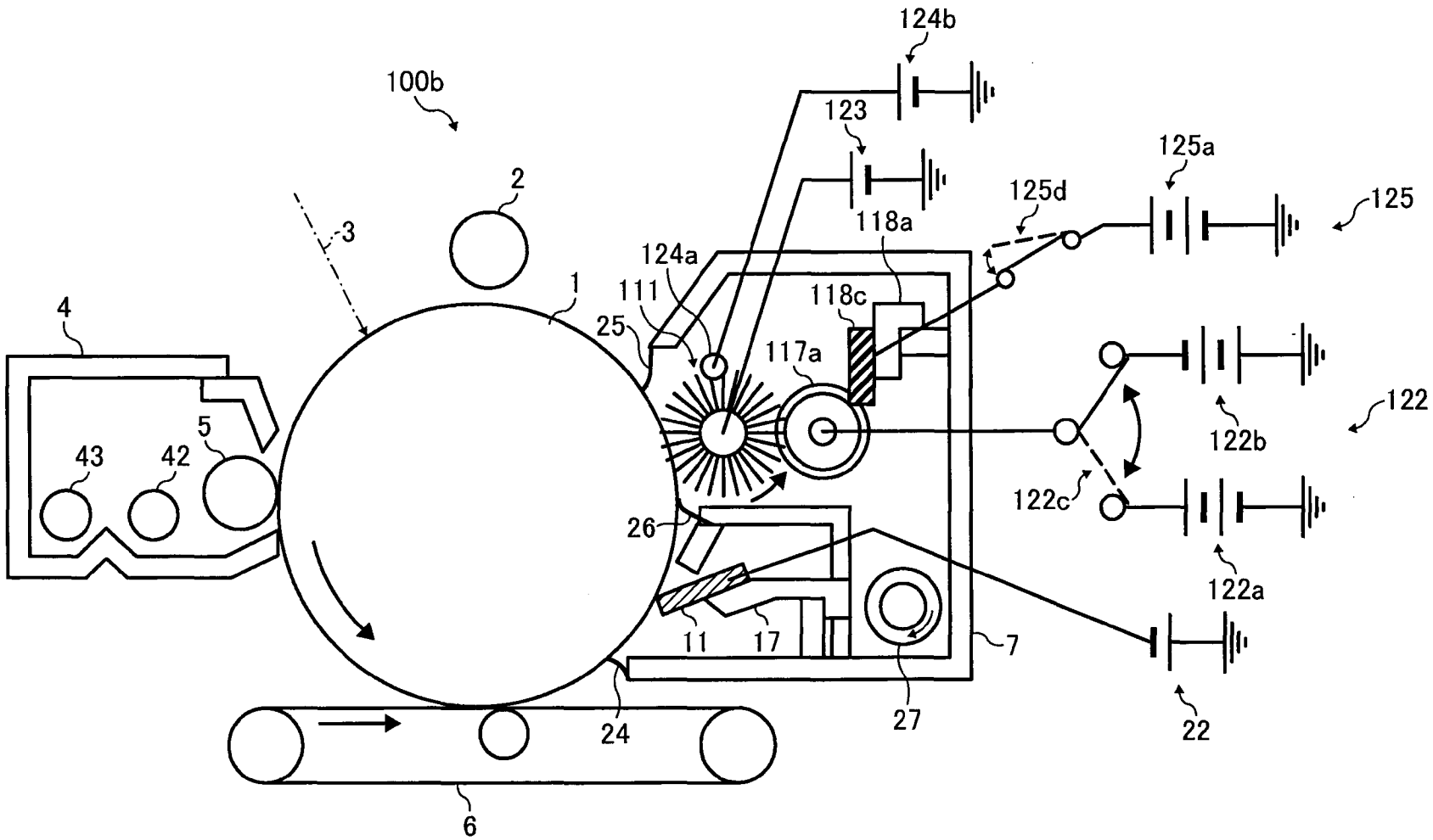
FIGS. 35 and 36 illustrate schematic configurations for image forming apparatuses having another cleaning units according to another exemplary embodiment.

A description is now given to another configuration of another exemplary embodiment with reference to FIG. 35, which illustrates a schematic configuration of an image forming apparatus 100*b*. In the image forming apparatus 100*b*, when conducting another toner recovery operation for toner particles having positive polarity (i.e., toner particles having not correctly controlled polarity) in the image forming apparatus 100*b*, a voltage is not applied to the conductive scraper 118*c*, wherein the conductive scraper 118*c* is used to apply a voltage to a surface of the high-resistance recovery roller 117*a*. Accordingly, the cleaning unit 7 has a similar configuration shown in FIG. 24 except the fifth power source circuit 125 includes only the primary power source 125*a* and a switch 125*d*.

As similar to a cleaning operation described with a configuration shown in FIG. 24, a metal core of the cleaning brush 111 is applied with +500V, the electric charge application member 124*a* is applied with +500V, a roller shaft of the high-resistance recovery roller 117*a* is applied with +800V, and the conductive scraper 118*c* is applied with +1000V, for example, when conducting a normal toner recovery operation for recovering toner particles having negative polarity (i.e., toner particles having correctly controlled polarity) adhering the cleaning brush 111.

With such configuration, toner particles having negative polarity (i.e., toner particles having correctly controlled polarity) adhering the cleaning brush 111 may be attracted to the high-resistance recovery roller 117*a* with an effect of potential difference between the cleaning brush edge of the cleaning brush 111 and the surface of the high-resistance recovery roller 117*a*. Then, toner particles adhered on the high-resistance recovery roller 117*a* are scraped by the conductive scraper 118*c*, and then ejected to an outside of the image forming apparatus 100*a* by the toner ejection screw 27 or returned to the developing unit 4.

Further, another toner recovery operation for toner particles having positive polarity, which are not controlled to a voltage polarity applied to the conductive blade 11, may be conducted.

When conducting such another toner recovery operation, the switch 122*c*, connected to the primary power source 122*a*, is switched to the secondary power source 122*b* so that the secondary power source 122*b* can apply a voltage having negative polarity to the high-resistance recovery roller 117*a*. Further, the switch 125*d* of the fifth power source circuit 125 is set to OFF so that the conductive scraper 118*c* is not be applied with a voltage from the primary power source 125*a*.

When conducting another toner recovery operation for toner particles not controlled to correct polarity under such configuration, a metal core of the cleaning brush 111 is applied with +500V, the electric charge application member 124*a* is applied with +500V, a roller shaft of the high-resistance recovery roller 117*a* is applied with −500V, and the conductive scraper 118*c* is applied with 0V, for example.

By applying −500V to the shaft of the high-resistance recovery roller 117*a*, toner particles having positive polarity (i.e., toner particles having not correctly controlled polarity) adhering on the cleaning brush 111 may be electrostatically attracted to the high-resistance recovery roller 117*a* with an effect of a potential difference generated between the cleaning brush edge of the cleaning brush 111 and the high-resistance recovery roller 117*a*. With such process, toner particles having positive polarity (i.e., toner particles having not correctly controlled polarity) can be also removed from the cleaning brush 111.

In such configuration shown in FIG. 35, the conductive scraper 118*c* is not applied with negative voltage when conducting another toner recovery operation for toner particles having positive polarity (i.e., toner particles having not correctly controlled to negative polarity), by which the image forming apparatus 100*b* shown in FIG. 35 can be manufactured with a reduced cost corresponding to a power source cost compared to the image forming apparatus 100*a* shown in FIG. 24.

However, such another toner recovery operation can be conducted within a given time period that a surface potential of the high-resistance recovery roller 117*a* does not decrease even without a voltage application to the surface of the high-resistance recovery roller 117*a*.

Specifically, as shown in FIG. 29B, because a potential difference between the cleaning brush edge and the surface of the high-resistance recovery roller 117*a* can be maintained at a given time period such as within two seconds without applying a voltage to the conductive scraper 118*c*, if such another toner recovery operation can be conducted within such given time period (e.g., two-second period), the configuration shown in FIG. 35 may be effectively employed for the another toner recovery operation. Such two-second period is just an example time period, which may be changed by factors such as brush fiber resistance, resistance of high-resistance recovery roller 117*a*, toner particle resistance, photoconductor resistance, thickness of surface layer for such members, rotation speed of for such members, or the like. Accordingly, a time period that can maintain a potential difference between the cleaning brush edge and the surface of the high-resistance recovery roller 117*a* at a given value may vary depending on the above-mentioned factors. Therefore, such time period for another toner recovery operation may preferably be determined by experiment.

Further, as similar to a configuration shown in FIG. 24, a configuration shown in FIG. 35 is provided with a voltage control unit having a microcomputer (not shown), wherein such voltage control unit is similarly used to control a voltage and a polarity to be applied to be the high resistance recovery roller 117*a*. Specifically, the microcomputer instructs a switching timing of the switch 125*d* so that a given voltage having a given polarity can be applied to the high resistance recovery roller 117*a* at a given timing, set for a cleaning operation of toner particles having different polarities.

Figure 36:
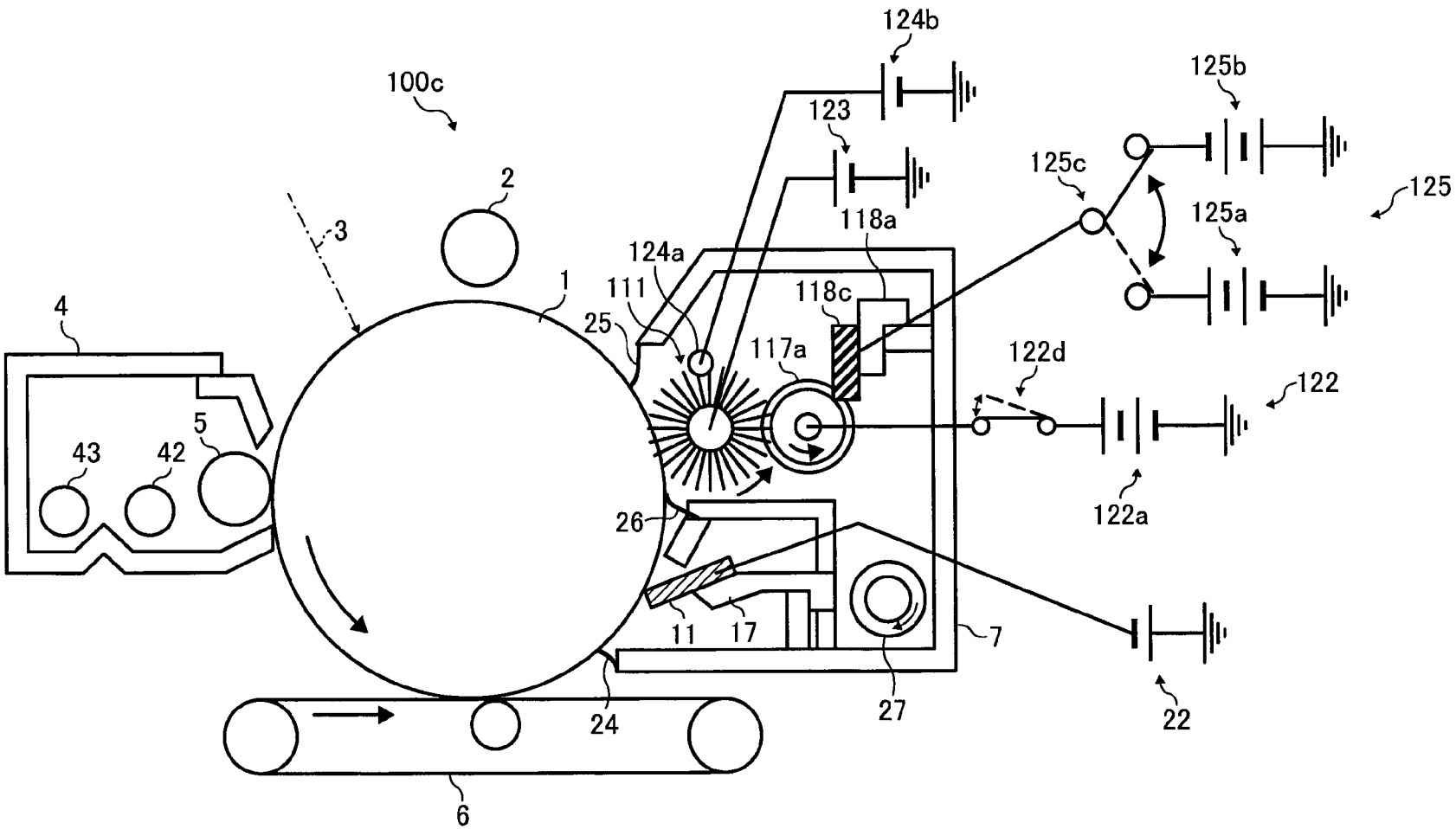

Further, as illustrated as another configuration of FIG. 36, the high-resistance recovery roller 117*a* may not be applied with a voltage when conducting another toner recovery operation is conducted. In such configuration, the second power source circuit 122 includes only the primary power source 122*a* and a switch 122*d* to apply a voltage to a shaft of the high-resistance recovery roller 117*a* as illustrated in FIG. 36.

When conducting a normal toner recovery operation for recovering toner particles having negative polarity (i.e., toner particles having correctly controlled polarity) adhering the cleaning brush 111, a metal core of cleaning brush 111 is applied with +500V, the electric charge application member 124*a* is applied with +500V, a roller shaft of the high-resistance recovery roller 117*a* is applied with +800V, and the conductive scraper 118*c* is applied with +1000V, for example.

Further, another toner recovery operation may be conducted for toner particles having positive polarity, which are not controlled to a voltage polarity applied to the conductive blade 11.

When conducting such another toner recovery operation, the switch 122*d* of the second power source circuit 122 is set to OFF so that the high-resistance recovery roller 117*a* is not be applied with a voltage from the primary power source 122*a*. Further, the switch 125*c* of the fifth power source circuit 125 is switched over from the primary power source 125*a* to the secondary power source 125*b* so that secondary power source 125*b* applies a given voltage to the conductive scraper 118*c*.

With such configuration, when conducting another toner recovery operation for toner particles having not correctly controlled polarity, a metal core of cleaning brush 111 is applied with +500V, the electric charge application member 124*a* is applied with +500V, a roller shaft of the high-resistance recovery roller 117 is applied with 0V, and the conductive scraper 118*c* is applied with −500V, for example.

By applying −500 V to the conductive scraper 118*c*, toner particles having positive polarity (i.e., toner particles having not correctly controlled polarity) adhering on the cleaning brush 111 may be electrostatically attracted to the high-resistance recovery roller 117*a* with an effect of a potential difference generated between the cleaning brush edge of the cleaning brush 111 and the high-resistance recovery roller 117*a*. With such process, toner particles having positive polarity (i.e., toner particles having not correctly controlled polarity) can be also removed from the cleaning brush 111.

The image forming apparatus 100*c* having a configuration shown in FIG. 36 can be manufactured with a reduced cost corresponding to a power source cost compared to the image forming apparatus 10*a* shown in FIG. 24.

As similar to the image forming apparatus 100*b* of FIG. 35, such another toner recovery operation can be conducted for the image forming apparatus 100*c* of FIG. 36 within a given time period that a surface potential of the high-resistance recovery roller 117*a* does not decrease.

Further, as similar to a configuration shown in FIG. 35, a configuration shown in FIG. 36 is provided with a voltage control unit having a microcomputer (not shown), wherein such voltage control unit is similarly used to control a voltage and a polarity to be applied to be the high resistance recovery roller 117*a*. Specifically, the microcomputer instructs a switching timing of the switch 122*d* so that a given voltage having a given polarity can be applied to the high resistance recovery roller 117*a* at a given timing, set for a cleaning operation of toner particles having different polarities.

Figure 37:
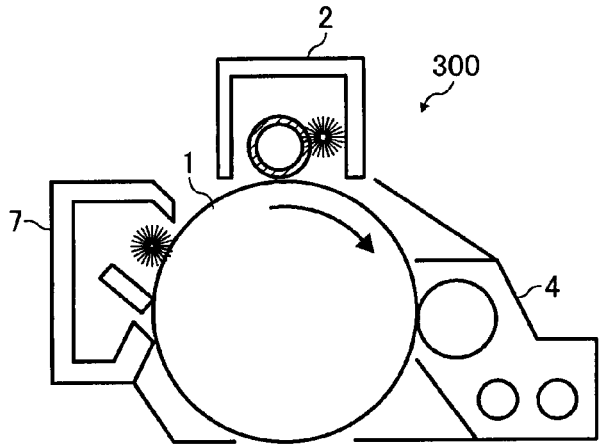
FIG. 37 illustrates a schematic configuration of a process cartridge having a cleaning unit according to exemplary embodiments.

Further, as illustrated in FIG. 37, the photoconductor 1 and the cleaning unit 7 can be integrated as a process cartridge 300, which is detachably mountable in an image forming apparatus. Although the process cartridge 300 of FIG. 37 integrates the photoconductor 1, the cleaning unit 7, the charging unit 2, and the developing unit 4, such process cartridge 300 may at least include the photoconductor 1 and the cleaning unit 7.

Figure 38:
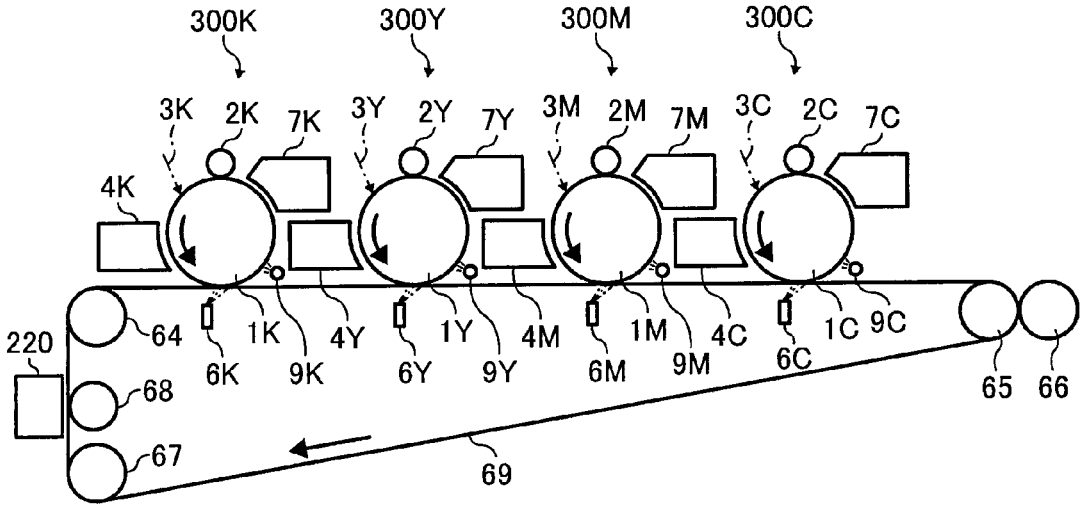
FIG. 38 illustrates a schematic configuration of an image forming apparatus of tandem type.
Figure 39:
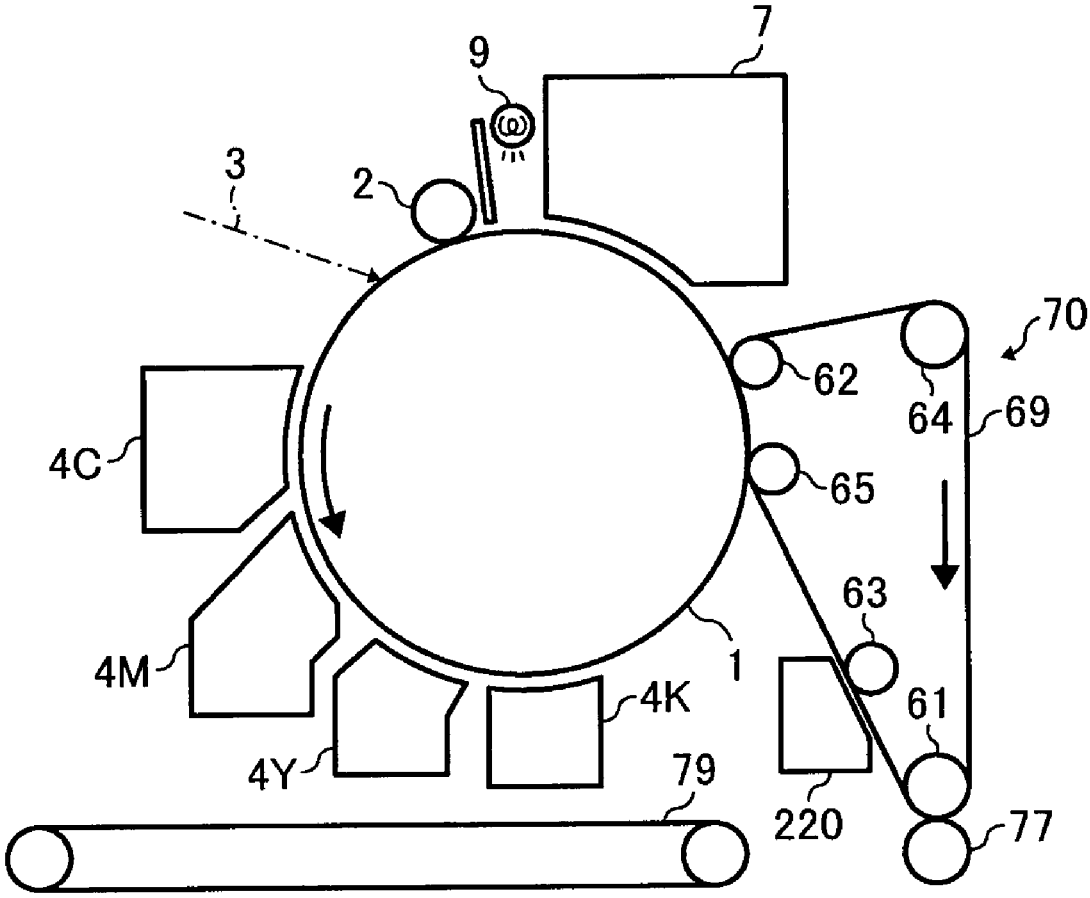
FIG. 39 illustrates a schematic configuration of an image forming apparatus using one photosensitive drum.
Figure 40:
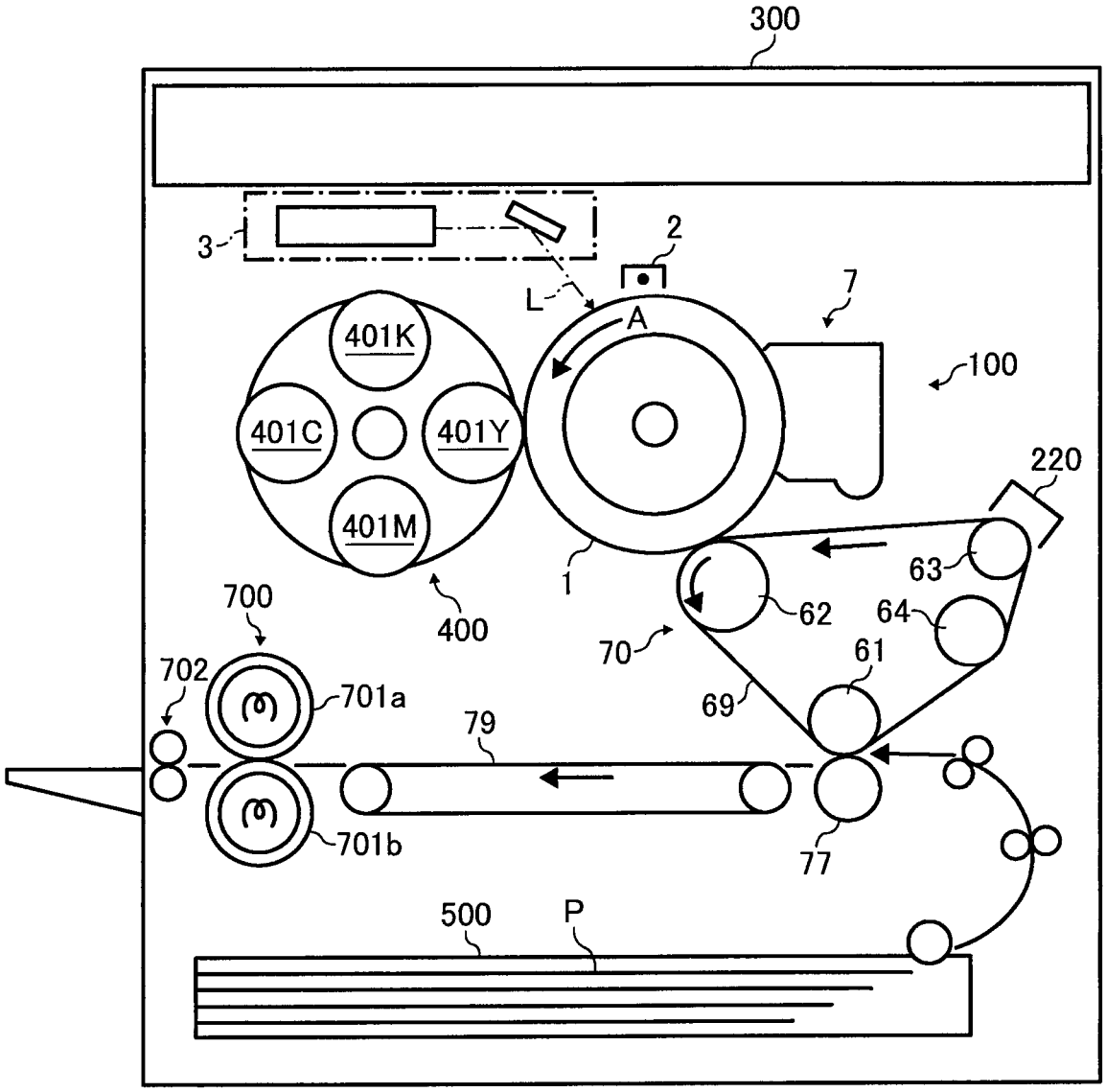
FIG. 40 illustrates a schematic configuration of an image forming apparatus using a revolver developing unit.

A description is now given to an image forming apparatus employing the cleaning unit 7 according to exemplary embodiments with reference to FIGS. 38, 39, and 40.

FIG. 38 is a schematic view of an image forming section of tandem type having the cleaning unit 7 in an image forming apparatus. As illustrated in FIG. 38, an intermediate transfer belt 69, extended by a plurality of rollers 64, 65, and 67, may be aligned in a horizontal direction when an image forming apparatus is installed on a horizontal floor. The intermediate transfer belt 69 travels in a direction shown by an arrow in FIG. 38. Further, process cartridges 300Y, 300M, 300C, and 300K for forming images of yellow, magenta, cyan, and black are arranged along a horizontally extended face of the intermediate transfer belt 69. The arrangement order of process cartridges 300 are not limited "yellow, magenta, cyan, black," but other arrangement order can be used. Hereinafter, suffix of Y, M, C, and K may be used to indicate colors of "yellow, magenta, cyan, and black," respectively.

Generally, an image forming apparatus for forming color image may have a plurality of image forming units, by which an apparatus size becomes larger. Further, such image forming unit may combine several sub-units such as a cleaning unit, a charge unit in a complex manner, and thereby a replacement of each sub-units from an image forming apparatus may become a time-consuming work. Such replacement may be conducted when each sub-units is malfunctioned or becomes its lifetime. In viewing of such inconvenience, a photoconductor, a charge unit, a developing unit, and a cleaning unit may be integrated as a process cartridge, which is easily detachable and mountable with respect to an image forming apparatus by an user, and such process cartridge may enhance compact in size of image forming apparatus and durability of an image forming apparatus, for example.

Further, an image forming apparatus includes a sheet cassette (not shown), which stores a plurality of recording member such as recording sheet. A recording sheet is fed to a pair of registration rollers (not shown) from the sheet cassette one by one with a feed roller (not shown) at adjusted timing, and then transported to a secondary transfer area formed between the intermediate transfer belt 69 and a secondary transfer roller 66.

In an image forming apparatus of FIG. 38, an image forming may be conducted as follows. First, the photoconductor 1 is rotated in a counter-clockwise direction, and the intermediate transfer belt 69 is rotated in a clockwise direction, for example. Then, the charge unit 2 uniformly charges a surface of the photoconductor 1. A laser beam 3 is irradiated on a charged surface of the photoconductor 1 to form an electrostatic latent image on the photoconductor 1, in which the laser beam 3 is generated based on image data input to the image forming apparatus. With such process, an electrostatic latent image is formed on each of the photoconductors 1Y, 1M, 1C, and 1K. Then, the developing unit 4 develops the electrostatic latent image as toner image by adhering toner particles having each color. Accordingly, four color toner images of Y, M, C, and K are formed on each of the photoconductors 1Y, 1M, 1C, and 1K. Such four color toner images are primary transferred to the intermediate transfer belt 69 by superimposing each toner image, and then the superimposed toner image is transferred to a recording sheet transported to the secondary transfer area with an effect of the secondary transfer roller 66. The recording sheet having toner image is transported to a fixing unit (not shown), in which the fixing unit applies heat and pressure to the recording sheet to fix the toner image on the recording sheet. After fixing the toner image, the recording sheet is ejected to an ejection tray (not shown).

After transferring toner images to the intermediate transfer belt 69, the cleaning unit 7 removes toner particles remaining on a surface of the photoconductor 1. Further, after transferring toner images to the recording sheet, a belt-cleaning unit 220 removes toner particles remaining on a surface of the intermediate transfer belt 69. The belt-cleaning unit 220 can be configured as similar to the cleaning unit 7 according to exemplary embodiments.

By employing the cleaning unit 7 according to exemplary embodiments for cleaning the photoconductor 1 of an image forming apparatus shown in FIG. 38, toner particles remaining on a surface of the photoconductor 1 can be preferably removed even if remaining toner particles are a mixture of toner particles having positive and negative polarity. Further, by employing the belt-cleaning unit 220 for cleaning the intermediate transfer belt 69, toner particles remaining on a surface of the intermediate transfer belt 69 can be preferably removed even if remaining toner particles are a mixture of toner particles having positive and negative polarity.

FIG. 39 is a schematic configuration of another image forming apparatus for forming color image having the cleaning unit 7 according to exemplary embodiments, in which one photosensitive drum is used as the photoconductor 1.

As illustrated in FIG. 39, the photoconductor 1 is surrounded with the charge unit 2, the developing units 4C, 4M, 4Y, and 4K for C, M, Y, and K color, an intermediate transfer unit 70, and the cleaning unit 7, for example. Further, an image forming apparatus includes a sheet cassette (not shown), which stores a plurality of recording member such as recording sheet. A recording sheet is fed to a pair of registration rollers (not shown) from the sheet cassette one by one with a feed roller (not shown) at adjusted timing, and then transported to a secondary transfer area formed between the intermediate transfer belt 69 and a secondary transfer roller 77.

Each of the developing units 4C, 4M, 4Y, and 4K includes a developing sleeve (not shown) and a developing agent paddle (not shown), for example. The developing sleeve, which rotates in a given direction, is used to form spikes of developing agent for developing an electrostatic latent image, and the developing agent paddle is rotated to agitate the developing agent and to carry up the developing agent to the developing sleeve. In the developing unit 4, toner particles, agitated with carrier particles (e.g., ferrite particles), may be charged to negative polarity having a given value such as −10 μC/g to −25 μC/g, for example.

Further, the developing sleeve is applied with a developing bias voltage with a developing bias voltage applicator (not shown) having a power source. Such developing bias voltage may be direct current voltage only, or a superimposed bias voltage having direct current voltage Vdc of negative polarity and superimposed alternate current voltage Vac. Such developing sleeve is biased to a given potential with respect to a metal base layer of the photoconductor 1.

As illustrated in FIG. 39, the intermediate transfer unit 70 includes the intermediate transfer belt 69 and the belt-cleaning unit 220, for example. The intermediate transfer belt 69, extended by a drive roller 61, a bias roller 62, a counter roller 63, and driven rollers 64 and 65, is driven by a drive motor (not shown).

The intermediate transfer belt 69 may be made of fluorine resin ETFE (ethylene tetrafluoroethylene) having dispersed carbon therein, and have an given electric resistance such as volume resistivity of $10^{10}$ Ω·cm and surface resistivity of $10^{9}$ Ω/sq., for example. The secondary transfer roller 77 may be made of a hydrin rubber roller and PFE (polyfluoroethylene) tube coated on the roller, and have a given volume resistivity such as $10^{9}$ Ω·cm, for example. Further, the secondary transfer roller 77 is applied with a secondary transfer bias with a secondary bias application unit (not shown) having a power source. Such secondary transfer bias may be direct current voltage only, or a superimposed bias voltage having direct current voltage and superimposed alternate current voltage.

In the image forming apparatus of FIG. 39, an image forming process is conducted as follows. First, a scanner (not shown) scans document image placed on a contact glass, and converts document image to electric image signals. Specifically, a document image scanned by an irradiation lamp, mirrors, and a lens is focused on a color sensor to decompose color image information of document into red, green, and blue (hereinafter, R, G, B) information, and converted to electric image signals. The color sensor may be configured with a photoelectric transducer such as CCD (charge coupled device) and a decomposer of RGB color, for example, and read decomposed three color images simultaneously. Based on image signal intensity for RGB color obtained by the scanner, an image processing unit (not shown) processes image signals to generate color image data of cyan(C), magenta(M), yellow(Y), and black(K).

The scanner may be operated as below for obtaining color image data of K, C, M, and Y. First, a scanning start signal is input to the scanner at a given timing synchronized when an image forming operation is started in an image forming apparatus. Then, an optical unit having the irradiation lamp and mirrors scans a document in a given direction to obtain one color image data for one scanning. By repeating such scanning movement for four times, four color image data is sequentially obtained.

The photoconductor 1 is rotated in a counter-clockwise direction, and the intermediate transfer belt 69 is rotated in a clockwise direction. After charging a surface of the photoconductor 1 uniformly by the charge unit 2 at a given potential (e.g., −500V to −700V), a laser beam 3 for image data C (cyan) is irradiated on the surface of the photoconductor 1 to form a latent image for C at a given potential (e.g., −80V to −130V) on the photoconductor 1. Then, the developing unit 4C develops the latent image for C as C toner image with toner particles, wherein such toner image has a given toner concentration such as 2 to 6 wt %, for example. The developed C toner image is primary transferred to the intermediate transfer belt 69. After transferring the C toner image, the cleaning unit 7 removes toner remaining on the photoconductor 1. Then, the charge unit 2 uniformly charges the photoconductor 1 again.

For this time, a laser beam 3 for image data M (magenta) is irradiated on the surface of the photoconductor 1 to form a latent image for M on the photoconductor 1. Then, the developing unit 4M develops the latent image for M as M toner image with toner particles. The developed M toner image is primary transferred to the intermediate transfer belt 69 while superimposed with the C toner image transferred on the intermediate transfer belt 69. Such image forming process is similarly conducted to primary transfer Y and K toner images to the intermediate transfer belt 69. The order of forming toner images on the photoconductor 1 can be changed in any order. Further, such primary transfer process may be conducted by setting a bias voltage of first color as 1200V, second color as 1300V, third color as 1400V, and fourth color as 1500V, for example.

Such superimposed toner images on the intermediate transfer belt 69 are then transferred to a recording sheet at a secondary transfer area with an effect of the secondary transfer roller 77. The secondary transfer bias voltage may be set to 1300V, for example. The recording sheet having the toner images is then transported to a fixing unit (not shown) by a sheet transport belt 79. The fixing unit applies heat and pressure to the recording sheet to fix the toner image on the recording sheet. After fixing toner image, the recording sheet is ejected on an ejection tray (not shown).

After transferring toner image to the recording sheet, the cleaning unit 7 removes toners remaining on a surface of the photoconductor 1. Further, the belt-cleaning unit 220 removes toner remaining on the intermediate transfer belt 69, wherein the belt-cleaning unit 220 can be configured as similar to the cleaning unit 7 according to exemplary embodiments.

By employing the cleaning unit 7 according to exemplary embodiments for cleaning the photoconductor 1 of an image forming apparatus having one photosensitive drum as shown in FIG. 39, toner particles remaining on a surface of the photoconductor 1 can be preferably removed even if remaining toner particles are a mixture of toner particles having positive and negative polarity. Further, by employing the belt-cleaning unit 220, configured as similar to the cleaning unit 7, for cleaning the intermediate transfer belt 69, toner particles remaining on a surface of the intermediate transfer belt 69 can be preferably removed even if remaining toner particles are a mixture of toner particles having positive and negative polarity.

FIG. 40 is a schematic configuration of another image forming apparatus for forming color image having the cleaning unit 7 according to exemplary embodiments, in which a revolver-type developing unit revolver is used. As illustrated in FIG. 40, the image forming apparatus includes image forming devices, a scanner 300, a sheet feed unit 500, and a controller (not shown), for example.

The scanner 300 scans document image placed on a contact glass, and converts document image to electric image signals. Specifically, scanned document information is decomposed to color image information of red, green, and blue (hereinafter, R, G, B) information, and converted to electric image signals. Based on image signal intensity for RGB color obtained by the scanner 300, an image processing unit (not shown) processes image signals to generate color image data of cyan(C), magenta(M), yellow(Y), and black(K).

The image forming apparatus shown in FIG. 40 includes the photoconductor 1, the charge unit 2, an optical writing unit 3, a revolver-type developing unit 400, the cleaning unit 7, the intermediate transfer unit 70, a secondary transfer unit 77, and a fixing unit 700 having fixing rollers 701*a* and 701*b*, for example.

The photoconductor 1 may rotate in a counter-clockwise direction as shown by an arrow A. The photoconductor 1 having a drum shape is surrounded by the charge unit 2, the revolver-type developing unit 400, the cleaning unit 7, and the intermediate transfer unit 70 having the intermediate transfer belt 69, for example.

The revolver-type developing unit 400 is configured with developing devices 401K, 401C, 401M, and 401Y, and a revolver driver (not shown), for example. The developing device 401K uses K toner particles, the developing device 401C uses C toner particles, the developing device 401M uses M toner particles, and the developing device 401Y uses Y toner particles. The revolver driver rotates the revolver-type developing unit 400 in a counterclockwise rotation, for example.

When forming an image in such configuration, a latent image is formed on the photoconductor 1, and then the latent image is developed with a first color toner using one of the developing devices 401, which is moved to a position facing the photoconductor 1. When a rear end of the first color toner image has passed through a developing position, the revolver-type developing unit 400 rotates to face other developing device 401 to the latent image to develop the latent image with a second color toner.

As illustrated in FIG. 40, the intermediate transfer unit 70 includes the intermediate transfer belt 69 extended by a primary transfer bias roller 62, a belt drive roller 61, a belt tension roller 64. Each of the rollers are made of conductive material, and earthed except the primary transfer bias roller 62.

The primary transfer bias roller 62 is applied with a primary transfer bias from a primary transfer power source (not shown) controlled by constant current or constant voltage. Such primary transfer bias may be set to a given current or voltage value depending on a number of superimposed toner images.

The intermediate transfer belt 69 is driven in an arrow direction by the belt drive roller 61 driven by a drive motor (not shown). The intermediate transfer belt 69 is surrounded by a secondary transfer bias roller 77, the belt-cleaning unit 220 for cleaning the intermediate transfer belt 69, and a pre-transfer charger (not shown) for uniformly charging toner image before transferring to a recording sheet.

A toner image is transferred from the photoconductor 1 to the intermediate transfer belt 69 at a primary transfer section, in which the primary transfer bias roller 62 presses the intermediate transfer belt 69 to the photoconductor 1 to form a transfer nip having a given width between the photoconductor 1 and the intermediate transfer belt 69. The primary transfer bias roller 62 applies a primary transfer electric charge to toner images.

In the image forming apparatus of FIG. 40, an image forming process is conducted as follows. First, the photoconductor 1 is rotated in a counter clockwise direction shown by an arrow A with a drive motor (not shown). The charge unit 2 uniformly charges the photoconductor 1 at a given potential with negative electric charge, discharged by corona charging. The optical writing unit 3 irradiates a laser beam to the photoconductor 1 to write a latent image on the photoconductor 1 based on color image signals input to the optical writing unit 3. Then, the latent image is developed by a first color toner, a second color, and so on by the revolver-type developing unit 400.

The intermediate transfer belt 69 is rotated in a counter-clockwise direction as shown by an arrow with a drive roller. With a rotation of the intermediate transfer belt 69, K, C, M, and Y toner images are superimposingly formed on the intermediate transfer belt 69.

The intermediate transfer belt 69 may be configured with a single layer or a multiple layer having a surface layer, an intermediate layer, and a base layer. The image forming apparatus of FIG. 40 may have the intermediate transfer belt 69 of multiple layer structure having a thickness of 0.15 mm, a width of 368 mm, an inner circumference length of 565 mm, which may move at a speed of 250 mm/sec, for example. The surface layer of the intermediate transfer belt 69 may be an insulating layer having a thickness of 1 μm or so, the intermediate layer may be an insulating layer (volume resistivity of about $10^{13}$ Ω·cm) made of PVDF (polyvinylidene fluoride) having a thickness of 75 μm, and the base layer may be made of middle-level resistive layer (volume resistivity of $10^{8}$ Ω·cm to $10^{11}$ Ω·cm) made of PVDF and titanium oxide having a thickness of 75 μm, for example.

The intermediate transfer belt 69 formed of such materials has a volume resistivity of $10^{7}$ Ω·cm to $10^{14}$ Ω·cm as a whole, for example. The volume resistivity was measured with a known measurement method such as JISK 6911, in which a voltage of 100V is applied for 10 seconds for measurement. Further, surface resistivity of the surface layer of the intermediate transfer belt 69 was measured with a resistance measurement apparatus ("Highrester IP" produced by Yuka Denshi Company Limited) as $10^{7}$ Ω·cm to $10^{14}$ Ω·cm. The surface resistivity can be measured with a known surface resistance measurement method such as JISK 6911 instead of using such resistance measurement apparatus. JIS is the Japan Industrial Standard.

The intermediate transfer belt 69 is sequentially transferred with K, C, M, and Y toner images from the photoconductor 1 to a same face of the intermediate transfer belt 69 while aligning image positions correctly, by which a toner image (or superimposed toner image) is formed on the intermediate transfer belt 69 with four color toner images, for example. The superimposed toner image on the intermediate transfer belt 69 is then uniformly charged by the pre-transfer charger (not shown).

By adjusting a toner image forming operation on the intermediate transfer belt 69 and a feed timing of a transfer sheet to a secondary transfer nip, set between the intermediate transfer belt 69 and the secondary transfer bias roller 77, by a registration roller 501, the superimposed toner image is transferred to the transfer sheet with an effect of the secondary transfer bias roller 77 applied with a secondary transfer bias. The transfer sheet is then de-charged by a decharging unit (not shown) and separated from the intermediate transfer belt 69, and transported to the fixing unit 700, at which toner images are fused and fixed on the transfer sheet at a nip of the fixing rollers 701*a* and 701*b*, and ejected outside by an ejection roller 702. After transferring toner images to the transfer sheet, the surface of the intermediate transfer belt 69 is cleaned by the belt-cleaning unit 220 configured as similar to the cleaning unit 7. Further, the above-described image forming process using four colors can be similarly conducted for image forming process using two or three colors by designating color.

By employing the cleaning unit 7 according to exemplary embodiments for cleaning the photoconductor 1 of an image forming apparatus having a revolver-type developing unit shown in FIG. 40, toner particles remaining on a surface of the photoconductor 1 can be preferably removed even if remaining toner particles are a mixture of toner particles having positive and toner particles having negative polarity. Further, by employing the belt-cleaning unit 220, configured as similar to the cleaning unit 7, for cleaning the intermediate transfer belt 69, toner particles remaining on a surface of the intermediate transfer belt 69 can be preferably removed even if remaining toner particles are a mixture of toner particles having positive and negative polarity.

As above-described in exemplary embodiments for the cleaning unit 7, toner particles having positive and negative polarity adhered on the cleaning brush 111 can be preferably recovered under a lower temperature/lower humidity environment using the cleaning unit 7.

Further, as described with reference to FIG. 24, voltage polarity applied to a roller shaft of the high-resistance recovery roller 117*a* and a surface of the high-resistance recovery roller 117*a* can be changed by the switches 122*c* and 125*c* to recover toner particles having positive and negative polarity, by which toner particles having positive and negative polarity adhered on the cleaning brush 111 can be reliably recovered.

Further, as described in another exemplary embodiments, a configuration of using the switch 125*d* for switching ON/OFF of voltage application to the surface of the high-resistance recovery roller 117*a* or a configuration of using the switch 122*d* for switching ON/OFF of voltage application to the roller shaft of the high-resistance recovery roller 117*a* can be used. Such configuration including only one power source unit for positive or negative polarity can reduce a manufacturing cost of an image forming apparatus.

Further, the conductive blade 11 (used as charge control member) controls polarity of toner particles remaining on the photoconductor 1. For example, the conductive blade 11 may apply voltage having negative polarity to control polarity of toner particles remaining on the photoconductor 1, and the cleaning brush 111 may be applied with a voltage polarity, opposite to a polarity of the conductive blade 11, that is positive polarity. Accordingly, most of toner particles passed through the conductive blade 11 may be charged to negative polarity, and only a small amount of toner particles may have positive polarity that is a same polarity applied to the cleaning brush 111. Therefore, toner amount having a polarity the same as voltage polarity applied to the cleaning brush 111 can be reduced. Further, a charge amount of toner particles having a polarity the same as voltage polarity applied to the cleaning brush 111 can be decreased, by which toner particles having positive polarity may be weakly charged toner particles. Accordingly, toner particles having a polarity the same as voltage polarity applied to the cleaning brush 111 can be preferably removed by brush fibers of the cleaning brush 111, which are frictionally electrified.

Further, the conductive blade 11 contacting the photoconductor 1 can scrape toner remaining on the photoconductor 1, by which remaining toner amount input to the cleaning brush 111 can be reduced. Further, a charge control member using a conductive brush roller can simplify its apparatus configuration because the charge control member may not need a device for removing toner particles adhered on the charge control member.

Further, the conductive scraper 118*c*, contacted to a high-resistance recovery roller 117*a*, can be connected to a power source unit for applying a voltage to the conductive scraper 118*c*. Specifically, the surface charge applicator 126 is used to apply a voltage to the recovery roller 117*a*. With such configuration, electric charges can be applied to the surface of the recovery roller 117*a*, and toner particles can be removed from the cleaning brush 111 effectively.

Further, a brush fiber of the cleaning brush 111 has a surface formed of the insulating material 33, by which the conductive material 32 applied with a voltage may not contact toner particles. Accordingly, an electric charge introduction from the cleaning brush 111 to toner particles can be suppressed. Accordingly, toner particles may not be strongly charged to a voltage polarity applied to the cleaning brush ill, by which a cleaning-ability of the cleaning brush 111 can be maintained at a preferable level.

Further, in exemplary embodiments, toner particles adhered on the cleaning brush 111 can be effectively removed by the recovery roller 117 or 117*a*, by which a cleaning performance level of the cleaning brush 111 can be preferably maintained.

Further, the cleaning unit 7 according to exemplary embodiments is used to preferably clean or remove toner particles remaining on the photoconductor 1, by which a higher quality image can be produced by an image forming operation.

Further, as above described with reference to FIG. 39, the cleaning unit 7 according to exemplary embodiments can be employed in an image forming apparatus having one photosensitive drum used as photoconductor 1, and thereby toner remaining on the photosensitive drum can be preferably cleaned. Because toner remaining on the photoconductor 1 can be preferably cleaned from the photoconductor 1, toner having one color used for image forming may not intrude a developing unit using toner having another color, by which an undesired mixture of color toners may be suppressed or prevented, and a higher quality image can be produced by an image forming operation.

Further, as above described with reference to FIG. 38, the cleaning unit 7 according to exemplary embodiments can be employed in an image forming apparatus of tandem type, and thereby toner remaining on each of the photoconductors 1 can be preferably cleaned, and a higher quality image can be produced by an image forming operation.

Further, as above described with reference to FIGS. 38 to 40, a cleaning unit, having configured similarly the cleaning unit 7 according to exemplary embodiments, can be employed to clean an intermediate transfer member disposed in an image forming apparatus, and thereby toner remaining on the intermediate transfer member can be preferably cleaned, and a higher quality image can be produced by an image forming operation.

Further, as above described, spherical toner having a higher circularity is used in exemplary embodiments, in which spherical toner has the shape factor SF1 of from 100 to 150. The higher the sphericity of toner particles, two toner particles may contact each other with a point contact manner, or a toner particle and a photoconductor may contact each other with a point contact manner. Accordingly, toner particles may adhere each other with a weaker force and thereby fluidity of toner particles may be enhanced, or toner particles adhere the photoconductor with a weaker force and thereby transferability of toner particles may be enhanced. Therefore, a higher quality image can be produced by an image forming operation.

Further, because the photoconductor 1 may have a surface layer or photosensitive layer dispersed with filler material, which may suppress a layer scraping phenomenon of the photoconductor 1, an abrasion resistance of the photoconductor 1 can be enhanced. Accordingly, an occurrence of concavities and convexities on the surface of the photoconductor 1 by abrasion can be suppressed. As a result, the photoconductor 1 and a cleaning blade (e.g., conductive blade 11) can maintain a contact pressure uniformly along a shaft direction or axial direction of the photoconductor 1. Accordingly, between the photoconductor 1 and the cleaning blade, an occurrence of a contact portion having a lower contact pressure compared to other contact portion having a normal contact pressure may be suppressed, by which a passing through of toner particles, not cleaned by the cleaning blade, can be suppressed.

Further, as above described, the photoconductor 1 may have a surface protection layer made of binder resin having cross-linked structure, by which anti-abrasiveness of the photoconductor 1 can be enhanced.

Further, as above described, by including a charge transport layer in a structure of binder resin, an electric stability of the photoconductor 1 can be enhanced.

Further, as above described, by integrating the photoconductor 1 and at least the cleaning unit 7 as the process cartridge 300, the photoconductor 1 and the cleaning unit 7 can be easily detachable and mountable with respect to an image forming apparatus, by which a replacement work of units can be conducted easily.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A cleaning apparatus for removing charged particles from a surface of an object, comprising:

a cleaning brush configured to remove the charged particles from the surface of the object, moving in a given direction, by attracting the charged particles to the cleaning brush, the cleaning brush configured to attract the charged particles having positive and negative polarity from the object;

a brush charge applicator configured to apply an electric charge to the cleaning brush; and a recovery unit, configured to recover the charged particles adhering to the cleaning brush, including:

a recovery member configured to be supplied with a given voltage and configured to contact the cleaning brush to electrostatically attract the charged particles from the cleaning brush, the recovery member having a core made of a conductive material and a surface layer formed on the core, the surface layer being made of an insulating material;

a first charge applicator configured to apply a given voltage polarity directly to the surface layer of the recovery member;

a second charge applicator configured to apply a given voltage polarity directly to the core of the recovery member; and a voltage control unit configured to control a polarity of the given voltage to be applied by the first charge applicator and the second charge applicator depending on a polarity of the charged particles to be recovered by the recovery unit.

2. The cleaning apparatus according to claim 1, wherein:

the first charge applicator has a switch for switching a voltage polarity to be applied to the surface layer of the recovery member; and the second charge applicator has a switch for switching a voltage polarity to be applied to the core of the recovery member, the voltage control unit controlling a timing of a switching of the switches of the first charge applicator and of the second charge applicator.

3. The cleaning apparatus according to claim 1, wherein:

the first charge applicator has a switch for switching a voltage polarity to be applied to the surface layer of the recovery member; and the second charge applicator has an ON/OFF switch for applying a given voltage polarity to the core of the recovery member, the voltage control unit controlling a switching timing of the switches of the first charge applicator and the second charge applicator.

4. The cleaning apparatus according to claim 1, wherein:

the first charge applicator has an ON/OFF switch for applying a given voltage polarity to the surface layer of the recovery member; and the second charge applicator has a switch for switching a voltage polarity to be applied to the core of the recovery member, the voltage control unit controlling a switching timing of the switches of the first charge applicator and the second charge applicator.

5. The cleaning apparatus according to claim 1, further comprising a charge control device configured to control a charge condition of the charged particles on the object, the charge control device disposed at a position facing a surface of the object at an upstream side of a surface movement direction of the object with respect to a position at which the cleaning brush contacts the object.

6. The cleaning apparatus according to claim 5, wherein the charge control device is a conductive blade configured to contact the object.

7. The cleaning apparatus according to claim 1, wherein the first charge applicator has a conductive member configured to contact the surface layer of the recovery member, and a power source unit configured to apply a given voltage polarity to the conductive member.

8. The cleaning apparatus according to claim 1, wherein the cleaning brush has brush fibers having a surface made of an insulating material.

9. The cleaning apparatus according to claim 8, wherein the brush fibers of the cleaning brush have brush edges, electrifiable to a polarity opposite to a voltage polarity applied to the cleaning brush, with friction of the brush edges against the object.

10. The cleaning apparatus according to claim 1, wherein the recovery member is made of a material having higher electric resistance.

11. The cleaning apparatus according to claim 1, wherein the charged particles are toner particles.

12. An image forming apparatus, comprising:

an image carrier;

a charge unit configured to charge the image carrier;

a writing unit configured to write a latent image on the image carrier charged by the charge unit;

a developing unit configured to develop the latent image on the image carrier as a toner image using toner particles;

a transfer unit configured to transfer the toner image from the image carrier to a transfer member or a recording member; and a first cleaning apparatus configured to remove toner particles remaining on a surface of the image carrier after transferring the toner image, the first cleaning apparatus including:

a cleaning brush configured to remove the toner particles from the surface of the image carrier, moving in a given direction, by attracting the toner particles charged to a given polarity to the cleaning brush, the cleaning brush configured to attract the charged toner particles having positive and negative polarity from the image carrier;

a brush charge applicator configured to apply an electric charge to the cleaning brush; and a recovery unit, configured to recover the charged toner particles adhering to the cleaning brush, including:

a recovery member configured to be supplied with a given voltage and configured to contact the cleaning brush to electrostatically attract the charged toner particles from the cleaning brush, the recovery member having a core made of a conductive material and a surface layer formed on the core, the surface layer being made of an insulating material;

a first charge applicator configured to apply a given voltage polarity directly to the surface layer of the recovery member;

a second charge applicator configured to apply a given voltage polarity directly to the core of the recovery member; and a voltage control unit configured to control the given voltage to be applied by the first charge applicator and the second charge applicator depending on a polarity of the charged particles to be recovered by the recovery unit.

13. The image forming apparatus according to claim 12, wherein the image carrier includes a single image carrier and the developing unit is one of a plurality of developing units configured to form an image having a plurality of colors by superimposing a plurality of different color images on the single image carrier.

14. The image forming apparatus according to claim 12, wherein the image carrier and the developing unit are integrated as one image forming unit, and the image forming unit is one of a plurality of image forming units configured to form an image having a plurality of colors by superimposing a plurality of different color images on the image carrier.

15. The image forming apparatus according to claim 12, further comprising an intermediate transfer member as the transfer member and a second cleaning apparatus, wherein the intermediate transfer member is configured to be transferred with the toner image from the image carrier, and the second cleaning apparatus, having a configuration equivalent to the first cleaning apparatus, cleans a surface of the intermediate transfer member.

16. The image forming apparatus according to claim 12, wherein the toner particles have a shape factor SF1 of from 100 to 150.

17. The image forming apparatus according to claim 12, wherein the image carrier has a surface protection layer comprising a particulate filler therein.

18. The image forming apparatus according to claim 12, wherein the image carrier has a surface protection layer made of high-polymer materials having cross-linked structure.

19. The image forming apparatus according to claim 18, wherein the surface protection layer has a charge transport layer therein.

20. The image forming apparatus according to claim 12, wherein the image carrier and the first cleaning apparatus are integrated as a process cartridge detachably mountable in the image forming apparatus.

* * * * *